US009817337B2

(12) United States Patent
Eto

(10) Patent No.: US 9,817,337 B2
(45) Date of Patent: Nov. 14, 2017

(54) IMAGE FORMING APPARATUS THAT RESTRAINS USE OF APPARATUS IN STATE WHERE DEVELOPER IS NOT REPLENISHABLE

(71) Applicant: Kyocera Document Solutions Inc., Osaka (JP)

(72) Inventor: Daisuke Eto, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 15/261,950

(22) Filed: Sep. 11, 2016

(65) Prior Publication Data

US 2017/0075256 A1 Mar. 16, 2017

(30) Foreign Application Priority Data

Sep. 11, 2015 (JP) ..... 2015-179442

(51) Int. Cl.
*G03G 15/08* (2006.01)
*G03G 21/16* (2006.01)

(52) U.S. Cl.
CPC ..... *G03G 15/0886* (2013.01); *G03G 15/0865* (2013.01); *G03G 21/1633* (2013.01); *G03G 21/1676* (2013.01)

(58) Field of Classification Search
CPC ..... G03G 15/0886; G03G 15/0865; G03G 21/1633; G03G 21/1676; G03G 2215/0692; G03G 2221/163
USPC ..... 399/258, 260, 262, 119, 120
See application file for complete search history.

(56) References Cited

U.S. PATENT DOCUMENTS

2014/0286679 A1* 9/2014 Nakamura ..... G03G 21/1633 399/258
2014/0376971 A1* 12/2014 Tanaka ..... G03G 21/1676 399/260
2015/0147095 A1* 5/2015 Iketani ..... G03G 15/0886 399/258
2015/0234320 A1* 8/2015 Lee ..... G03G 15/0886 399/260

FOREIGN PATENT DOCUMENTS

JP 2012-230280 A 11/2012

* cited by examiner

*Primary Examiner* — Sophia S Chen
(74) *Attorney, Agent, or Firm* — James Judge

(57) ABSTRACT

An image forming apparatus includes an apparatus main body, an image carrier, a developing device, a developer housing container, and a regulating member. The developer housing container takes a posture changeable between a first posture and a second posture. The developer discharge port communicates with the developer replenishment port such that the developer is replenishable to the developing device in the first posture. The second posture locates the developer discharge port separate from the developer replenishment port and seals the developer discharge port. The regulating member allows the cover member to be closed with respect to the apparatus main body while the developer housing container takes the first posture in the apparatus main body. The regulating member regulates the cover member to be closed with respect to the apparatus main body by an interference with the developer housing container while the developer housing container takes the second posture.

9 Claims, 45 Drawing Sheets

IMAGE FORMING APPARATUS THAT RESTRAINS USE OF APPARATUS IN STATE WHERE DEVELOPER IS NOT REPLENISHABLE

INCORPORATION BY REFERENCE

This application is based upon, and claims the benefit of priority from, corresponding Japanese Patent Application No. 2015-179442 filed in the Japan Patent Office on Sep. 11, 2015, the entire contents of which are incorporated herein by reference.

BACKGROUND

Unless otherwise indicated herein, the description in this section is not prior art to the claims in this application and is not admitted to be prior art by inclusion in this section.

As a typical image forming apparatus that forms images on sheets, there has been known an image forming apparatus that includes an apparatus main body, a photoreceptor drum (an image carrier), a developing device, and a developer housing container. The developing device supplies the photoreceptor drum with a developer. This develops an electrostatic latent image on the photoreceptor drum. The developer housing container replenishes the developing device with the developer.

There has been disclosed a technique where a developer housing container is removably attachable to an apparatus main body. With the technique, a cover member on the apparatus main body is opened to mount a developer housing container inside the apparatus main body. When a developer discharge port on the developer housing container communicates with a developer replenishment port on the developing device, a developer is replenishable to the developing device.

SUMMARY

An image forming apparatus according to one aspect of the disclosure includes an apparatus main body, an image carrier, a developing device, a developer housing container, and a regulating member. The apparatus main body includes an openable/closable cover member and an internal space. The image carrier is located in the apparatus main body. The mage carrier has a circumference surface on which an electrostatic latent image is formed by rotationally driving the image carrier. The developing device includes a developer replenishment port to which a developer is replenished. The developing device supplies the image carrier with the developer. The developer housing container includes a developer discharge port from which the developer is discharged. The developer housing container takes a posture changeable between a first posture and a second posture in which the developer housing container is mountable to the internal space with the cover member open and internally houses the developer. The developer discharge port communicates with the developer replenishment port such that the developer is replenishable to the developing device in the first posture. The second posture locates the developer discharge port separate from the developer replenishment port and seals the developer discharge port. The regulating member is located in the cover member. The regulating member allows the cover member to be closed with respect to the apparatus main body while the developer housing container takes the first posture in the apparatus main body. The regulating member regulates the cover member to be closed with respect to the apparatus main body by an interference with the developer housing container while the developer housing container takes the second posture.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
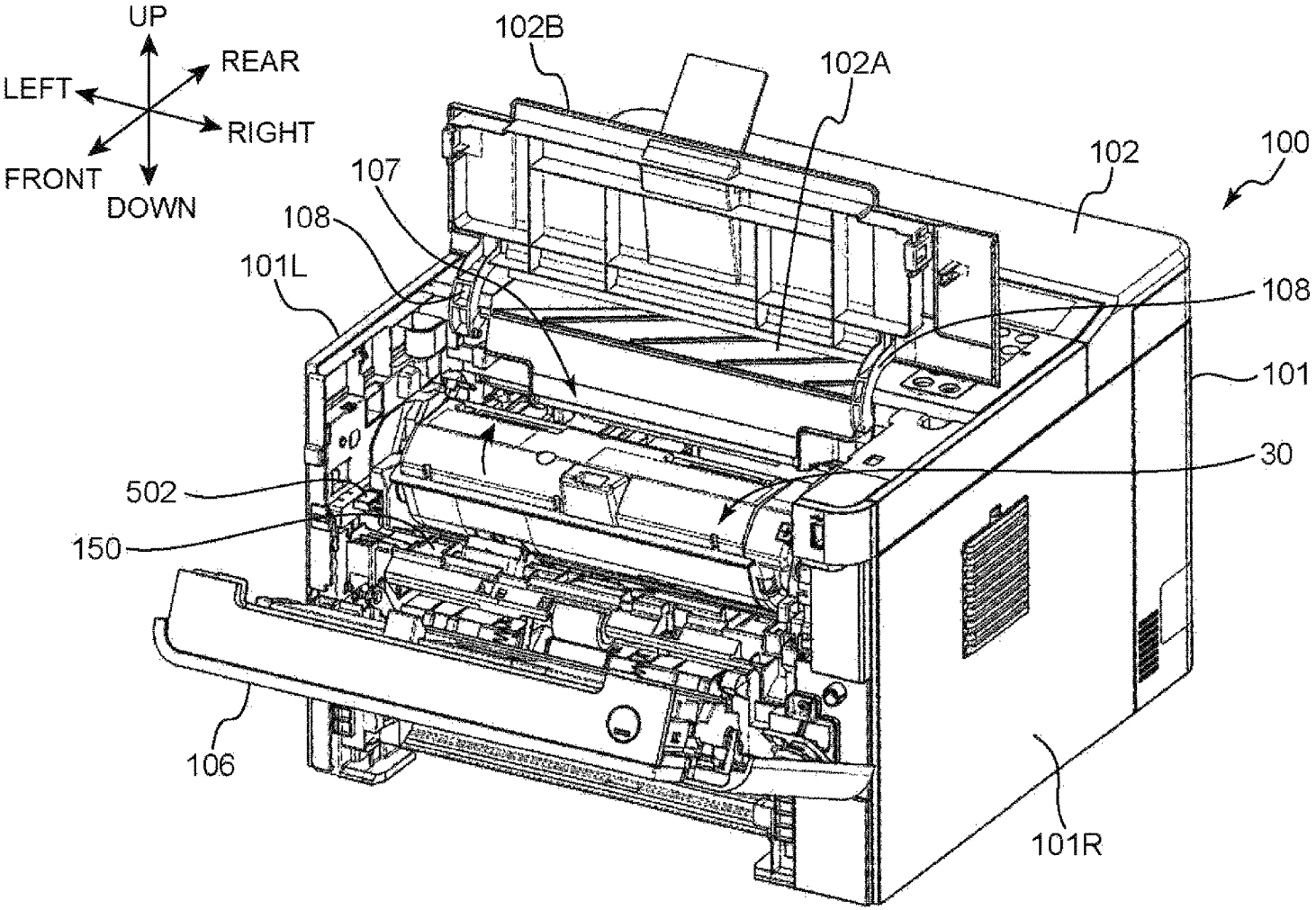
FIG. 1 obliquely illustrates an image forming apparatus according to one embodiment of the disclosure.

Example apparatuses are described herein. Other example embodiments or features may further be utilized, and other changes may be made, without departing from the spirit or scope of the subject matter presented herein. In the following detailed description, reference is made to the accompanying drawings, which form a part thereof.

The example embodiments described herein are not meant to be limiting. It will be readily understood that the aspects of the present disclosure, as generally described herein, and illustrated in the drawings, can be arranged, substituted, combined, separated, and designed in a wide variety of different configurations, all of which are explicitly contemplated herein.

Figure 2:
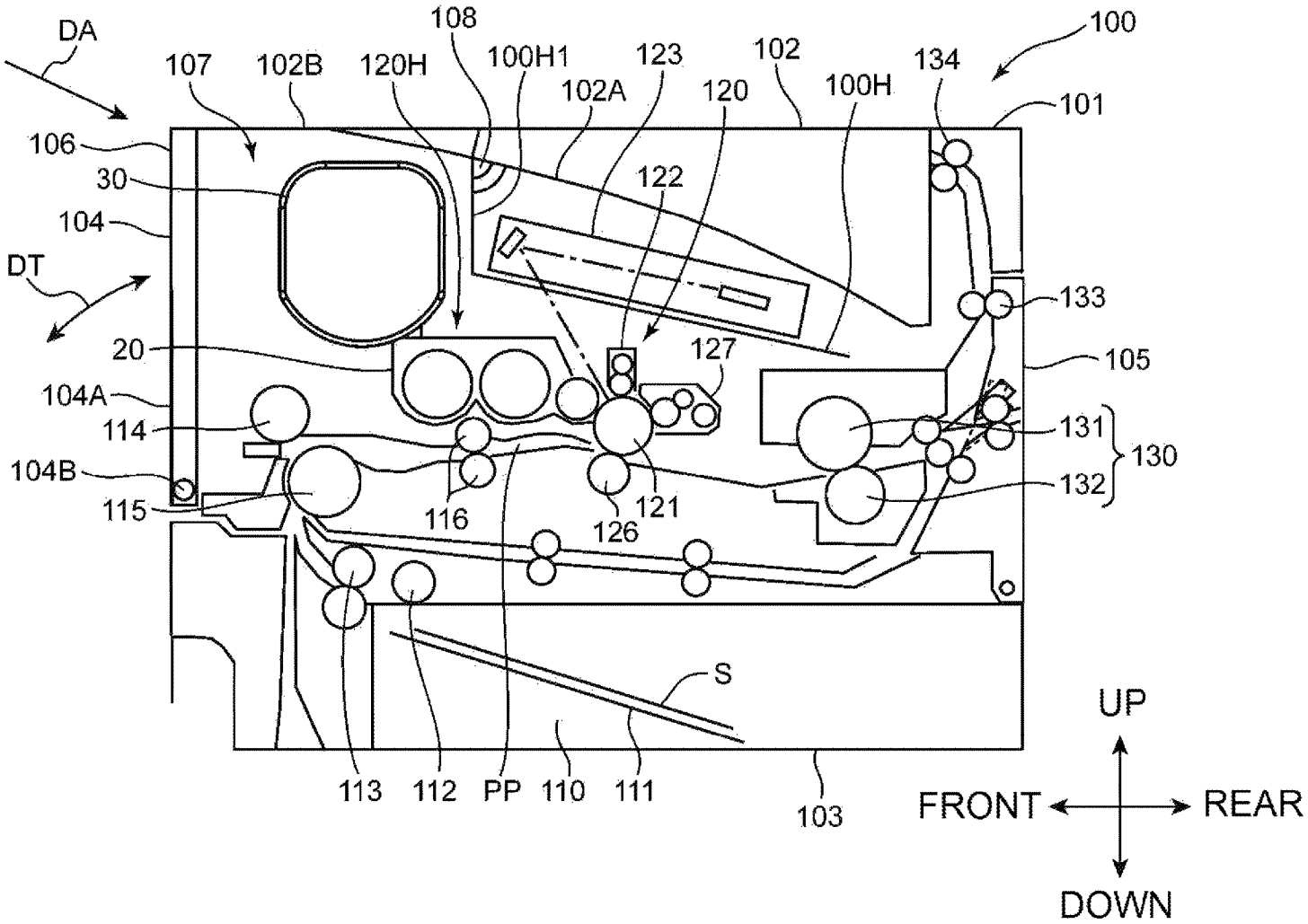
FIG. 2 illustrates a cross section inside the image forming apparatus according to the one embodiment.

Referring to the drawings, the following describes one embodiment of the disclosure. FIG. 1 obliquely illustrates a printer 100 (an image forming apparatus) according to the embodiment. FIG. 2 schematically illustrates a cross section of the internal structure of the printer 100. While the printer 100 illustrated in FIGS. 1 and 2 is, what is called, a black-and-white printer, the image forming apparatus may be a color printer, a facsimile device, a multi-functional peripheral that includes these functions, and other apparatuses for forming toner images on sheets in other embodiments. In the following description, directional terms like "up," "down," "front," "rear," "left," and "right" are simply used for clarifying the description without limiting principles of the image forming apparatus.

The printer 100 includes a housing 101 (an apparatus main body) that houses various devices for forming images on a sheet S. The housing 101 includes an upper wall 102 defining the top surface of the housing 101, a bottom wall 103 defining the bottom surface of the housing 101, a main-body rear wall 105 between the upper wall 102 and the bottom wall 103, and a main-body front wall 104 located in front of the main-body rear wall 105. The housing 101 includes a main-body internal space 107 (an internal space) where various kinds of devices are arranged. In the main-body internal space 107 of the housing 101, a sheet conveyance path PP that conveys the sheet S in a predetermined conveyance direction runs. The housing 101 includes a pair of a left-side wall 101L and a right-side wall 101R (see FIG. 1). The left-side wall 101L and the right-side wall 101R are wall portions that form the left and right side surfaces of the housing 101.

In the center of the upper wall 102, a paper sheet discharge unit 102A is arranged. The paper sheet discharge unit 102A has an inclined surface inclining downward from the front portion toward the rear portion of the upper wall 102. The sheet S with images formed in an image formation unit 120, which will be described later, is discharged into the paper sheet discharge unit 102A. In the main-body front wall 104, a front cover 106 (a cover member) and a manual bypass tray 104A are arranged. The front cover 106 and the manual bypass tray 104A are vertically openable/closable using respective lower end sides as fulcrums (an arrow DT in FIG. 2). The manual bypass tray 104A is turnable with respect to the front cover 106. The manual bypass tray 104A includes a tray fulcrum 104B, which serves as the fulcrum. FIG. 1 illustrates a state where the front cover 106 including the manual bypass tray 104A is open to the housing 101. With a closed state with respect to the housing 101, the front cover 106 and the manual bypass tray 104A constitute a part of the main-body front wall 104.

On the other hand, a front end portion 102B of the upper wall 102 is turnable rearward with an arm 108 as a fulcrum (see FIG. 1). As illustrated in FIG. 1, when the front end portion 1026 of the upper wall 102 and the front cover 106 are each opened, the main-body internal space 107 is exposed outside the printer 100. This results in that an image forming unit 120H and a toner container 30, which will be described later, are attachable inside the housing 101. When the sheet S gets stuck in the sheet conveyance path PP, the sheet S will become removable.

Referring to FIG. 2, the printer 100 includes a cassette 110, a pickup roller 112, a first feed roller 113, a second feed roller 114, a conveyance roller 115, a registration roller pair 116, the image formation unit 120, and a fixing unit 130.

The cassette 110 internally houses the sheets S. The cassette 110 includes a lift plate 111. The lift plate 111 inclines so as to push up the leading edge of the sheet S. The cassette 110 is extractable forward with respect to the housing 101.

The pickup roller 112 is arranged on the leading edge of the sheet S pushed up by the lift plate 111. Rotation of the pickup roller 112 pulls the sheet S out of the cassette 110.

The first feed roller 113 is located in the downstream side of the pickup roller 112 and further sends out the sheet S downstream. The second feed roller 114 is located in the inside (the rear side) of the fulcrum of the manual bypass tray 104A and pulls the sheet S on the manual bypass tray 104A inside the housing 101.

The conveyance roller 115 is located in the downstream side (hereinafter also simply referred to as a downstream) of a sheet conveyance direction (hereinafter also simply referred to as a conveyance direction) of the first feed roller 113 and the second feed roller 114. The conveyance roller 115 further conveys the sheet S, which is sent out by the first feed roller 113 and the second feed roller 114, downstream.

The registration roller pair 116 has a function of correcting an oblique conveyance of the sheet S. This adjusts a position of an image to be formed on the sheet S. The registration roller pair 116 supplies the image formation unit 120 with the sheet S in accordance with timing of the image formation by the image formation unit 120.

The image formation unit 120 includes a photoreceptor drum 121 (an image carrier), a charger 122, an exposure apparatus 123, a developing device 20, the toner container 30 (the developer housing container), a transfer roller 126, and a cleaning apparatus 127. As will be described later, the developing device 20 and the toner container 30 are integrally removably attachable with respect to the housing 101 as the image forming unit 120H.

The photoreceptor drum 121 has a cylindrical shape and is rotatably supported by the housing 101. The photoreceptor drum 121 has a circumference surface where an electrostatic latent image is formed and carries a toner image (a developer image) corresponding to this electrostatic latent image on the circumference surface. The charger 122 applied with a predetermined voltage causes the circumference surface of the photoreceptor drum 121 to be approximately evenly charged.

The exposure apparatus 123 irradiates the circumference surface of the photoreceptor drum 121 charged by the charger 122 with a laser beam. This laser beam is irradiated in accordance with image data output from an external device (not illustrated) such as a personal computer communicatively connected to the printer 100. This results in forming the electrostatic latent image corresponding to the image data on the circumference surface of the photoreceptor drum 121. The exposure apparatus 123 is supported by a support frame 100H (see FIG. 2). The support frame 100H is a frame located inside the housing 101. The support frame 100H is located along the paper sheet discharge unit 102A inclined downward toward the rear. A frame front wall 100H1 is located upright at the front end portion of the support frame 100H. The frame front wall 100H1 is a wall portion extending in a vertical direction immediately below the paper sheet discharge unit 102A. The frame front wall 100H1 is located opposed to the toner container 30 (see FIG. 2).

The developing device 20 supplies toner to the circumference surface of the photoreceptor drum 121 on which the electrostatic latent image is formed. The toner container 30 internally houses the toner and replenishes the toner to the developing device 20. The toner container 30 is located to be removably attachable with respect to the developing device 20. Supplying the toner to the photoreceptor drum 121 by the developing device 20 develops (visualizes) the electrostatic latent image formed on the circumference surface of the photoreceptor drum 121. This results in forming the toner image (the developer image) on the circumference surface of the photoreceptor drum 121.

The transfer roller 126 is arranged facing the photoreceptor drum 121 while sandwiching the sheet conveyance path PP under the photoreceptor drum 121. The transfer roller 126 forms a transfer nip portion with the photoreceptor drum 121 and transfers the toner image to the sheet S.

The cleaning apparatus 127 removes the toner left on the circumference surface of the photoreceptor drum 121 after the toner image has been transferred to the sheet S.

The fixing unit 130 is arranged in the downstream side of the conveyance direction with respect to the image formation unit 120 and fixes the toner image on the sheet S. The fixing unit 130 includes a heating roller 131 that melts the toner on the sheet S and a pressure roller 132 that causes the sheet S to be brought into close abutment on the heating roller 131.

The printer 100 further includes a conveyance roller pair 133 located in the downstream side of the fixing unit 130 and a discharge roller pair 134 located in the downstream side of the conveyance roller pair 133. The sheet S is conveyed upward by the conveyance roller pair 133 and is finally discharged out of the housing 101 by the discharge roller pair 134. The sheet S discharged out of the housing 101 is stacked on the paper sheet discharge unit 102A.

Structure of Image Forming Unit

Figure 3:
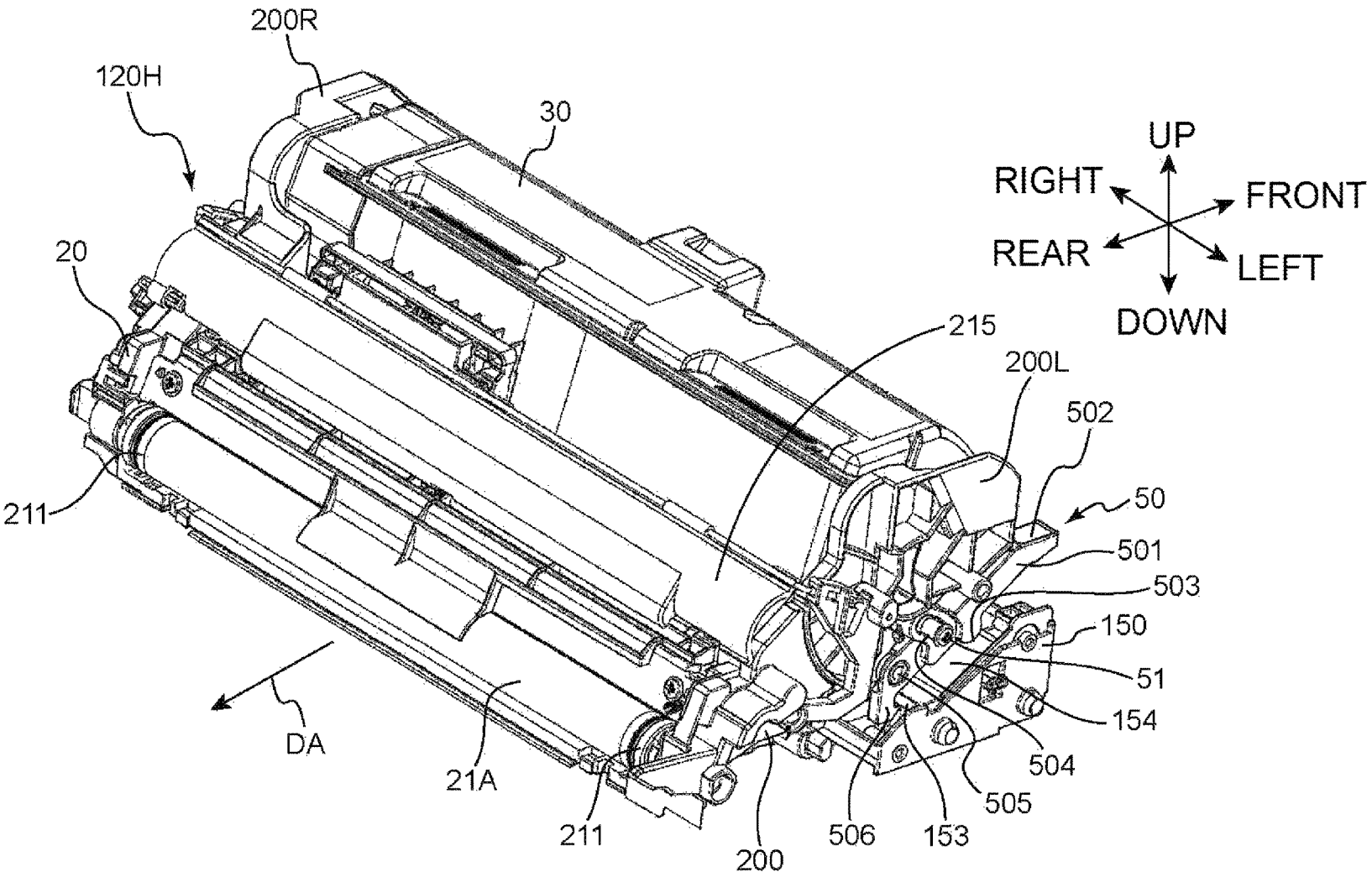
FIG. 3 obliquely illustrates a part of an image forming unit and an apparatus main body according to the one embodiment.
Figure 4:
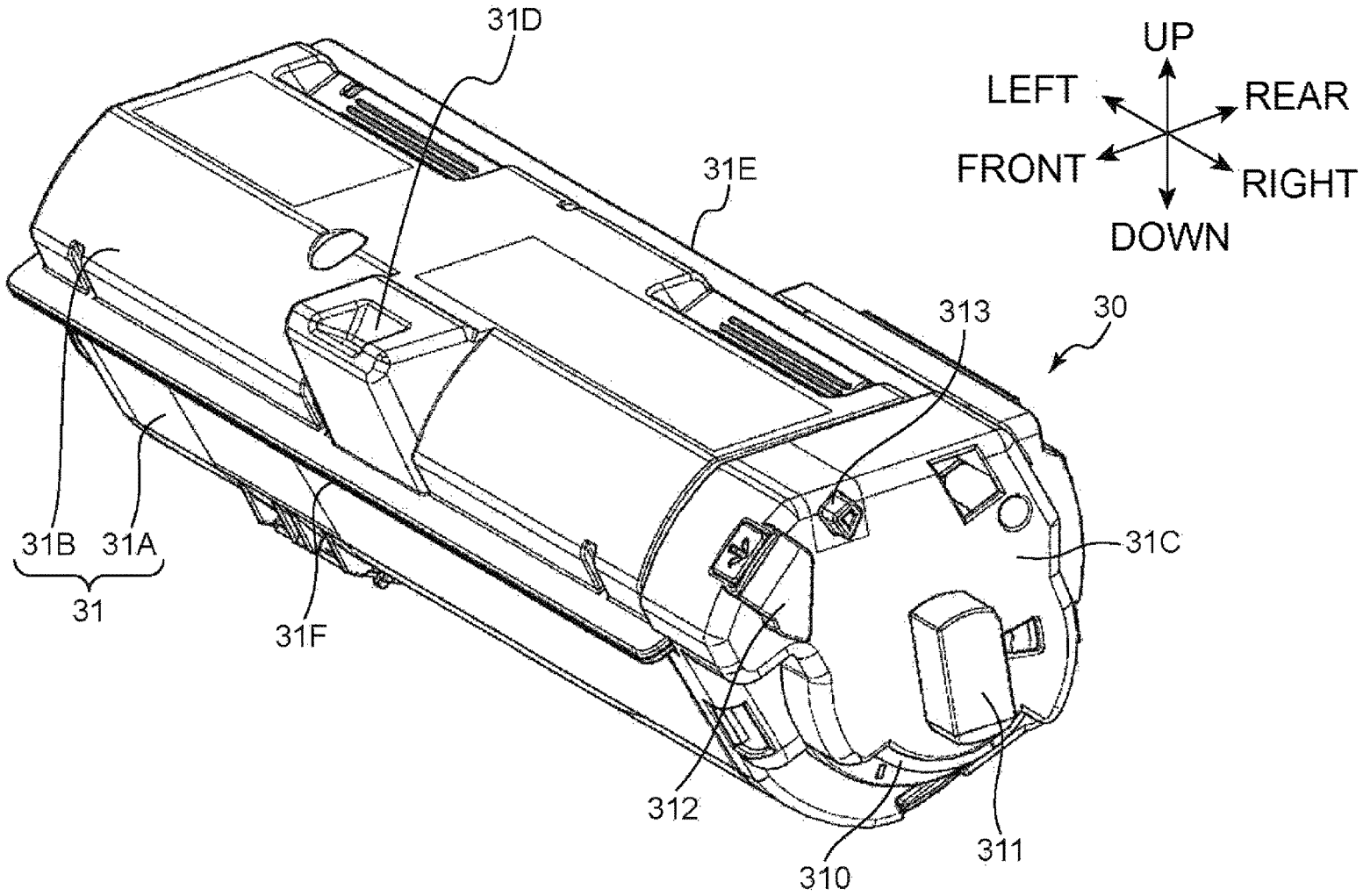
FIG. 4 obliquely illustrates a developer housing container according to the one embodiment.
Figure 5:
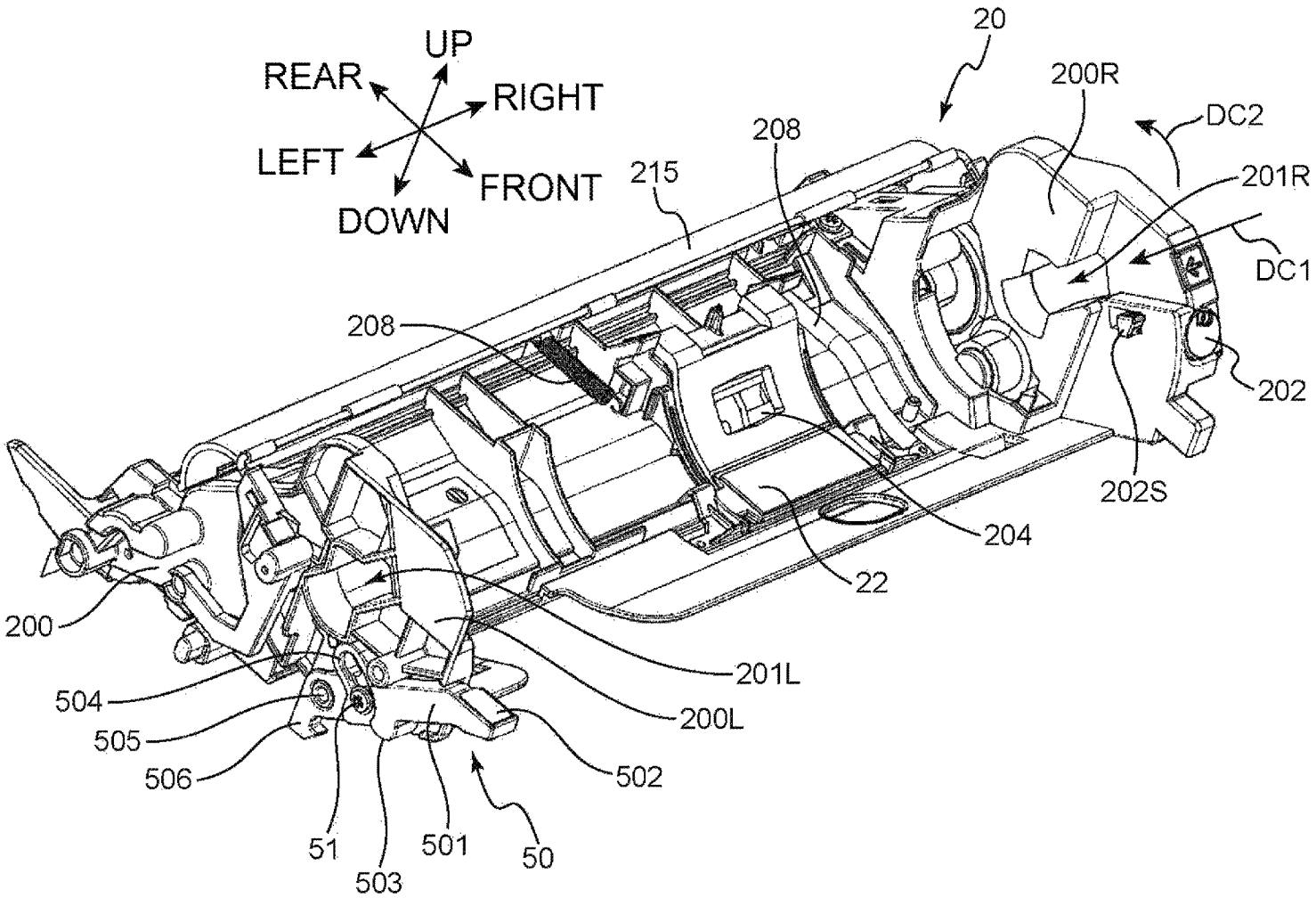
FIG. 5 obliquely illustrates a developing device according to the one embodiment.
Figure 6:
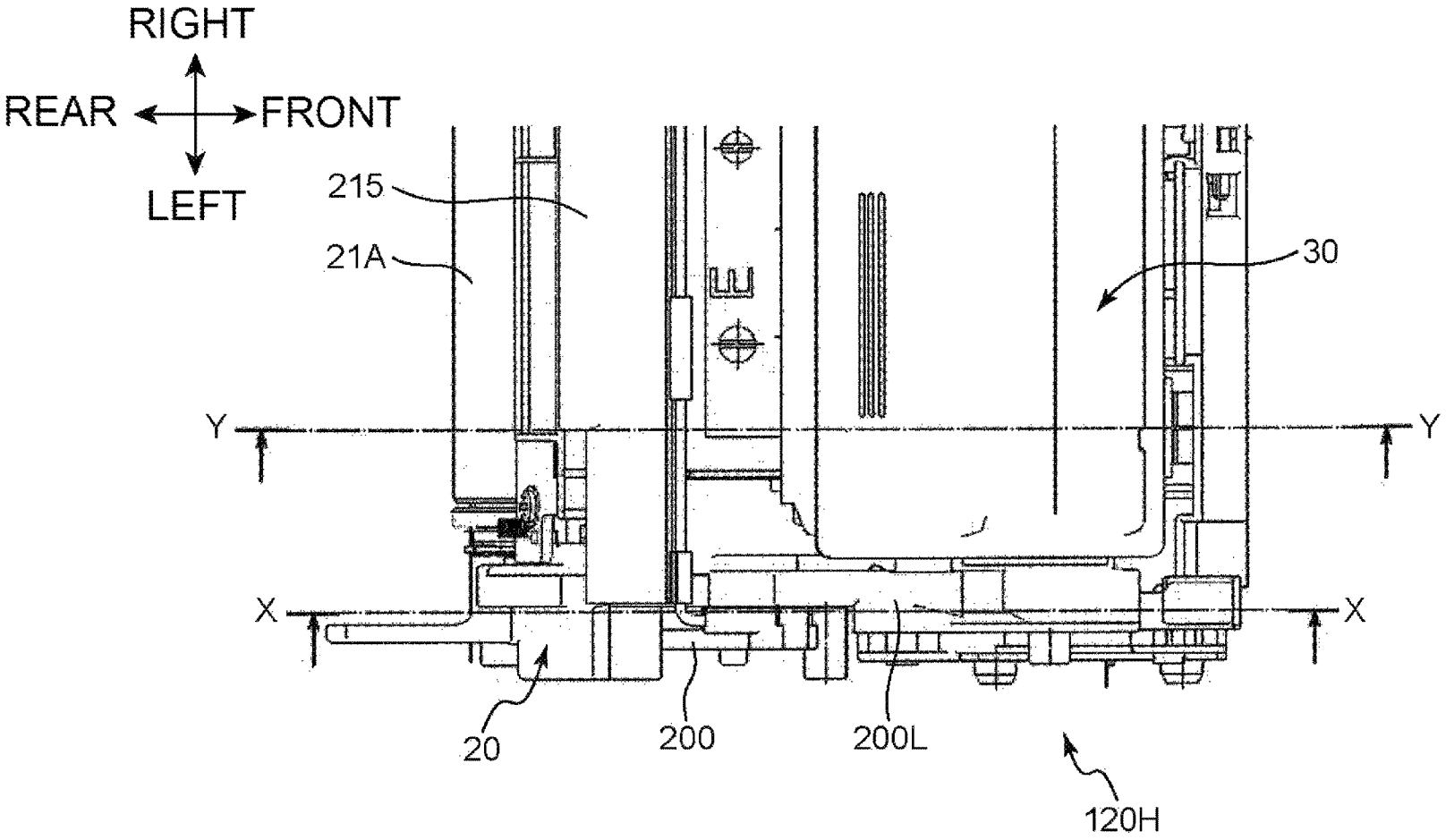
FIG. 6 illustrates a part of a top surface of the image forming unit according to the one embodiment.

Next, referring to FIGS. 3 to 10, the following describes in detail the image forming unit 120H (the developing device 20 and the toner container 30) according to the embodiment. FIG. 3 obliquely illustrates the image forming unit 120H and a main body unit 150 (a part of the housing 101), which will be described later, according to the embodiment. FIG. 4 obliquely illustrates the toner container 30 according to the embodiment. FIG. 5 obliquely illustrates the developing device 20 according to the embodiment. FIG. 6 illustrates a part of the top surface of the image forming unit 120H. FIGS. 7 to 10 illustrate cross sections of the image forming unit 120H and the main body unit 150. The respective cross-sectional views of FIGS. 7 and 8 correspond to the cross-sectional view at X-X line in FIG. 6, and the respective cross-sectional views of FIGS. 9 and 10 correspond to the cross-sectional view at Y-Y line in FIG. 6.

As described above, the image forming unit 120H (see FIG. 3) includes the developing device 20 and the toner container 30. The image forming unit 120H is removably attachable along a predetermined attachment/detachment direction with respect to the housing 101. This results in that the toner container 30 is attachable to the housing 101, integrally with the developing device 20. When the developing device 20 is first mounted to the housing 101, the toner container 30 is independently mounted to the developing device 20 inside the housing 101. An arrow DA in FIGS. 2 and 3 indicates an attachment direction of the image forming unit 120H relative to the housing 101.

Figure 7:
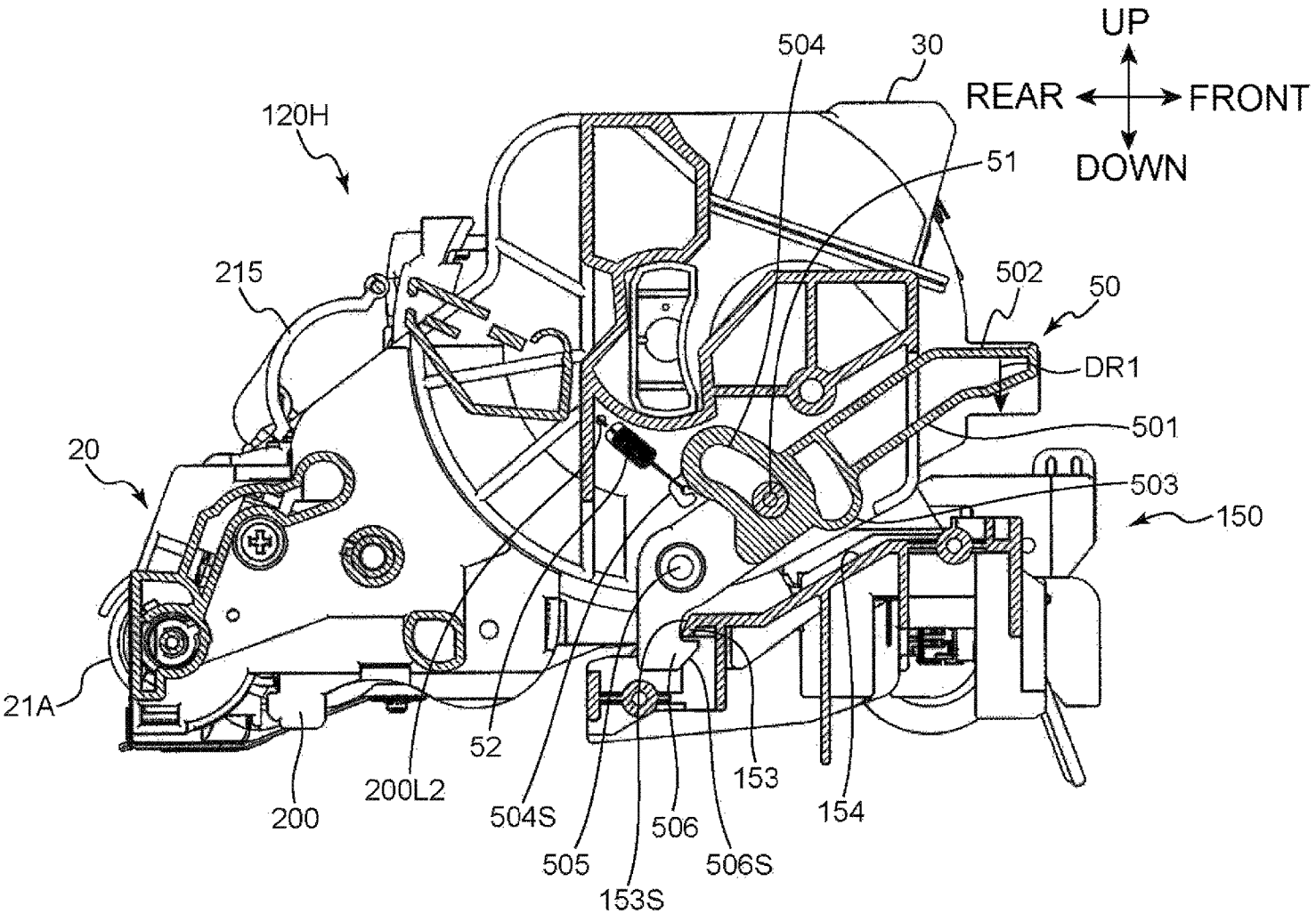
FIG. 7 illustrates a part of a cross section of the image forming unit and the apparatus main body according to the one embodiment.

Further, the printer 100 includes the main body unit 150 (see FIGS. 3 and 7). The main body unit 150 is arranged in the housing 101 and guides an attachment/detachment of the image forming unit 120H. As illustrated in FIG. 1, opening the front cover 106 with respect to the housing 101 exposes the main body unit 150 outside the housing 101. The image forming unit 120H is mounted in the main-body internal space 107 of the housing 101 such that the image forming unit 120H passes through over the main body unit 150. As it appears in FIG. 3, the main body unit 150 has an approximately triangular shape from the side view and is a unit extending long in the lateral direction. The main body unit 150 includes positioning mechanisms 150S (see FIG. 9), an engaged portion 153 (see FIGS. 3 and 7), and a guide surface 154.

A pair of the positioning mechanisms 150S are arranged at both the end portions in the lateral direction of the main body unit 150. The positioning mechanism 150S includes an urging protrusion 151 and a unit urging spring 152. The urging protrusion 151 is brought into abutment on a housing pressed portion 200K (see FIG. 9) of the image forming unit 120H mounted to the housing 101. The unit urging spring 152 urges the urging protrusion 151 toward the rear. In other words, the unit urging spring 152 urges the image forming unit 120H that is mounted at an image forming position inside the housing 101 toward the rear, and thus positions the image forming unit 120H.

The guide surface 154 (see FIG. 7) is formed on the top surface portion of the main body unit 150. The guide surface 154 has a function of guiding the attachment of the image forming unit 120H. The guide surface 154 has an inclined surface extending downward from the front toward the rear. Of the guide surface 154, the further rear end side of this inclined surface is configured to be a horizontal surface. The engaged portion 153 is arranged in the distal end side of the attachment direction (the arrow DA direction in FIG. 3) of the image forming unit 120H with respect to the guide surface 154. A hook 506 (see FIG. 7) of a lock lever 50, which will be described later, is engageable with the guide surface 154.

Referring to FIG. 4, the toner container 30 houses toner (developer) inside. The toner container 30 includes a container main body 31 and a container cover 31C. The container main body 31 has a shape extending in the lateral direction (the longitudinal direction). The container main body 31 includes a main unit 31A and a lid portion 31B. The main unit 31A defines a lower part of the container main body 31. The top surface portion of the container main unit 31A has an opening.

The lid portion 31B is secured to the main unit 31A such that the lid portion 31B covers the opening of the main unit 31A. In the embodiment, the lid portion 31B is welded and fixed to the main unit 31A. The main unit 31A and the lid portion 31B are secured at a container flange 31F, which is formed along a peripheral edge of the opening of the main unit 31A. The lid portion 31B includes a first grip portion 31D and a second grip portion 31E. When the toner container 30 is mounted to the developing device 20 or when the image forming unit 120H, which includes the toner container 30 and the developing device 20, is mounted to the housing 101, an operator is allowed to grip the first grip portion 31D and the second grip portion 31E.

The container cover 31C is mounted in the right side portion of the container main body 31. The container cover 31C includes a right-side guide 311, a transmission gear 310, a first lock engaging portion 312, and a second lock engaging portion 313. The right-side guide 311 is a guide that is located to protrude from the container cover 31C and has an approximately rectangular parallelepiped shape. Although not appearing in FIG. 4, a left-side guide 301 with a shape identical to the right-side guide 311 is included in the side portion on the left side of the toner container 30 (see FIG. 11). These guides guide the attachment of the toner container 30 to the developing device 20. The transmission gear 310 is a gear that transmits a rotary drive power to a container paddle 30K, which will be described later. The first lock engaging portion 312 and the second lock engaging portion 313 are protrusions projected from the container cover 31C. Details of the first lock engaging portion 312 and the second lock engaging portion 313 will be described later.

Figure 9:
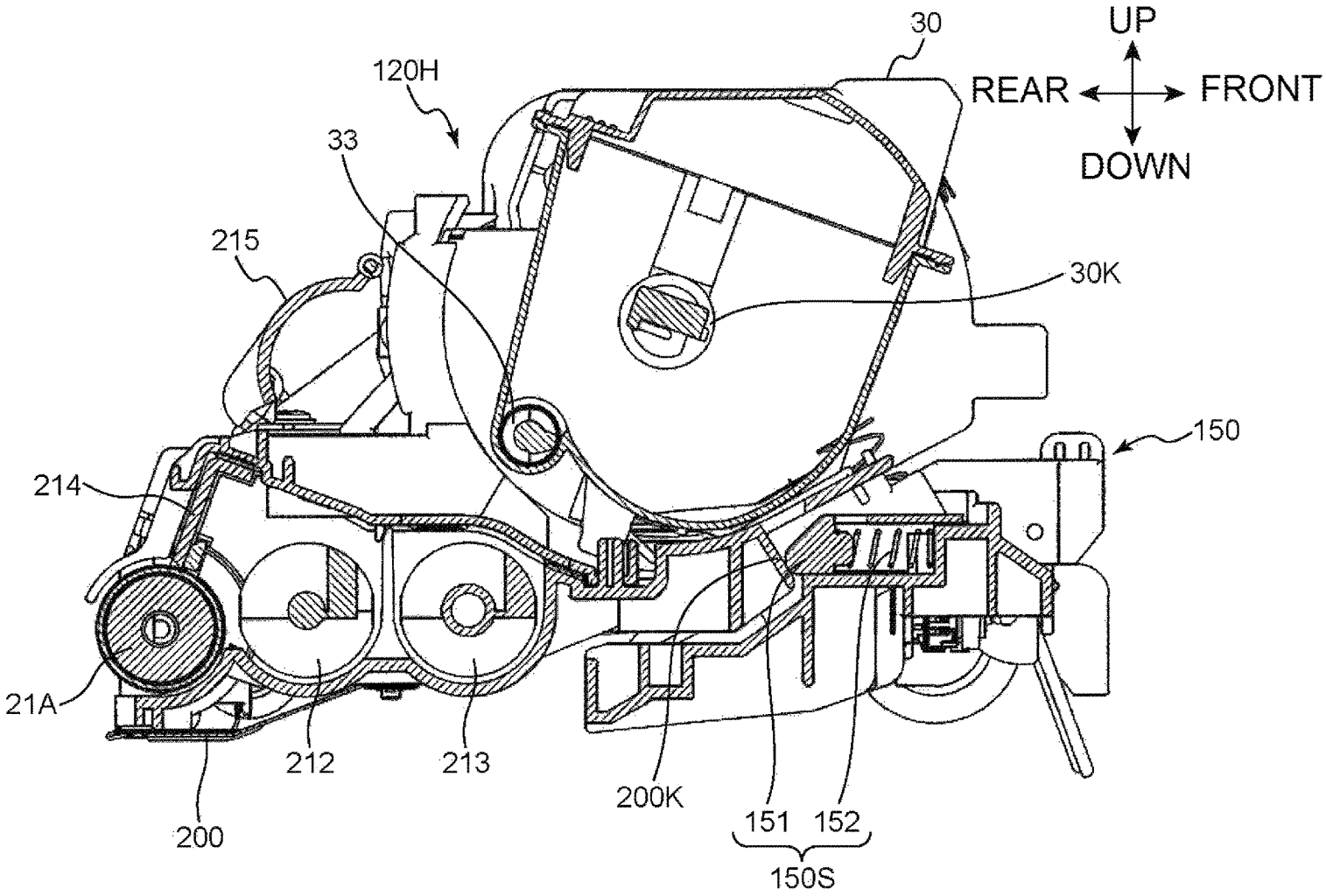
FIG. 9 illustrates a part of a cross section of the image forming unit and the apparatus main body according to the one embodiment.

Further, the toner container 30 includes a container screw 33 and the container paddle 30K (see FIG. 9).

The container screw 33 is a screw arranged along the bottom portion of the main unit 31A. The bottom portion of the main unit 31A has a toner discharge port 30P (see FIG. 12), which will be described later, with an opening. The container screw 33 is rotationally driven and conveys the toner inside the container main body 31 to the toner discharge port 30P. Slidingly moving a container shutter 32 (see FIG. 11), which will be described later, included in the container main body 31 opens the toner discharge port 30P and ensures discharge of the toner from the toner container 30. The container paddle 30K is rotatably supported inside the toner container 30 and stirs the toner housed inside the toner container 30.

The developing device 20 includes a development housing 200 (see FIG. 3), a developing roller 21A (see FIGS. 3 and 9), an abutting roller 211 (see FIG. 3), a first screw 212 (see FIG. 9), a second screw 213 (see FIG. 9), a layer thickness regulating member 214 (see FIG. 9), and a developing-roller cover 215.

The development housing 200 is a housing that supports the respective members of the developing device 20. The development housing 200 has a function to support the toner container 30. Referring to FIG. 5, the development housing 200 includes a housing-left-side wall 200L, a housing-right-side wall 200R, and a toner replenishment port 204 (a developer replenishment port). The housing-left-side wall 200L and the housing-right-side wall 200R are wall portions located upright from both the end portions in the lateral direction of the development housing 200. The toner container 30 is mounted between the housing-left-side wall 200L and the housing-right-side wall 200R.

The housing-right-side wall 200R includes a right-side guide groove 201R, a lock abutment piece 202S, and a lock button 202. The housing-left-side wall 200L includes a left-side guide groove 201L. The right-side guide groove 201R and the left-side guide groove 201L are guide grooves formed in the housing-right-side wall 200R and the housing-left-side wall 200L, respectively. These guide grooves are formed along the attachment direction (an arrow DC1 in FIG. 5) of the toner container 30 relative to the development housing 200. The above-described right-side guide 311 (see FIG. 4) of the toner container 30 enters the right-side guide groove 201R. The left-side guide 301 (see FIG. 11) included in the left side surface of the toner container 30 enters the left-side guide groove 201L. The toner container 30 is turned in an arrow DC2 direction in FIG. 5 after inserted over the development housing 200. This results in that the toner discharge port 30P of the toner container 30 faces the toner replenishment port 204, and this ensures toner (developer) replenishment to the developing device 20 from the toner container 30. The far-sides of the left-side guide groove 201L and the right-side guide groove 201R have a fan shape (see FIG. 5) to allow the rotations of the left-side guide 301 and the right-side guide 311. The following further describes an attachment structure of the toner container 30 to the development housing 200 in the developing device 20 in detail.

The lock abutment piece 202S locks the toner container 30 turned in the arrow DC2 direction. Pressing the lock button 202 releases the lock of the toner container 30, turning the toner container 30 in a direction opposite to the arrow DC2 direction in FIG. 5. This results in that the toner container 30 is detachable from the developing device 20 in a direction opposite to the arrow DC1 direction.

The developing roller 21A is rotatably supported by the development housing 200. The developing roller 21A carries developer constituted of toner and a carrier on its circumference surface. The developing roller 21A supplies the toner to the photoreceptor drum 121 and develops the electrostatic latent image on the photoreceptor drum 121. A pair of the abutting rollers 211 are arranged at both the end portions in the axial direction of the developing roller 21A. The abutting roller 211 holds a constant interval between the developing roller 21A and the photoreceptor drum 121 by being brought into abutment on the circumference surface of the photoreceptor drum 121. The first screw 212 and the second screw 213 are screws rotatably supported inside the development housing 200. The developer inside the development housing 200 is circulatory conveyed by the first screw 212 and the second screw 213. The developer is supplied to the developing roller 21A by the first screw 212. The layer thickness regulating member 214 regulates a layer thickness of the developer supplied on the developing roller 21A. The developing-roller cover 215 is configured to be swingable with respect to the development housing 200. FIG. 3 illustrates a state where the developing-roller cover 215 has retreated over the developing roller 21A. Swinging the developing-roller cover 215 downward from the state illustrated in FIG. 3 ensures that the developing-roller cover 215 covers the developing roller 21A. Consequently, this prevents a foreign object from adhering on the developing roller 21A and prevents the peripheral area from being stained by the toner on the developing roller 21A when the image forming unit 120H is detached from the housing 101.

Further, the developing device 20 includes the lock lever 50 (see FIGS. 3 and 5). The lock lever 50 is swingably located in the housing-left-side wall 200L of the developing device 20. The lock lever 50 takes a lock posture and a release posture. In the lock posture, the lock lever 50 locks the image forming unit 120H (the developing device 20) at an image forming position, which will be described later, inside the housing 101. In the release posture, the lock lever 50 releases the lock of the image forming unit 120H and allows detachment of the image forming unit 120H from the housing 101 along the predetermined attachment/detachment direction. The posture is changeable between the lock posture and the release posture.

Referring to FIGS. 3, 5, and 7, the lock lever 50 includes a lever main body 501, a lever pressed portion 502, an abutting portion 503, a guide groove 504, a fulcrum 505, and the hook 506.

The lever main body 501 is a main body portion of the lock lever 50 and, as illustrated in FIG. 7, is arranged so as to obliquely extend from the front and upper side toward the rear and lower side. The lever pressed portion 502 is a flat portion provided on the upper end portion of the lever main body 501. The lever pressed portion 502 is pressed by an operator before the image forming unit 120H is detached from the housing 101. The abutting portion 503 has a circular arc shape protruding downward, in the approximately center portion in the front-rear direction of the lock lever 50. As illustrated in FIGS. 3 and 7, mounting the image forming unit 120H inside the housing 101 arranges that the abutting portion 503 faces the guide surface 154 of the main body unit 150. The guide groove 504 is a groove portion that opens in the rear of the abutting portion 503. The guide groove 504 opens so as to form a circular arc shape centered upon the fulcrum 505. The rear side of the guide groove 504 includes a lever-side lock portion 504S. The lever-side lock portion 504S has a hook shape located to protrude from the lock lever 50. One end of a lever-urging spring 52, which will be described later, is engagingly locked to the lever-side lock portion 504S.

The fulcrum 505 is arranged in the rear end side of the lock lever 50. The fulcrum 505 is rotatably supported by the housing-left-side wall 200L of the development housing 200. The fulcrum 505 is a fulcrum in swing of the lock lever 50. The above-described abutting portion 503 is arranged between the fulcrum 505 and the lever pressed portion 502 (see FIG. 7). The hook 506 is arranged in the opposite side to the lever pressed portion 502 with respect to the fulcrum 505. The hook 506 is engageable with the engaged portion 153 (see FIG. 7) of the main body unit 150. As illustrated in FIG. 7, the hook 506 extends downward from the fulcrum 505, and its distal end portion is bent forward (to the rear end side in the attachment direction of the image forming unit 120H).

Further, the developing device 20 includes a guide screw 51 and the lever-urging spring 52 (see FIG. 7). The guide screw 51 is inserted into the guide groove 504 and is a screw fastened to the housing-left-side wall 200L. The guide screw 51 has a function to guide the swing of the lock lever 50 along the guide groove 504.

The lever-urging spring 52 is a spring member that expands and contracts between the housing-left-side wall 200L of the development housing 200 and the lock lever 50. The above-described housing-left-side wall 200L includes a housing-side lock portion 200L2. As illustrated in FIG. 7, one end of the lever-urging spring 52 is engagingly locked to the lever-side lock portion 504S of the lock lever 50, and the other end of the lever-urging spring 52 is engagingly locked to the housing-side lock portion 200L2. This results in that the lever-urging spring 52 urges the lock lever 50 around the fulcrum 505 such that the hook 506 engagingly locks to the engaged portion 153 (see FIG. 7).

Attachment/Detachment of Image Forming Unit

Next, the attachment/detachment of the image forming unit 120H relative to the housing 101 will be described. As described above, the image forming unit 120H is constituted of the developing device 20 and the toner container 30. The toner container 30 is removably attachable with respect to the developing device 20. The image forming unit 120H is attachable to the housing 101 even with only the developing device 20 without including the toner container 30. Here, a description will be given of a state where the image forming unit 120H including the toner container 30 is mounted and detached relative to the housing 101.

As illustrated in FIG. 1, when the front cover 106 of the housing 101 and the front end portion 102B of the upper wall 102 are opened, the image forming unit 120H is mounted in the main-body internal space 107 of the housing 101. In this case, the image forming unit 120H is inserted into the main-body internal space 107 along the arrow DA direction in FIGS. 2 and 3. The main body unit 150 (see FIG. 3) guides the lower portion of the image forming unit 120H. In accordance with the attachment of the image forming unit 120H, the hook 506 of the lock lever 50 moves rearward sliding on the guide surface 154. Soon, an inclined surface 506S (see FIG. 7) of the hook 506 slidingly rubs against an inclined surface 153S of the engaged portion 153. In this case, in FIG. 7, slight clockwise turning of the hook 506 around the fulcrum 505 causes the distal end portion of the hook 506 to enter the lower side of the engaged portion 153. This results in that the hook 506 engages with the engaged portion 153, and the image forming unit 120H is locked at the image forming position illustrated in FIG. 7. The posture of the lock lever 50 in FIG. 7 is defined as the lock posture of the lock lever 50. In this case, as illustrated in FIG. 9, the housing pressed portion 200K of the development housing 200 is pressed rearward by the urging protrusion 151 of the positioning mechanism 150S. That is, the positioning mechanisms 150S urge the image forming unit 120H toward a direction where the developing roller 21A approaches the photoreceptor drum 121. Then, positioning the image forming unit 120H at the image forming position in FIGS. 7 and 9 in the housing 101 causes the abutting roller 211 (see FIG. 3) to be brought into abutment on the circumference surface of the photoreceptor drum 121 and thus arranges the developing roller 21A at a predetermined interval with respect to the photoreceptor drum 121. This results in stable supply of toner from the developing roller 21A to the photoreceptor drum 121 and formation of toner images on the photoreceptor drum 121.

Figure 8:
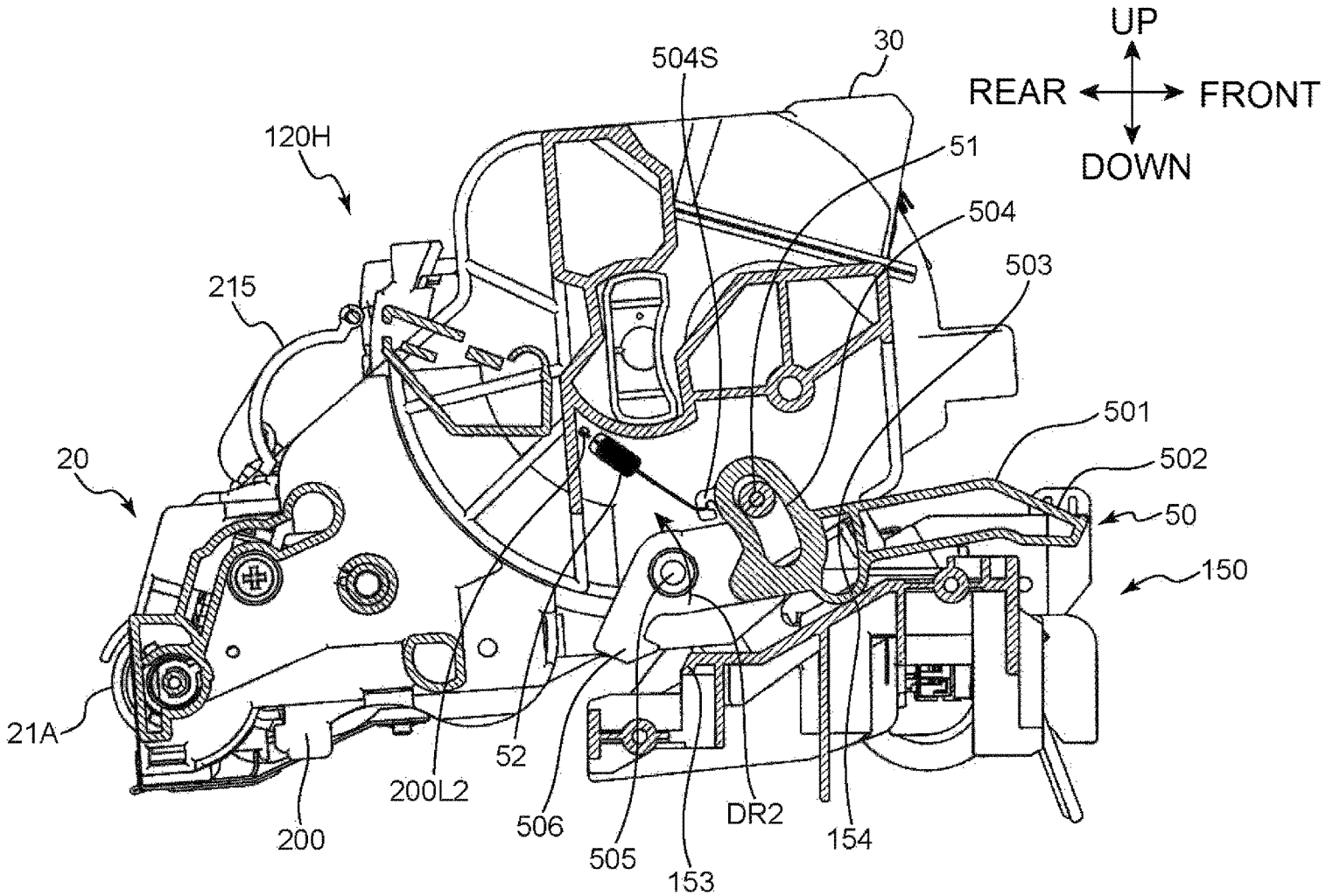
FIG. 8 illustrates a part of a cross section of the image forming unit and the apparatus main body according to the one embodiment.
Figure 10:
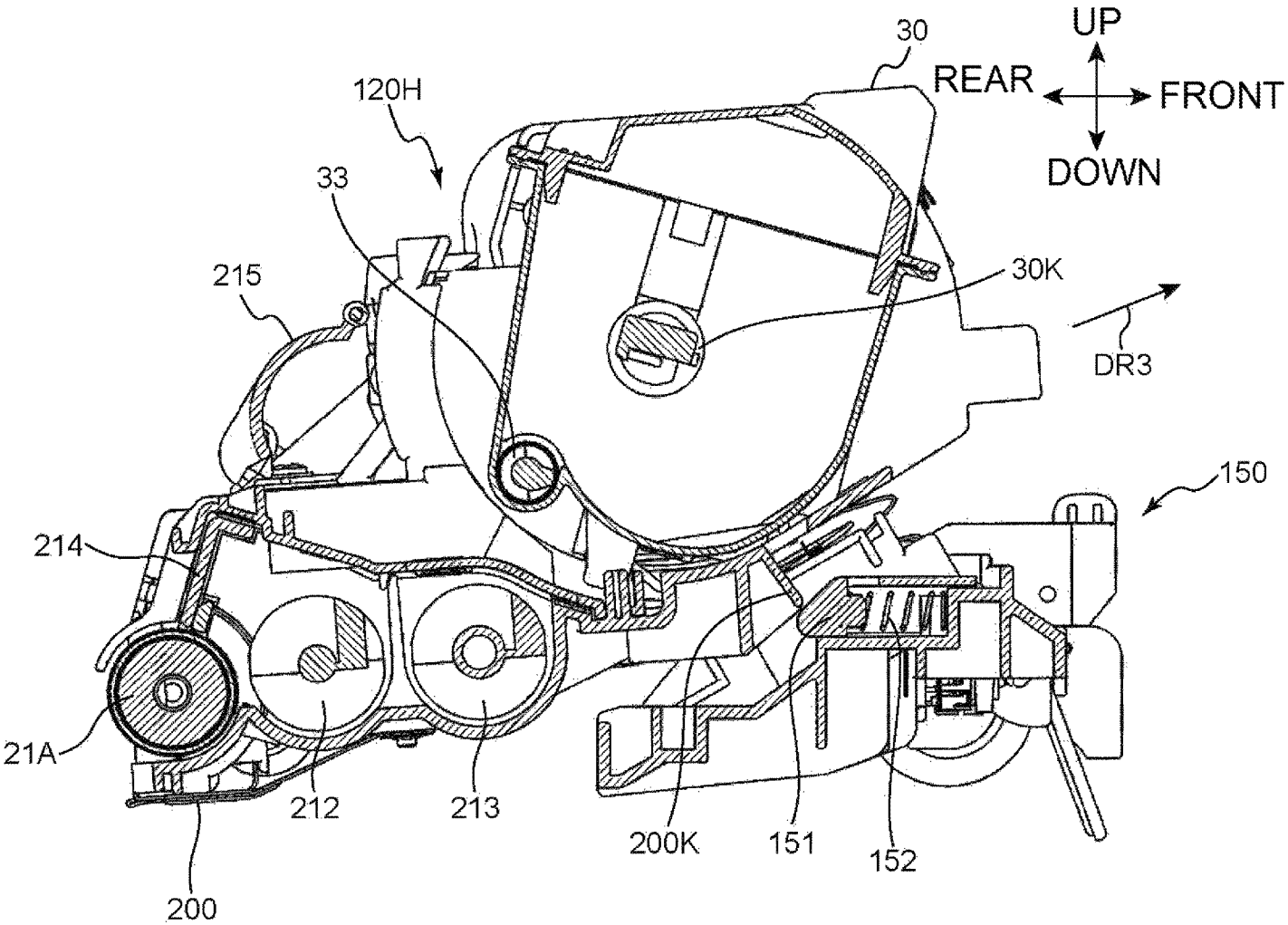
FIG. 10 illustrates a part of a cross section of the image forming unit and the apparatus main body according to the one embodiment.

When the image forming unit 120H is detached from the housing 101, as illustrated in FIG. 1, opening the front cover 106 of the housing 101 and the front end portion 102B of the upper wall 102 exposes the lever pressed portion 502 of the lock lever 50 outside the printer 100. The operator first press the lever pressed portion 502 downward (an arrow DR1 in FIG. 7). This results in that the lock lever 50 swings around the fulcrum 505 against the urging force of the lever-urging spring 52 and takes the release posture illustrated in FIG. 8. In this case, engagement of the hook 506 with the engaged portion 153 is released. Further pressing the lever pressed portion 502 causes the abutting portion 503 of the lock lever 50 to be brought into abutment on the guide surface 154, as illustrated in FIG. 8. Then, the image forming unit 120H is pushed up to a standby position upper than the image forming position illustrated in FIG. 7, with this abutting portion 503 as the fulcrum and the fulcrum 505 being a load point (an arrow in FIG. 1 and an arrow DR2 in FIG. 8). As illustrated in FIG. 10, this results in that the housing pressed portion 200K goes on the inclined surface of the urging protrusion 151, and the positioning of the image forming unit 120H by the positioning mechanisms 150S is released. In this case, the urging forces from the positioning mechanisms 150S (the unit urging springs 152) is not strongly applied to the development housing 200. Consequently, this ensures easy detachment of the image forming unit 120H from the housing 101 along the above-described attachment/detachment direction (an arrow DR3 in FIG. 10).

As illustrated in FIG. 8, after the image forming unit 120H has been pushed up in the arrow DR2 direction, bringing the hook 506 into abutment on the guide surface 154 (the above-described horizontal surface) on the upper side of the engaged portion 153 by the own weight of the image forming unit 120H holds the image forming unit 120H at the standby position. Consequently, even when the operator releases his/her hand from the lock lever 50, this prevents the hook 506 from engaging again with the engaged portion 153. This ensures that the operator easily and surely detaches the image forming unit 120H.

In other embodiments, when the image forming unit 120H is pushed up to the standby position, the inclined surface 506S (see FIG. 7) of the hook 506 may be in abutment on the inclined surface 153S of the engaged portion 153. In this case as well, the lock lever 50 is turnable around the fulcrum 505 in accordance with pulling-out operation (the arrow DR3 in FIG. 10) of the image forming unit 120H. This similarly prevents the hook 506 from engaging again with the engaged portion 153.

Structures of Toner Container and Developing Device

Figure 11:
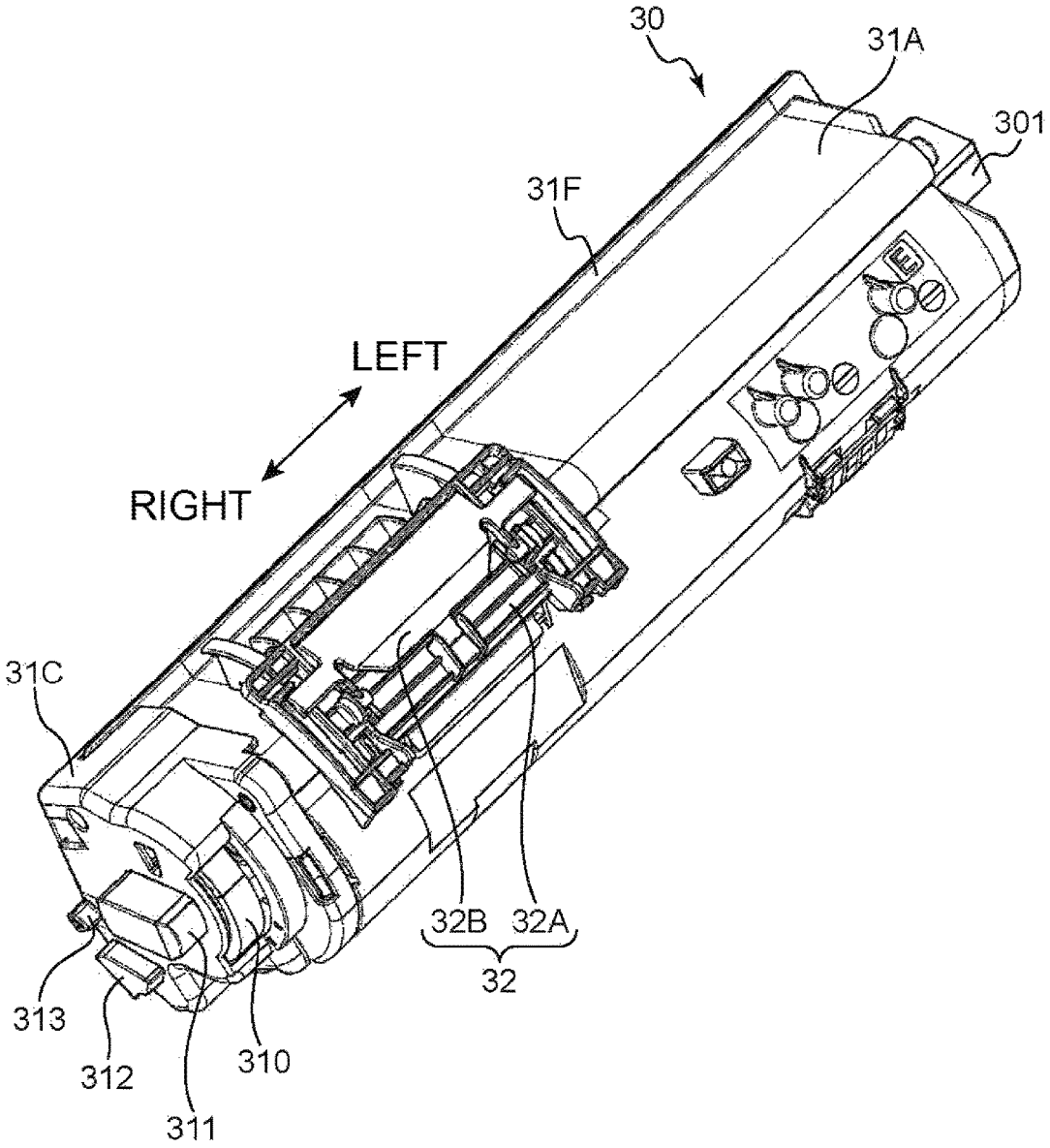
FIG. 11 obliquely illustrates the developer housing container according to the one embodiment.
Figure 12:
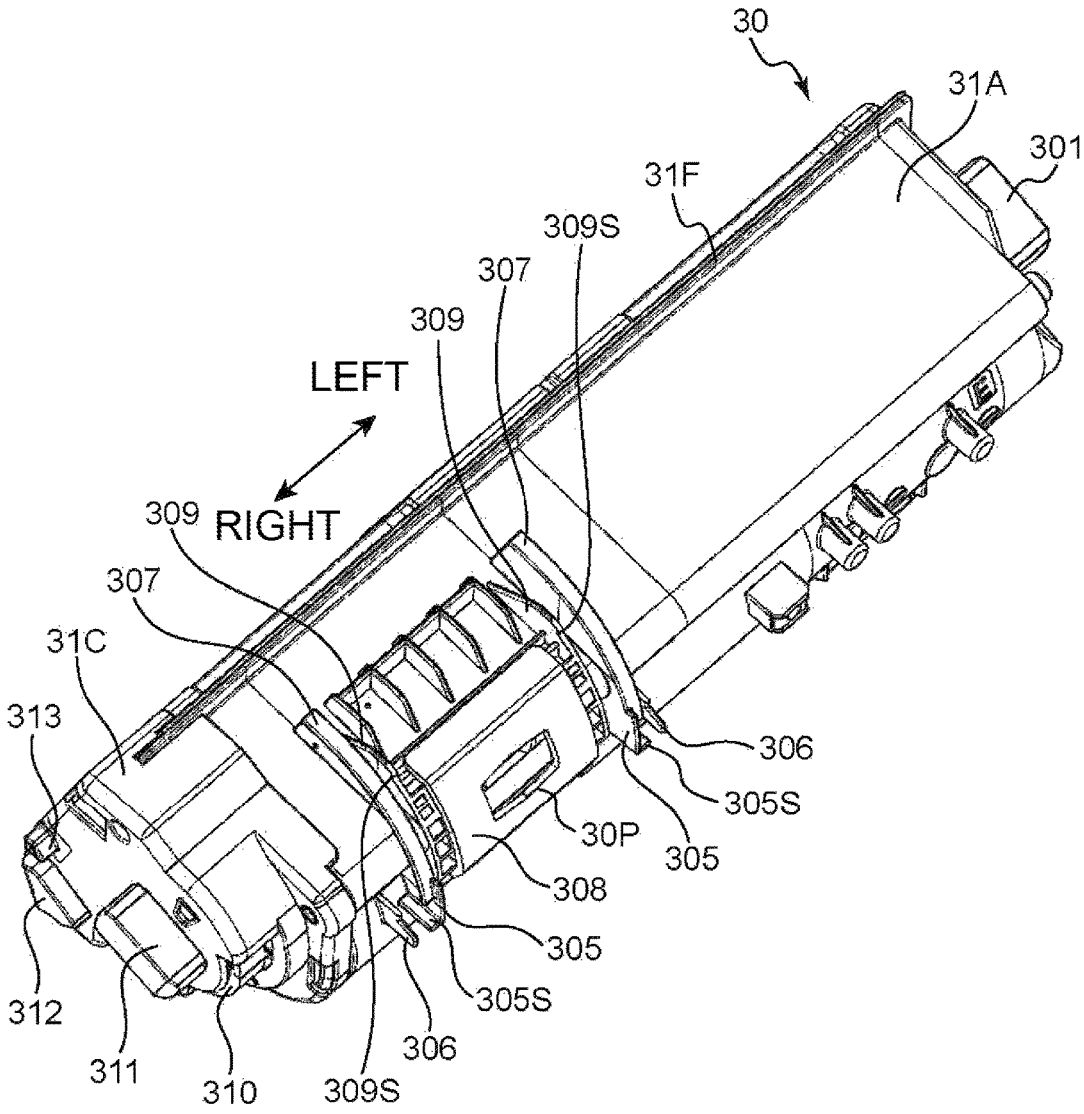
FIG. 12 obliquely illustrates a state where a shutter is removed from the developer housing container according to the one embodiment.
Figure 13A:
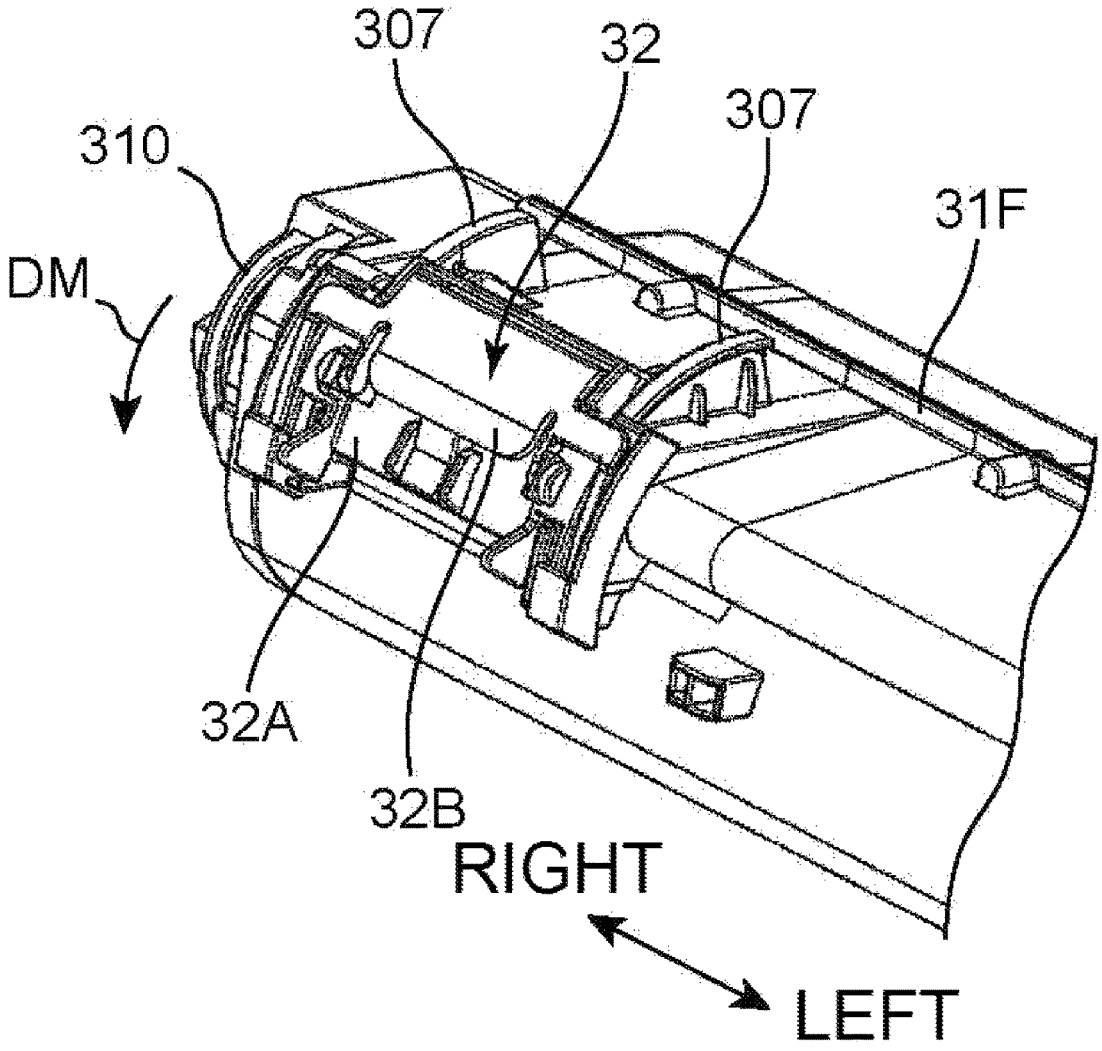
FIG. 13A obliquely illustrates the enlarged developer housing container according to the one embodiment.
Figure 13B:
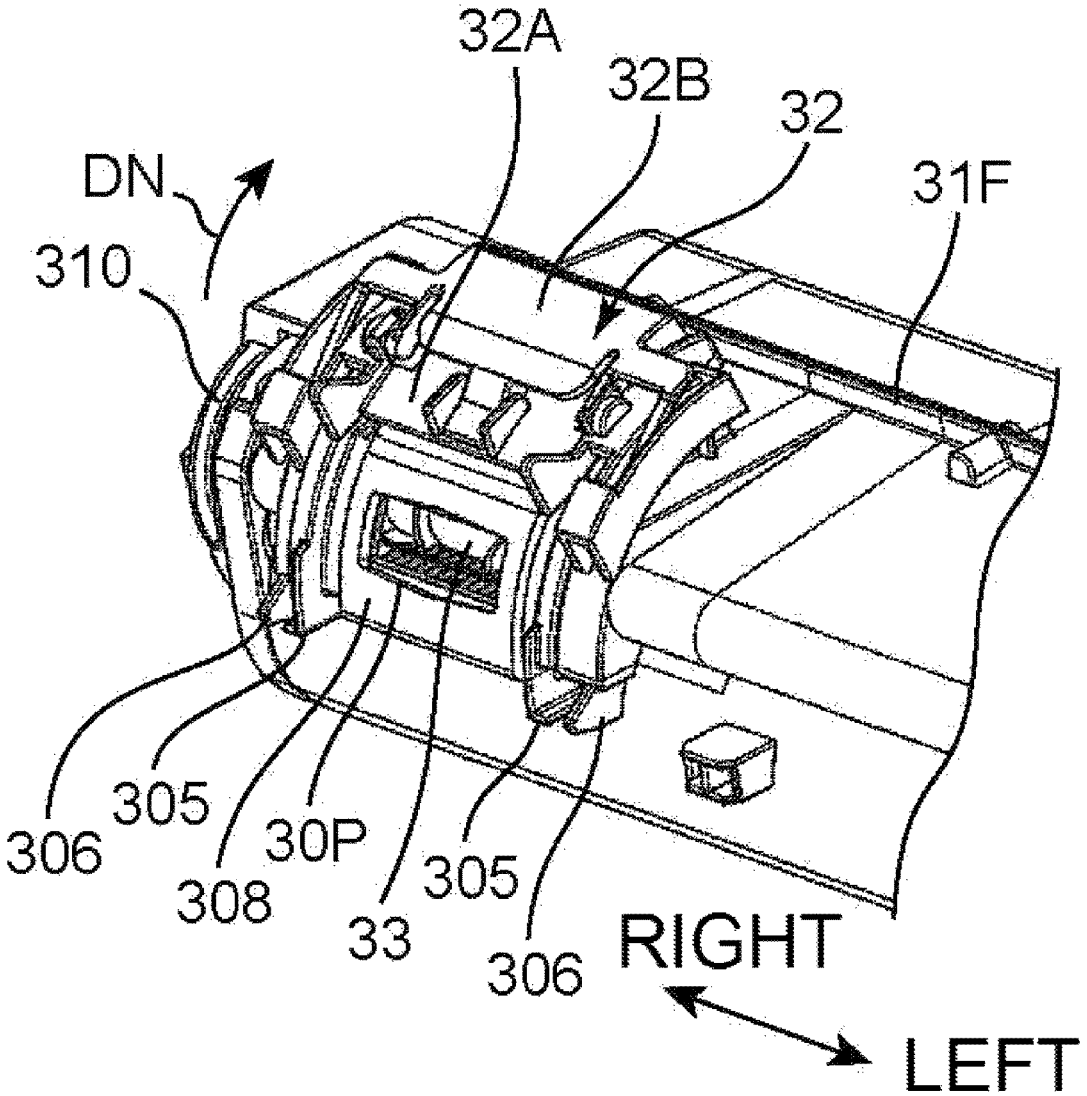
FIG. 13B obliquely illustrates the enlarged developer housing container according to the one embodiment.
Figure 14A:
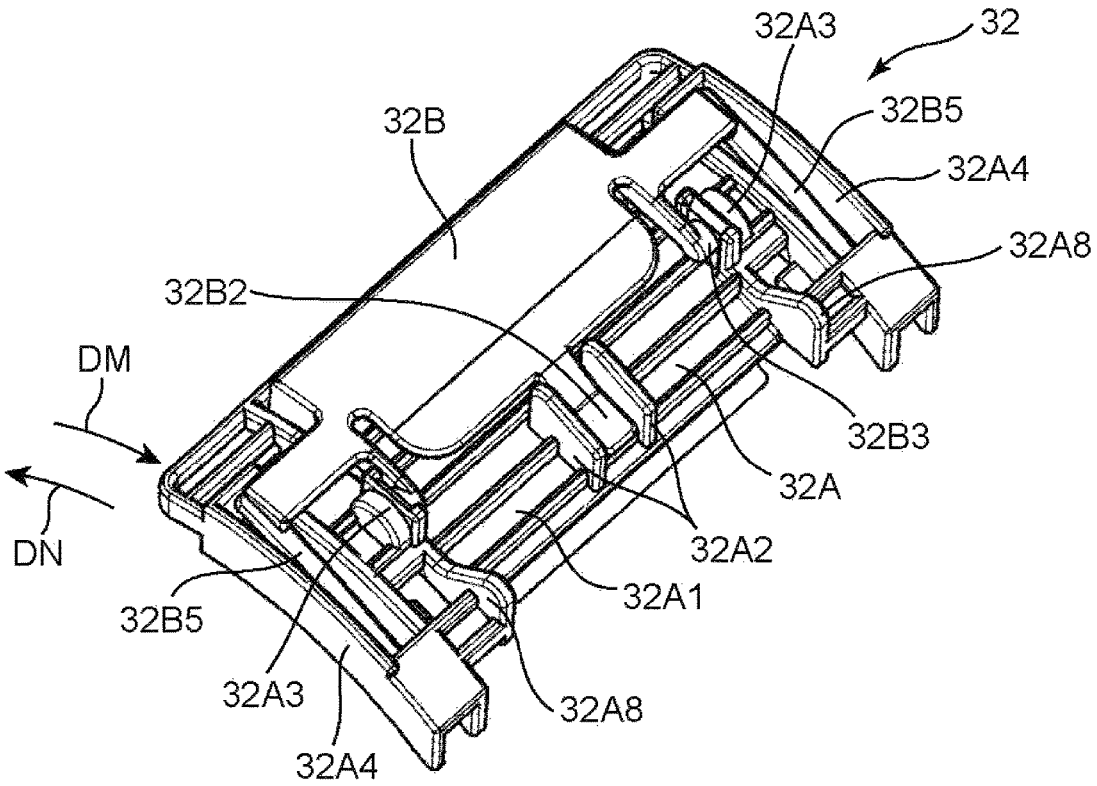
FIG. 14A obliquely illustrates the shutter of the developer housing container according to the one embodiment.
Figure 14B:
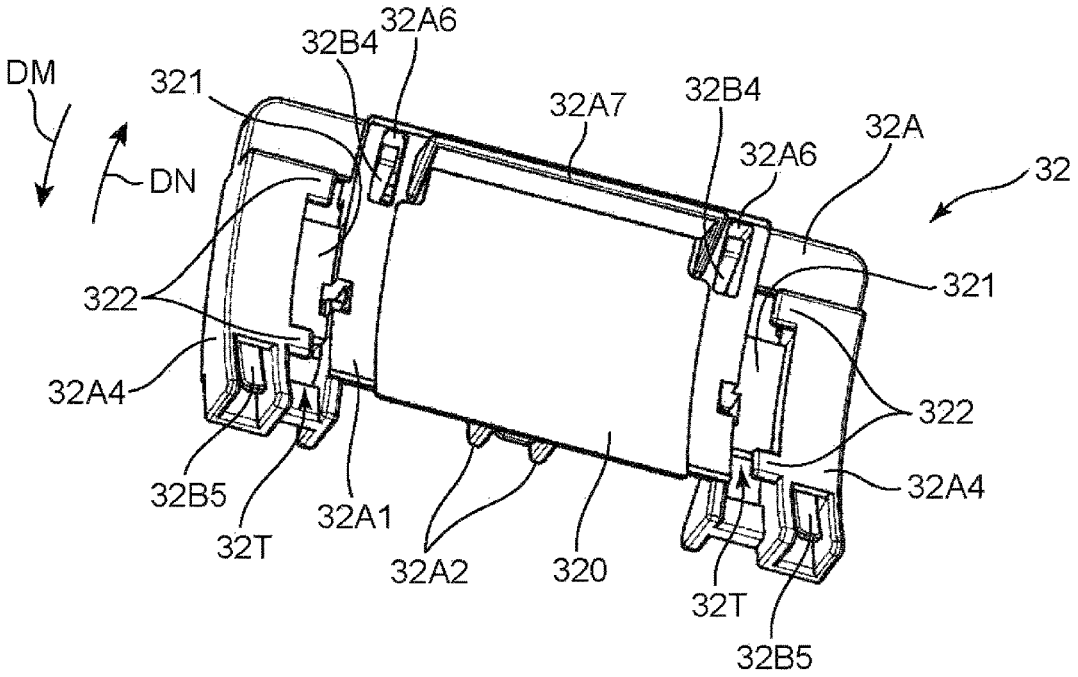
FIG. 14B obliquely illustrates the shutter of the developer housing container according to the one embodiment.
Figure 15A:
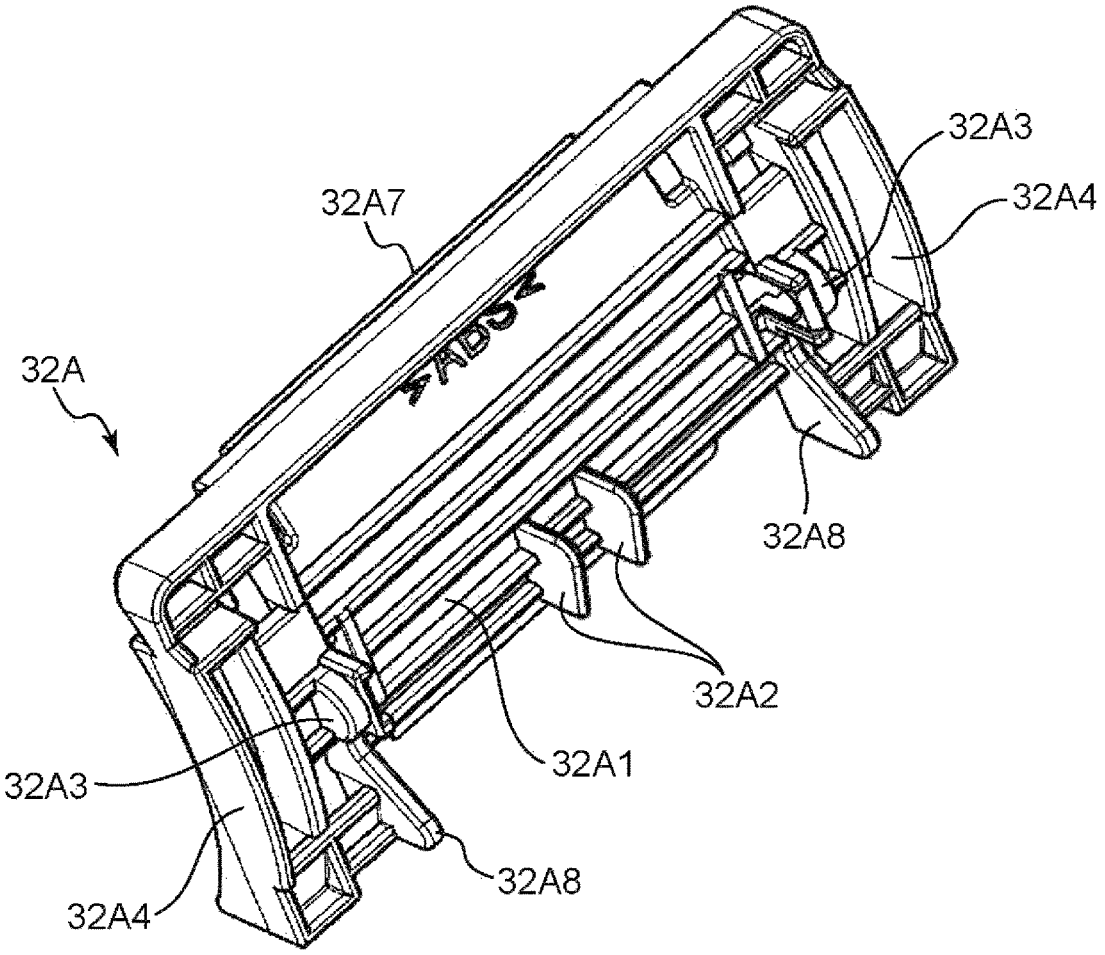
FIG. 15A obliquely illustrates a shutter main body of the developer housing container according to the one embodiment.
Figure 15B:
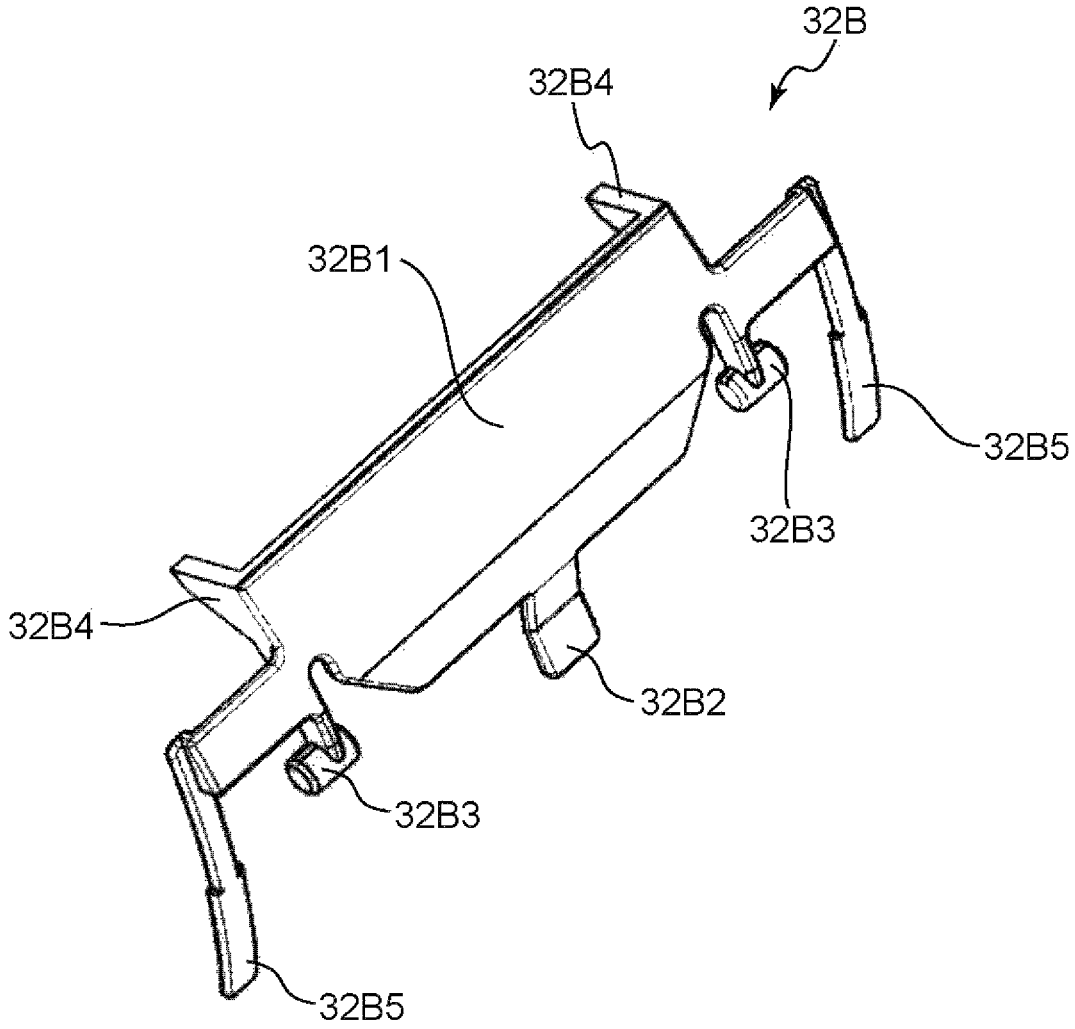
FIG. 15B obliquely illustrates a stopper member of the developer housing container according to the one embodiment.
Figure 16A:
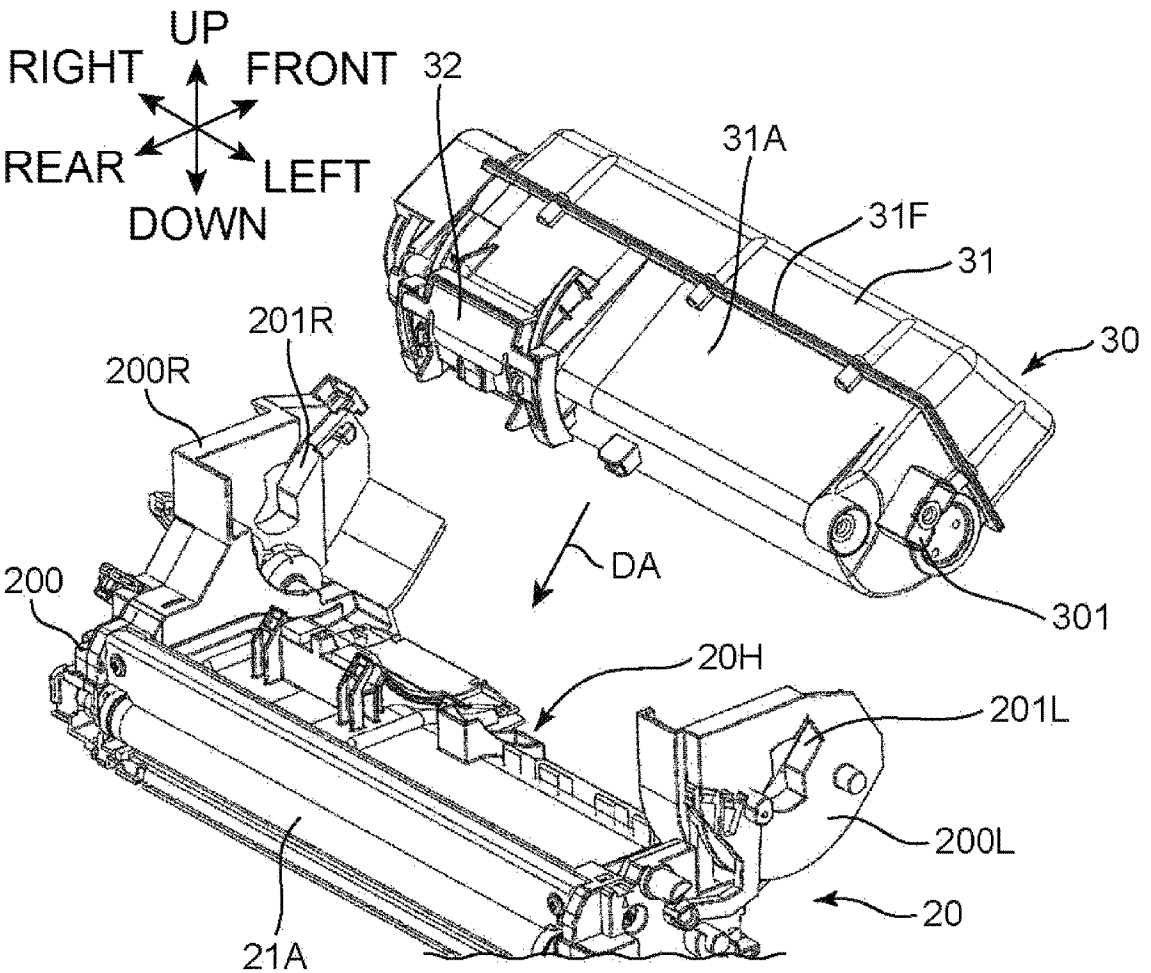
FIG. 16A obliquely illustrates a state where the developer housing container is mounted to the developing device according to the one embodiment.
Figure 16B:
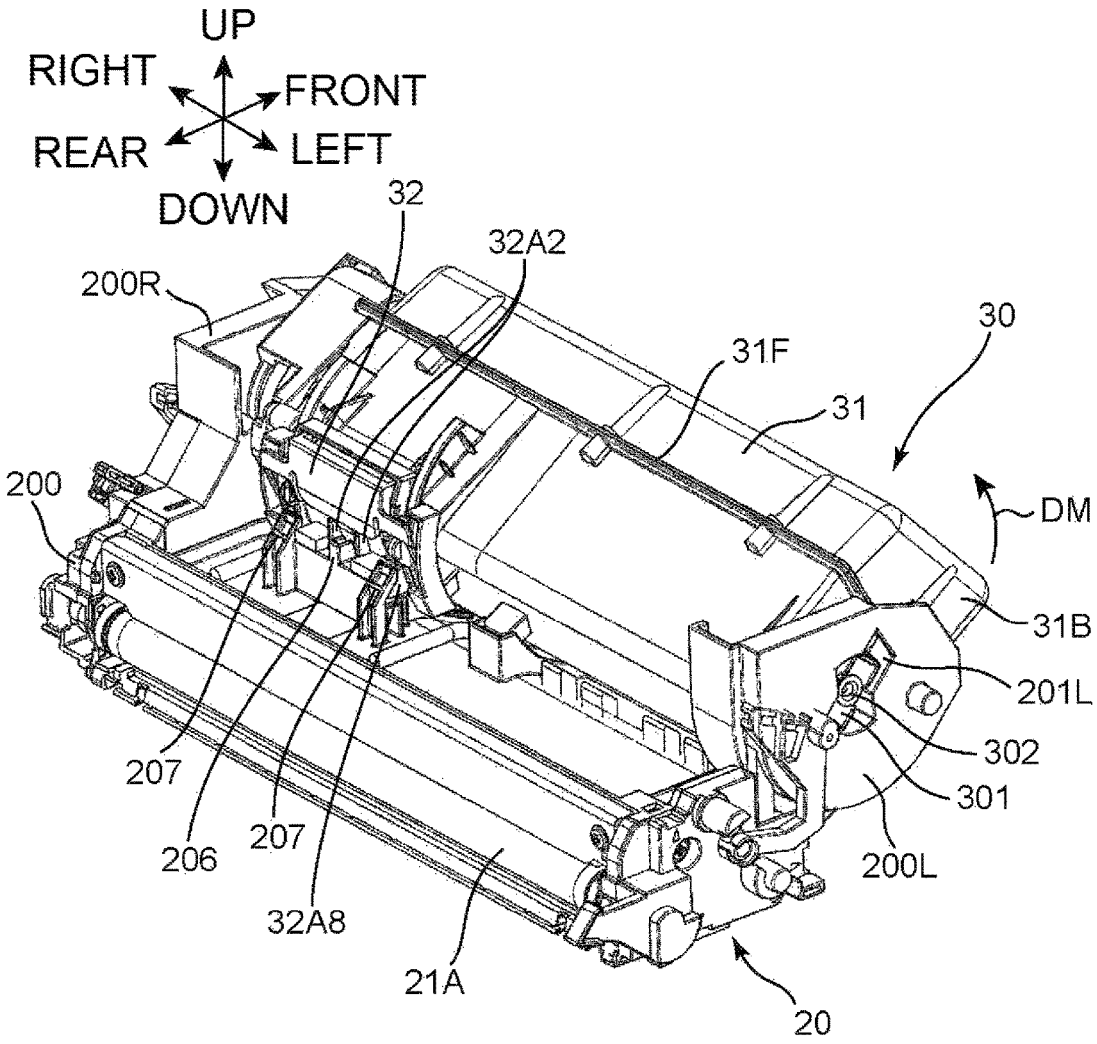
FIG. 16B obliquely illustrates a state where the developer housing container is mounted to the developing device according to the one embodiment.
Figure 16C:
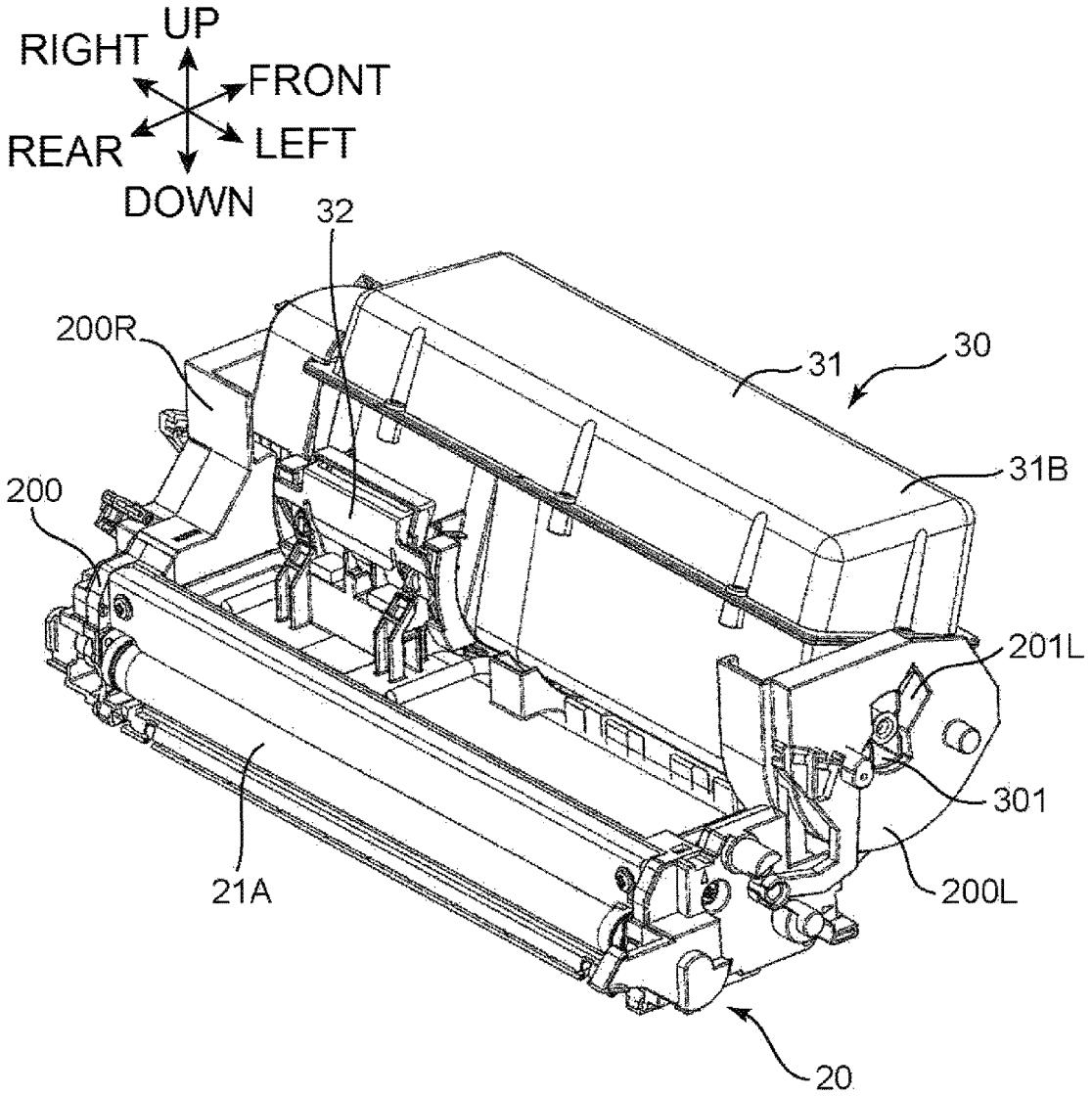
FIG. 16C obliquely illustrates a state where the developer housing container is mounted to the developing device according to the one embodiment.

The following further describes the structures of the toner container 30 and the developing device 20 according to the embodiment in detail. FIG. 11 obliquely illustrates the toner container 30 according to the embodiment. FIG. 12 obliquely illustrates a state where the container shutter 32, which will be described later, is removed from the toner container 30. FIGS. 13A and 13B obliquely illustrate the enlarged toner container 30. FIG. 13A illustrates a state that the container shutter 32 shuts the toner discharge port 30P, which will be described later. FIG. 13B illustrates the open toner discharge port 30P. FIGS. 14A and 14B obliquely illustrate the container shutter 32 of the toner container 30 according to the embodiment. FIG. 14A corresponds to a drawing viewing the container shutter 32 from outside the toner container 30. FIG. 14B corresponds to a drawing viewing the container shutter 32 from inside the toner container 30. FIG. 15A obliquely illustrates the shutter main body 32A of the container shutter 32. FIG. 15B obliquely illustrates a shutter stopper 32B of the container shutter 32. FIGS. 16A and 16B obliquely illustrate a state of mounting the toner container 30 to the developing device 20. FIG. 16C obliquely illustrates a state of mounting the toner container 30 to the developing device 20.

The toner container 30 has a longitudinal shape extending in one direction. The toner container 30 is mounted to the developing device 20 inside the housing 101 such that the longitudinal direction of the toner container 30 goes along the lateral direction. In addition to the above-described container main body 31, the toner container 30 includes the container shutter 32 (see FIG. 11) (the shutter), the toner discharge port 30P (see FIG. 12) (the developer discharge port), the left-side guide 301, a paddle bearing portion 302 (see FIG. 16B), container shutter pressing portions 305 (see FIG. 12), elastic piece pressing portions 306 (see FIG. 12) (protrusions), guide ribs 307 (see FIG. 12), a discharge protrusion 308 (see FIG. 12), container shutter lock ribs 309 (see FIG. 12), the transmission gear 310 (see FIG. 12), the above-described right-side guide 311 (see FIG. 12), the first lock engaging portion 312, and the second lock engaging portion 313.

The toner discharge port 30P (see FIG. 12) is an opening open to a right edge side on a lower surface of the main unit 31A. In details, the toner discharge port 30P is open with approximately rectangular shape on a circumference surface of the discharge protrusion 308 (see FIG. 12), which further projects from a lower surface portion of the main unit 31A with circular arc shape. The toner housed inside the toner container 30 is discharged from the toner discharge port 30P and is supplied to the developing device 20.

The left-side guide 301 is a protrusion with longitudinal shape formed to extend in a predetermined direction at the left side surface of the main unit 31A. The left-side guide 301 regulates a mounting direction of the toner container 30 to the developing device 20 (an arrow DA direction in FIG. 16A). The left-side guide 301 internally has a cavity. The paddle bearing portion 302 (see FIG. 16B) is a bearing portion located inside the left-side guide 301. The paddle bearing portion 302 rotatably journals the container paddle 30K. The right-side guide 311 also internally includes a bearing portion similar to the paddle bearing portion 302 (see FIG. 16B) on the left-side guide 301 side. The bearing portion is adjacent to the transmission gear 310 and journals a shaft of the container paddle 30K.

The container shutter pressing portions 305 (FIG. 12) are a pair of ribs projected so as to sandwich the discharge protrusion 308, which has the toner discharge port 30P, in the longitudinal direction (the lateral direction) of the toner container 30. The container shutter pressing portions 305 are located downstream in a rotation direction of the toner container 30 during mounting (a first rotation direction, an arrow DM in FIG. 13A) with respect to the toner discharge port 30P. The pair of container shutter pressing portions 305 each extend along the rotation direction. The container shutter pressing portions 305 have a shape whose distal end portions (container shutter pressing pieces 305S) bent along the longitudinal direction of the toner container 30 (each so as to expand in the lateral direction). The container shutter pressing pieces 305S have a function of pressing a main body shutter 22, which will be described later, and being pressed by the main body shutter 22.

The elastic piece pressing portions 306 (see FIGS. 12 and 13B) are pair of projection pieces adjacent to the container shutter pressing pieces 305S on the container shutter pressing portions 305 and projected from the main unit 31A. A pair of the elastic piece pressing portions 306 are located so as to sandwich the pair of container shutter pressing portions 305 in the lateral direction. The elastic piece pressing portions 306 extend along the above-described rotation direction of the toner container 30. The elastic piece pressing portions 306 have a stepped shape whose projection height heightens as away from the toner discharge port 30P. The elastic piece pressing portions 306 are opposed to elastic pieces 32B5 of the shutter stopper 32B, which will be described later, and have a function of pressing the elastic pieces 32B5.

The guide ribs 307 (see FIG. 12) are pair of arc-shaped rib members projected from the main unit 31A and connected to the container shutter pressing portions 305. The guide ribs 307 are formed extending along the rotation direction of the container main body 31. A pair of the guide ribs 307 are located so as to sandwich the toner discharge port 30P in the lateral direction. As illustrated in FIG. 12, the guide ribs 307 extend long to a side opposite from the container shutter pressing pieces 305S with respect to the toner discharge port 30P, and distal end portions of the guide ribs 307 are opposed to the container flange 31F. Outer peripheral portions of a pair of the guide ribs 307 each bend in the lateral direction and have a predetermined width. The guide ribs 307 support the container shutter 32, which will be described later, slidably movable around a predetermined shaft center.

The container shutter lock ribs 309 (see FIG. 12) are pair of ribs extending from right and left side edges of the discharge protrusion 308 along the above-described rotation direction of the toner container 30. Describing in further details, a pair of the container shutter lock ribs 309 extend from the side edges of the discharge protrusion 308 toward the rotation direction when the toner container 30 is removed from the developing device 20 (a second rotation direction, an arrow DN in FIG. 13B). At the container shutter lock ribs 309, claw-shaped stepped portions are formed (container shutter engaging portions 309S (engaged portions)) (see FIG. 12). To these container shutter engaging portions 309S, stopper lock pieces 32B4 of the shutter stopper 32B, which will be described later, are engageable.

The transmission gear 310 (see FIGS. 11 and 12) is a rotation gear rotatably supported to the right side surface of the toner container 30. The transmission gear 310 has a function of transmitting rotary drive power to the container paddle 30K. Mounting the toner container 30 to the developing device 20 connects a gear group (not illustrated) of the developing device 20 to the transmission gear 310, thus the rotary drive power is input to the transmission gear 310.

The first lock engaging portion 312 is a protrusion projected from the container cover 31C spaced with respect to the right-side guide 311 on the right-side surface of the container cover 31C. In a cross-sectional view intersecting with the lateral direction (see FIG. 20A), the first lock engaging portion 312 has an approximately trapezoidal shape. Similarly, the second lock engaging portion 313 is a protrusion projected from the container cover 31C. The second lock engaging portion 313 has a trapezoidal shape smaller than the first lock engaging portion 312. The second lock engaging portion 313 is located at a position spaced from the first lock engaging portion 312 along the rotation direction of the toner container 30. The first lock engaging portion 312 and the second lock engaging portion 313 are engageable with the lock abutment piece 202S (see FIG. 5).

The container shutter 32 (see FIG. 11) is supported to the container main body 31 so as to be slidably movable with respect to the toner discharge port 30P to seal or open the toner discharge port 30P (see FIGS. 13A and 13B). The container shutter 32 slidably moves along the guide ribs 307 (see FIG. 12) on the container main body 31. The container shutter 32 includes a shutter main body 32A and the shutter stopper 32B. The shutter stopper 32B is swingably supported to the shutter main body 32A.

By referring to FIGS. 14A and 14B, the shutter main body 32A is an approximately rectangular-shaped member that has a curved surface along a circumference surface of the container main body 31. The shutter main body 32A seals the toner discharge port 30P. The shutter main body 32A includes a shutter plate 32A1, releasing piece supporting portions 32A2, stopper journals 32A3, elastic piece supporting portions 32A4, shutter holes 32A6 (see FIG. 14B), a shutter abutting portion 32A7, shutter engaging pieces 32A8, a container shutter sheet 320, guided surfaces 321, and guided pieces 322.

The shutter plate 32A1, which is a main part of the shutter main body 32A, is a plate-shaped member with approximately rectangular shape. As illustrated in FIG. 14A, the releasing piece supporting portions 32A2 are pair of projection pieces projected from the center of the shutter plate 32A1 in a longitudinal direction (a lateral direction in FIG. 11). Between a pair of the releasing piece supporting portions 32A2, a stopper releasing piece 32B2, which will be described later, on the shutter stopper 32B is located.

The stopper journals 32A3 are pair of bearing portions located outside a pair of the releasing piece supporting portions 32A2 in the longitudinal direction. The stopper journals 32A3 turnably journal stopper fulcrums 32B3, which will be described later. The elastic piece supporting portions 32A4 are pair of grooves located outside a pair of the stopper journals 32A3 in the longitudinal direction. The elastic piece supporting portions 32A4 are each formed of a bottom surface, which is a flat surface with the shutter plate 32A1, and a pair of sidewalls. The elastic pieces 32B5, which will be described later, are housed inside the elastic piece supporting portions 32A4.

Referring to FIG. 14B, the shutter holes 32A6 are pair of elongate holes open passing through the shutter plate 32A1. The shutter holes 32A6 are open at distal end portions of the shutter plate 32A1 in the second rotation direction (direction of the arrow DN in FIG. 14B). The shutter abutting portion 32A7 is an elongate projection piece formed between the pair of shutter holes 32A6. Both end portions of the shutter abutting portion 32A7 in the longitudinal direction are indented on its upstream side in the first rotation direction (direction of the arrow DM in FIG. 14B). The shutter abutting portion 32A7 has a function to regulate the movement of the container shutter 32 in the second rotation direction. The shutter engaging pieces 32A8 (see FIG. 14A) are pair of projection pieces projected from between the shutter plate 32A1 and the pair of elastic piece supporting portions 32A4 in the longitudinal direction. The shutter engaging pieces 32A8 have an approximately triangular shape. The shutter engaging pieces 32A8 are engageable with container shutter securing portions 207, which will be described later, of the developing device 20.

The container shutter sheet 320 is a sheet member pasted to a surface of sealing the toner discharge port 30P among the shutter main body 32A of the container shutter 32. In this embodiment, the container shutter sheet 320 is formed of a film member made of resin.

By referring to FIG. 14B, the guided surface 321 is a surface located between the shutter plate 32A1 and the elastic piece supporting portion 32A4 with a step difference with respect to the shutter plate 32A1. The guided pieces 322 are pair of protrusions projected from the bottom surfaces of the elastic piece supporting portions 32A4 at upstream and downstream in the first rotation direction of the guided surface 321. Between the guided surfaces 321 and the guided pieces 322, space portions extending along the first rotation direction (the arrow DM) are formed. One ends of the guide ribs 307 (see FIG. 12) of the toner container 30 are inserted from guide insertion ports 32T in FIG. 14B into these space portions, thus mounting the container shutter 32 to the container main body 31. Consequently, the container shutter 32 is slidably movable in the container main body 31.

The shutter stopper 32B (the stopper member) is mounted to a surface on the shutter main body 32A opposite from a surface of sealing the toner discharge port 30P. The shutter stopper 32B has a function to regulate or allow the slidable movement of the container shutter 32. By referring to FIGS. 15A and 15B, the shutter stopper 32B includes a stopper plate 32B1, the stopper releasing piece 32B2 (the pressed portion), the stopper fulcrums 32B3 (the fulcrums), the stopper lock pieces 32B4 (the lock pieces), and the elastic pieces 32B5.

The stopper plate 32B1, which is a main part of the shutter stopper 32B, is a plate-shaped member with approximately rectangular shape. The stopper releasing piece 32B2 is a projection piece projected from the center of the stopper plate 32B1 in the longitudinal direction (the lateral direction in FIG. 11). As illustrated in FIG. 14A, the stopper releasing piece 32B2 projects downstream in the first rotation direction from the stopper plate 32B1. As described above, the stopper releasing piece 32B2 is located between a pair of the releasing piece supporting portions 32A2 on the shutter main body 32A.

The stopper fulcrums 32B3 are pair of projection pieces projected from near the end portion of the stopper plate 32B1 in the longitudinal direction. The stopper fulcrums 32B3 include shafts, which slightly project, at the distal end portions. These shafts of the stopper fulcrums 32B3 are inserted into the stopper journals 32A3 on the above-described shutter main body 32A to be journaled. Consequently, the shutter stopper 32B is swingable with respect to the shutter main body 32A around an axis line connecting a pair of the stopper fulcrums 32B3.

The stopper lock pieces 32B4 (the lock pieces) are pair of projection pieces projected from both the end portions of the stopper plate 32B1 in the longitudinal direction. As illustrated in FIG. 15B, the stopper lock pieces 32B4 have an approximately triangular shape. The stopper lock pieces 32B4 are connected to the stopper fulcrums 32B3 in the first rotation direction. The stopper lock pieces 32B4 are engageable with the container shutter engaging portions 309S on the container main body 31. The stopper releasing pieces 32B2 and the stopper lock pieces 32B4 are located on a side opposite from one another with respect to the stopper fulcrums 32B3.

The elastic pieces 32B5 are a pair of elongate projection pieces included in both the end portions of the shutter stopper 32B. Distal end sides of the elastic pieces 32B5 are free ends extending in the first rotation direction.

An insertion of a pair of the stopper fulcrums 32B3 into a pair of the stopper journals 32A3 integrates the shutter main body 32A and the shutter stopper 32B. Then, a pair of the stopper lock pieces 32B4 are inserted into the shutter holes 32A6 (see FIG. 14B). Further, a pair of the elastic pieces 32B5 are housed inside the elastic piece supporting portions 32A4. Then, as illustrated in FIG. 14B, the distal end portions of the elastic pieces 32B5 are exposed to the back side of the container shutter 32.

By referring to FIGS. 16A and 16B, the developing device 20 includes a container mounting portion 20H between the housing-right-side wall 200R and the housing-left-side wall 200L. The toner container 30 is mounted to the container mounting portion 20H.

Further, the development housing 200 includes a stopper pressing portion 206 (see FIG. 16B) (a pressing portion), the container shutter securing portions 207, and shutter springs 208 (see FIG. 5).

The stopper pressing portion 206 (see FIG. 16B) is a protrusion projected from a top panel of the development housing 200 adjacent to a rear side of the toner replenishment port 204. When the toner container 30 is mounted to the container mounting portion 20H, the stopper pressing portion 206 has a function of pressing the stopper releasing piece 32B2 (see FIG. 14A) on the container shutter 32 of the toner container 30. In other words, the stopper pressing portion 206 allows the slidable movement of the container shutter 32.

The container shutter securing portions 207 (see FIG. 16B) are protrusions projected from the top panel of the development housing 200 so as to sandwich the stopper pressing portion 206 in the lateral direction. In a cross-sectional view intersecting with the lateral direction, the container shutter securing portions 207 have an approximately trapezoidal shape. Wedge-shaped cutouts are formed on front side surfaces of the container shutter securing portions 207. When the toner container 30 is mounted to the container mounting portion 20H, the shutter engaging pieces 32A8 (see FIG. 14A), which are on the container shutter 32 of the toner container 30, engage these cutouts. Consequently, the container shutter securing portions 207 secure the container shutter 32 and regulate the movement (turning) of the container shutter 32.

The shutter springs 208 (see FIG. 5) are pair of spring members located outside the pair of container shutter securing portions 207 in the lateral direction. The shutter springs 208 extend in a front-rear direction. One ends of the shutter springs 208 are locked to the top panel of the development housing 200. The other ends of the shutter springs 208 are locked to the main body shutter 22 (see FIG. 5), which will be described later.

Further, the developing device 20 includes the main body shutter 22 (see FIG. 5). The main body shutter 22 is supported to the development housing 200 slidably movable to the toner replenishment port 204. The main body shutter 22 seals or opens the toner replenishment port 204.

The above-described shutter springs 208 urge the main body shutter 22 in a direction that the main body shutter 22 seals the toner replenishment port 204 (see FIG. 5). Accordingly, as illustrated in FIG. 16A, with the toner container 30 removed from the developing device 20, the main body shutter 22 receives urging force from the shutter springs 208 to seal the toner replenishment port 204.

Mounting and Removal of Toner Container to/from Developing Device

The following describes the mounting of the toner container 30 to the developing device 20 with reference to FIGS. 17 to 23B in addition to FIGS. 16A to 16C.

Figure 17:
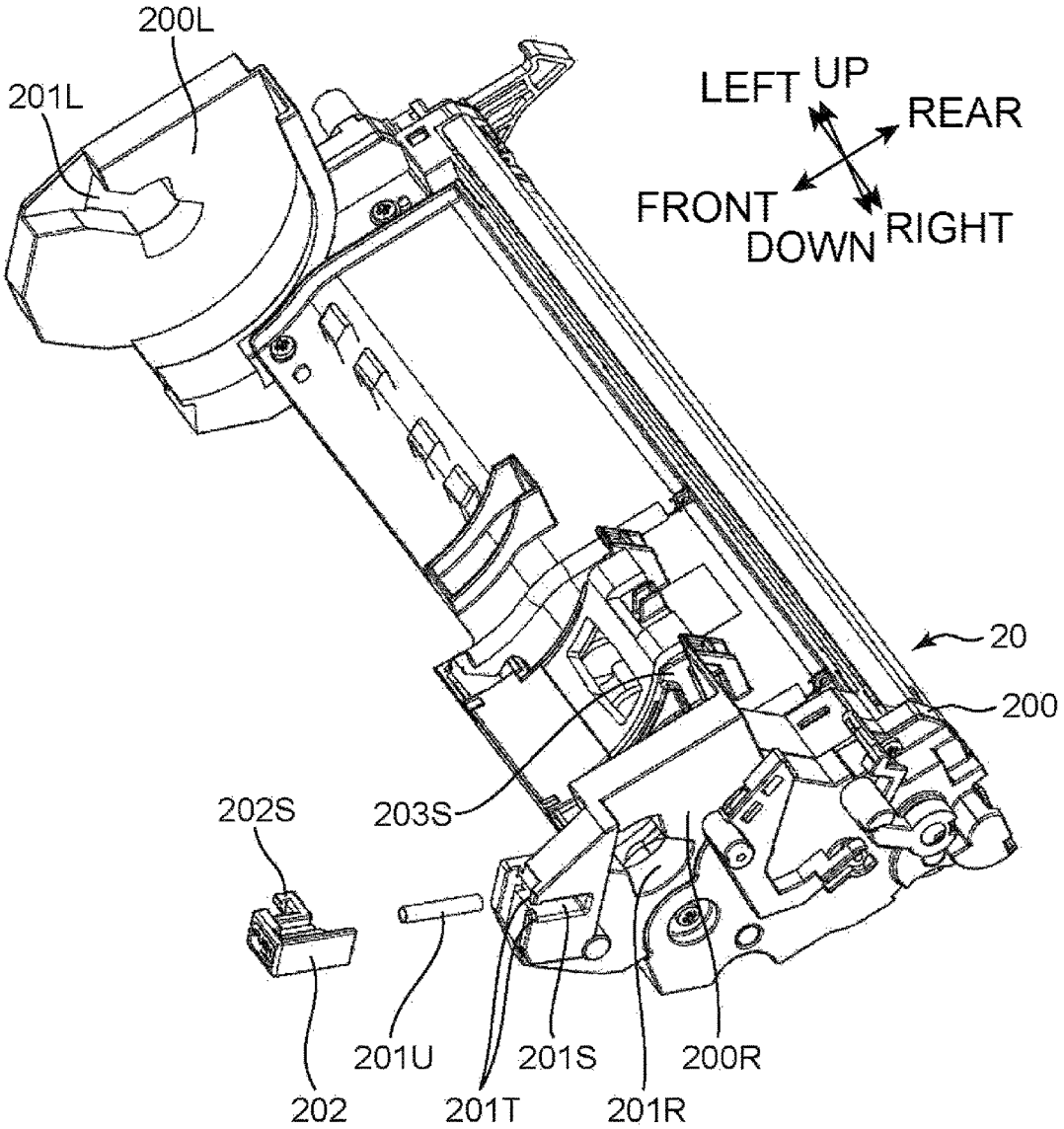
FIG. 17 obliquely illustrates the disassembled developing device according to the one embodiment.
Figure 18A:
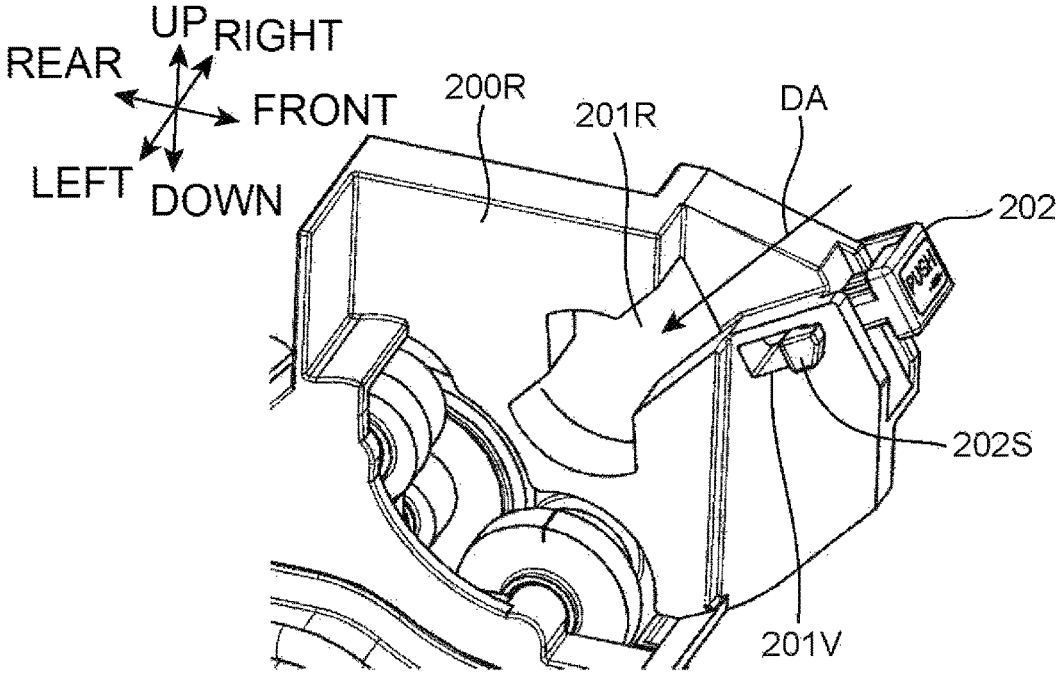
FIG. 18A obliquely illustrates a part of the enlarged developing device according to the one embodiment.
Figure 18B:
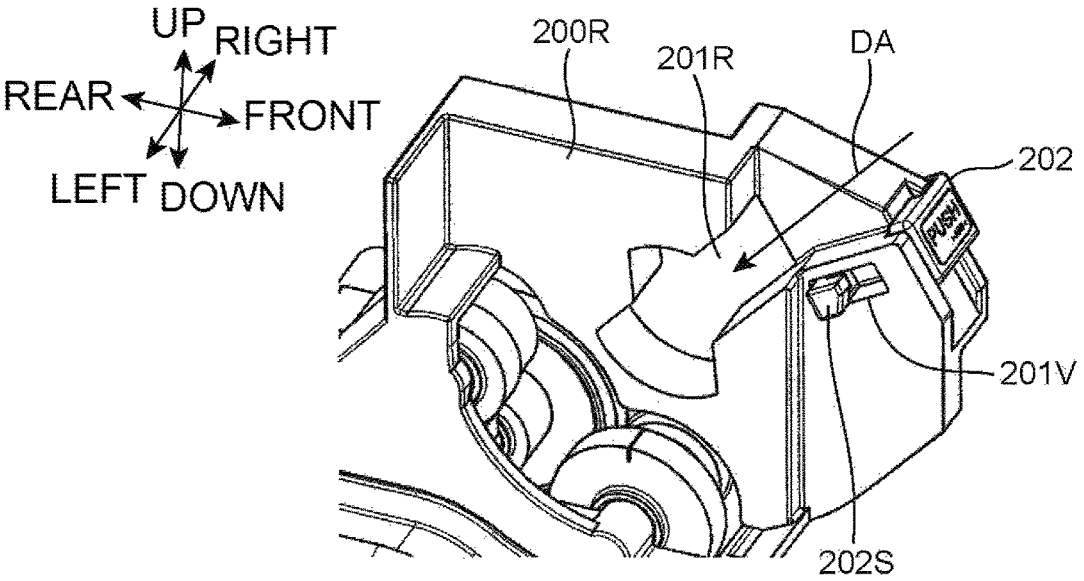
FIG. 18B obliquely illustrates a part of the enlarged developing device according to the one embodiment.
Figure 19:
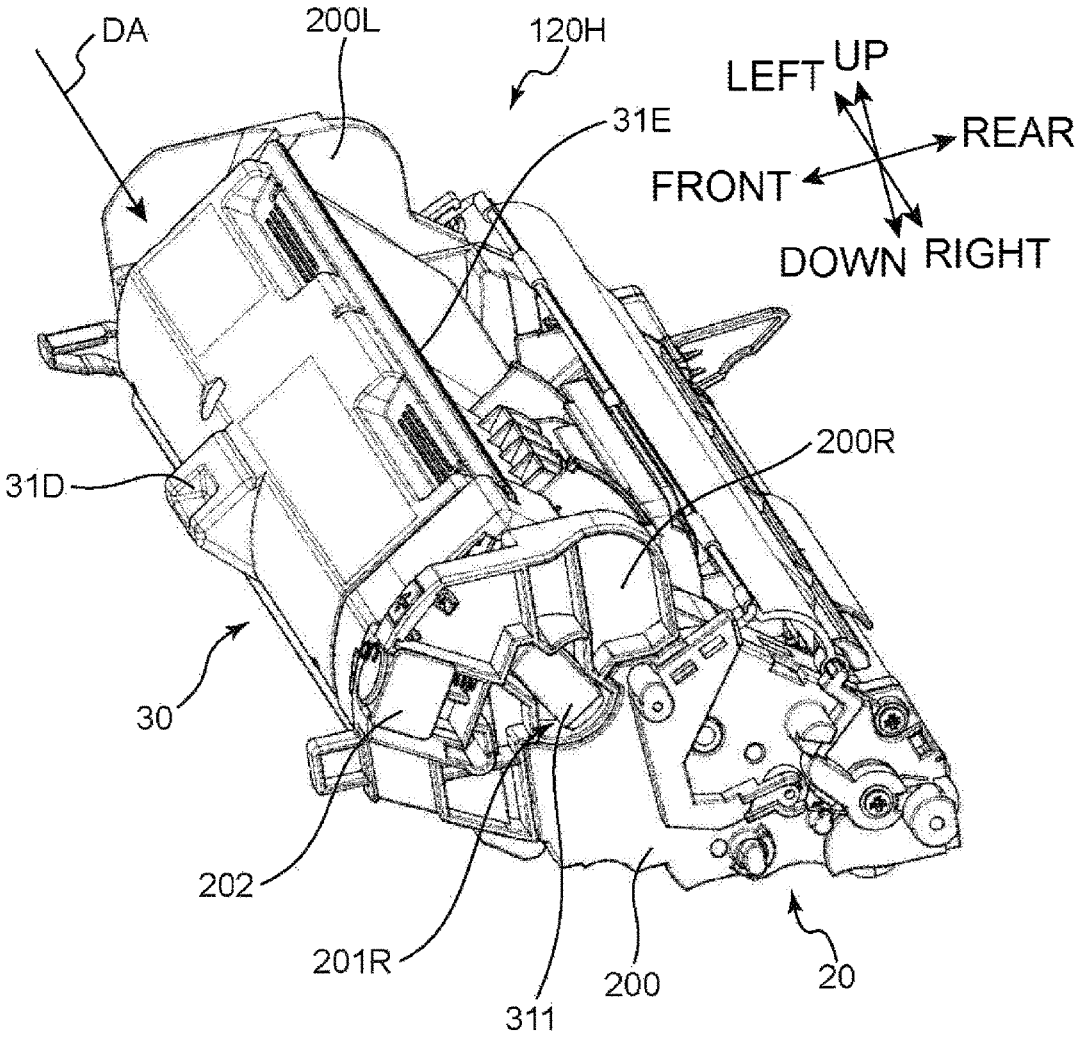
FIG. 19 obliquely illustrates a state where the developer housing container is mounted to the developing device according to the one embodiment.
Figure 20A:
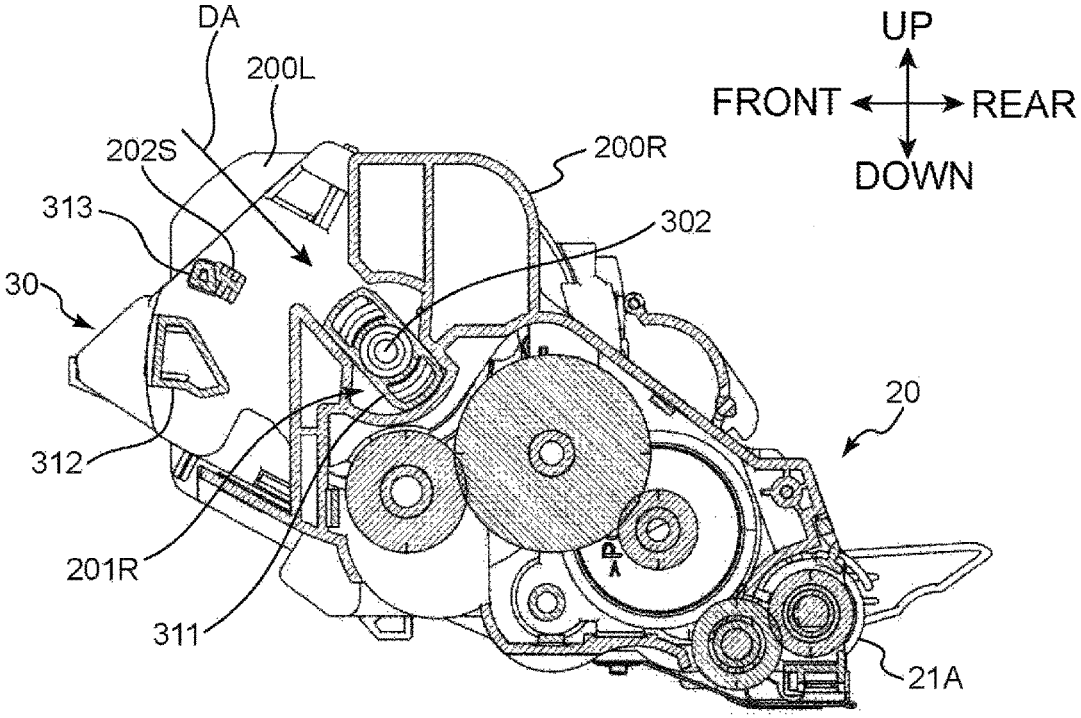
FIG. 20A illustrates a state where the developer housing container is mounted to the developing device according to the one embodiment in cross section.
Figure 20B:
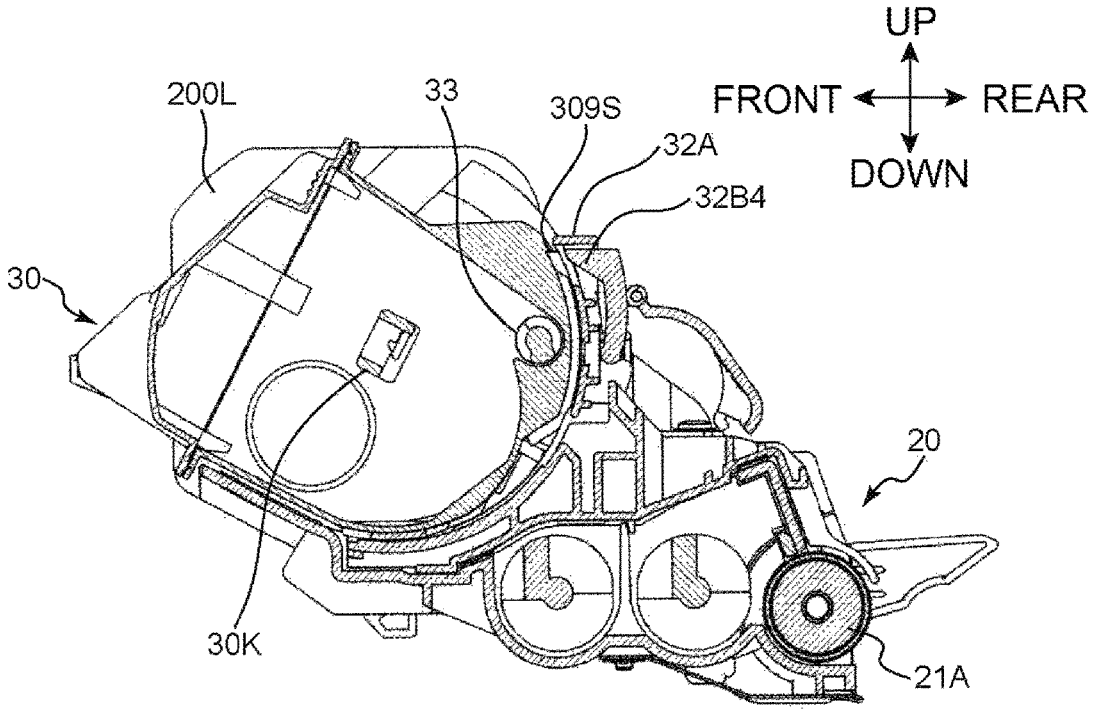
FIG. 20B illustrates a state where the developer housing container is mounted to the developing device according to the one embodiment in cross section.
Figure 20C:
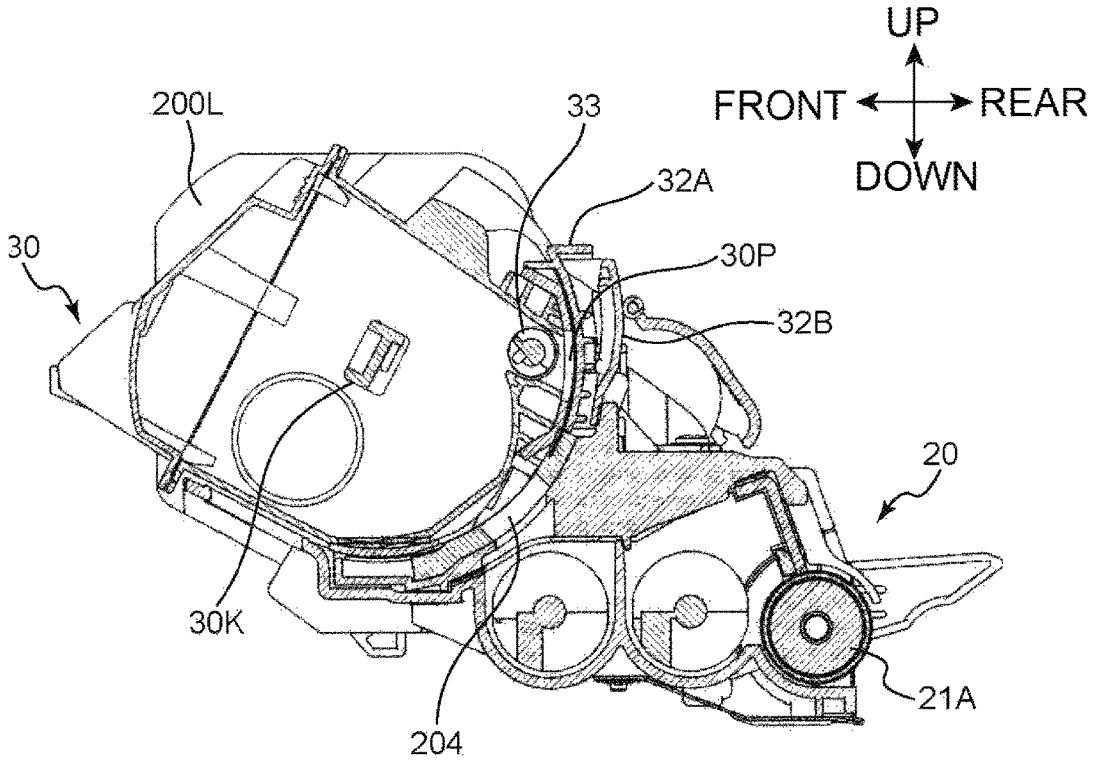
FIG. 20C illustrates a state where the developer housing container is mounted to the developing device according to the one embodiment in cross section.
Figure 21A:
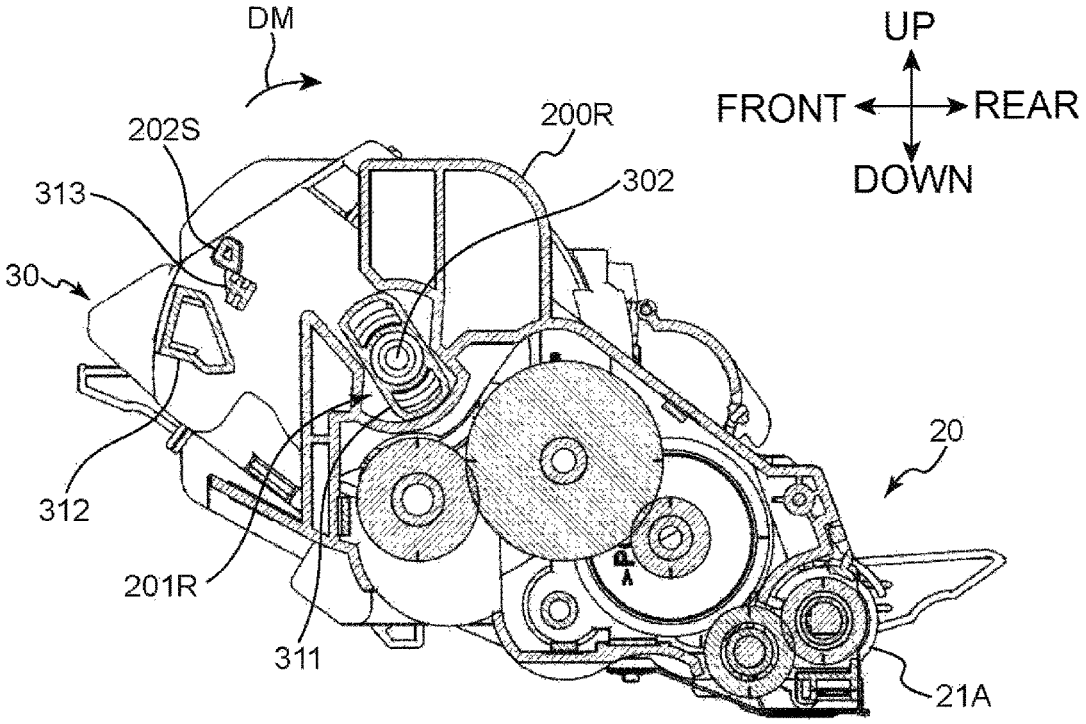
FIG. 21A illustrates a state where the developer housing container is mounted to the developing device according to the one embodiment in cross section.
Figure 21B:
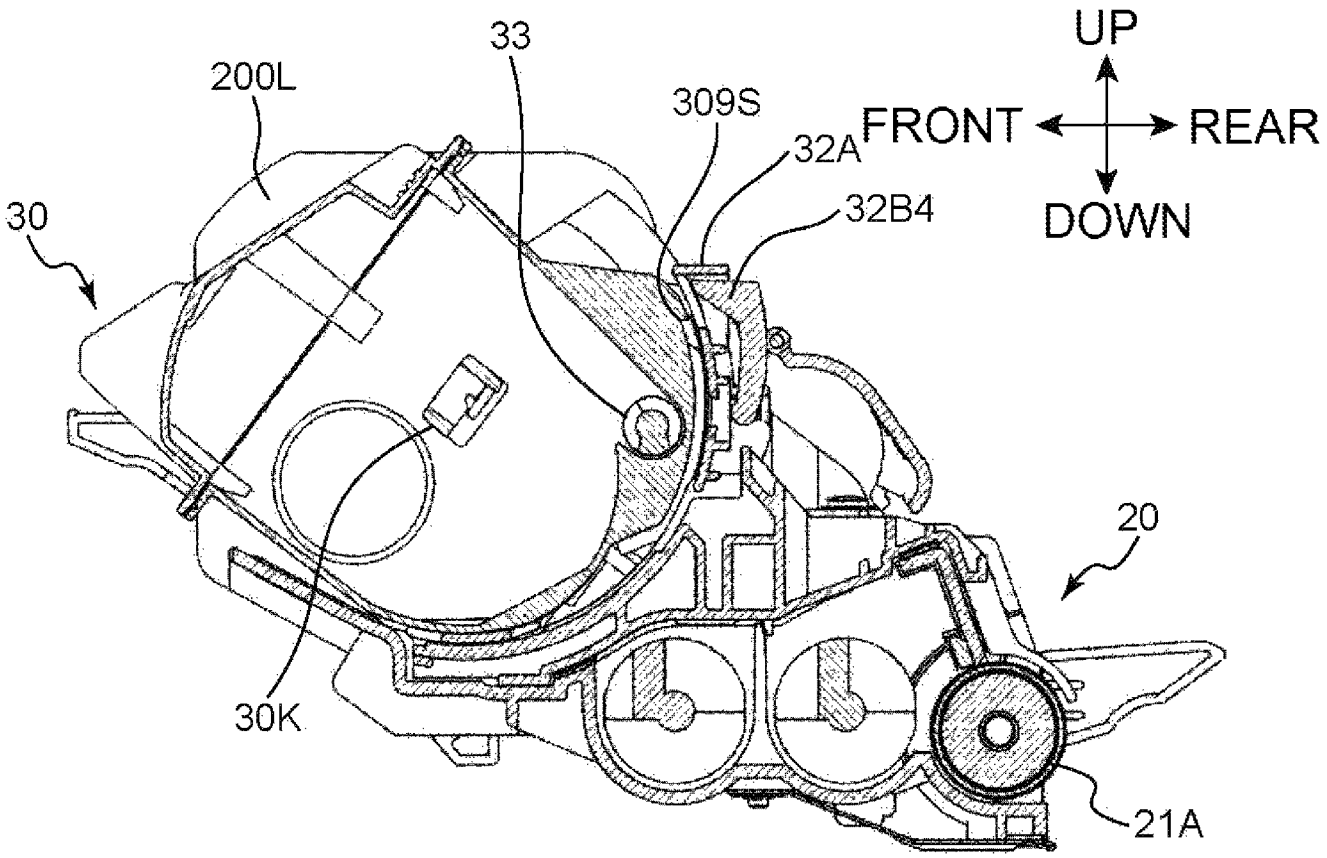
FIG. 21B illustrates a state where the developer housing container is mounted to the developing device according to the one embodiment in cross section.
Figure 21C:
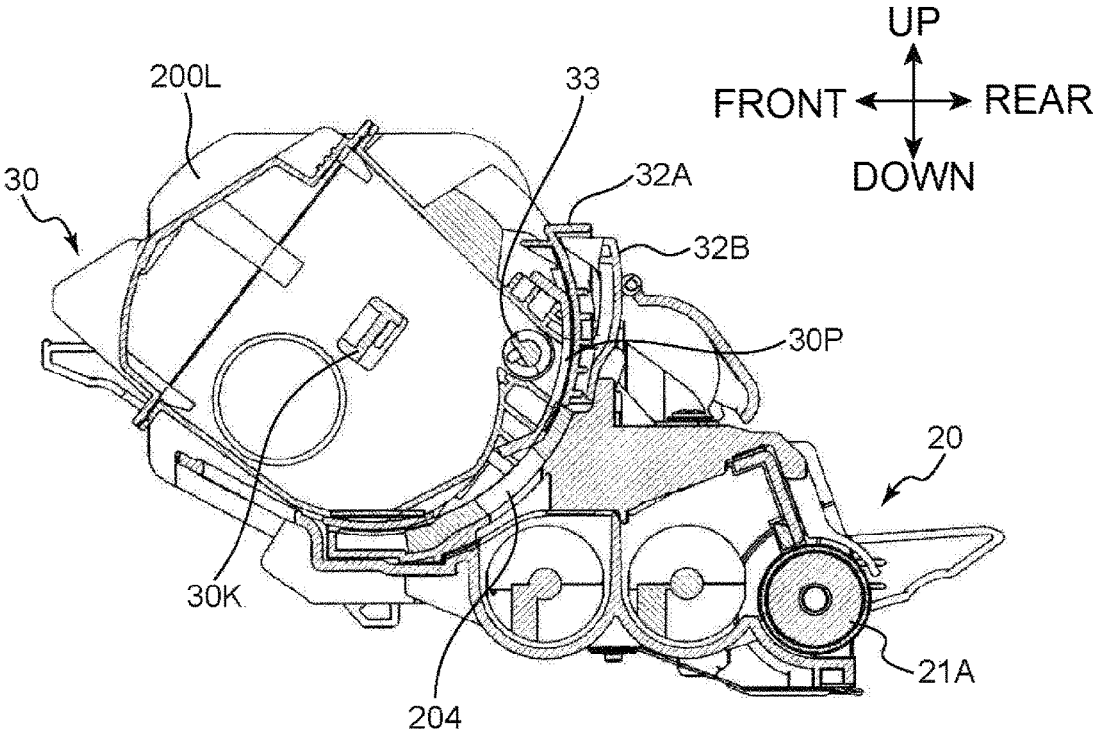
FIG. 21C illustrates a state where the developer housing container is mounted to the developing device according to the one embodiment in cross section.
Figure 22:
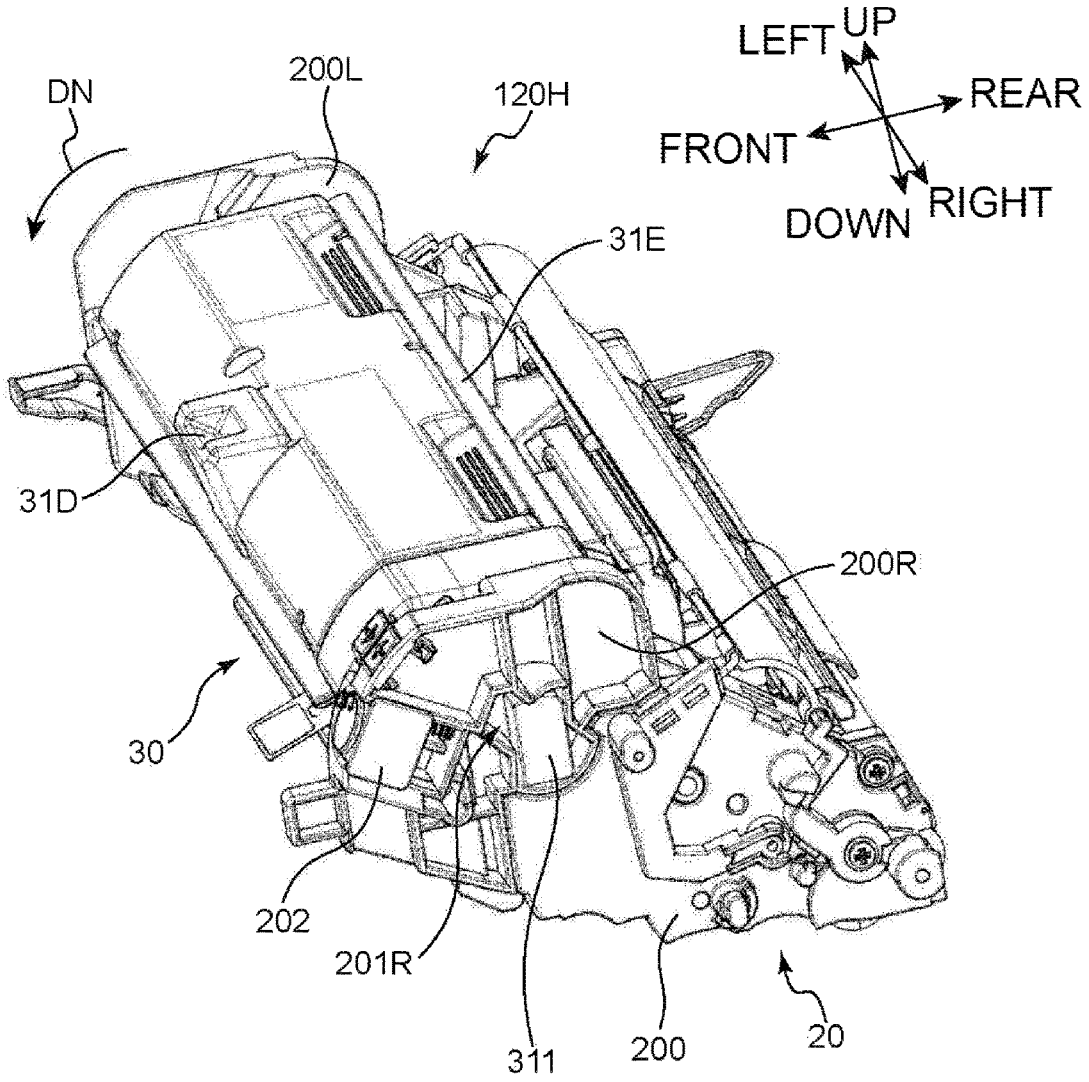
FIG. 22 obliquely illustrates a state where the developer housing container is mounted to the developing device according to the one embodiment.
Figure 23A:
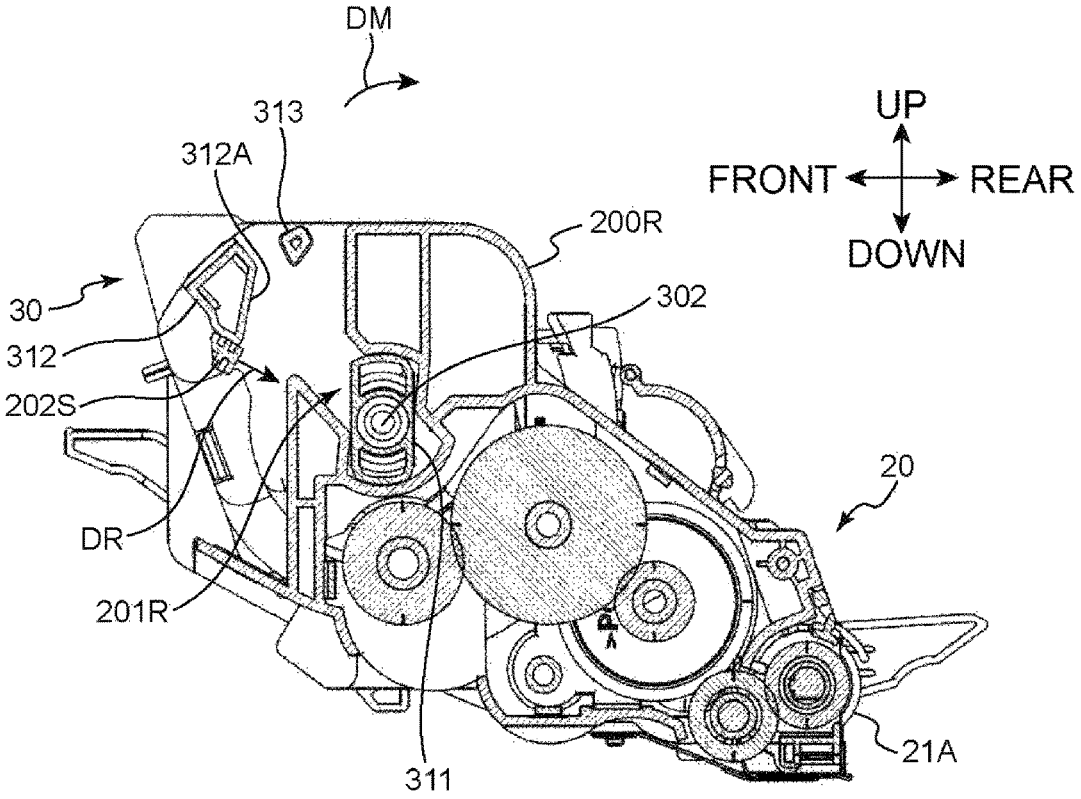
FIG. 23A illustrates a state where the developer housing container is mounted to the developing device according to the one embodiment in cross section.
Figure 23B:
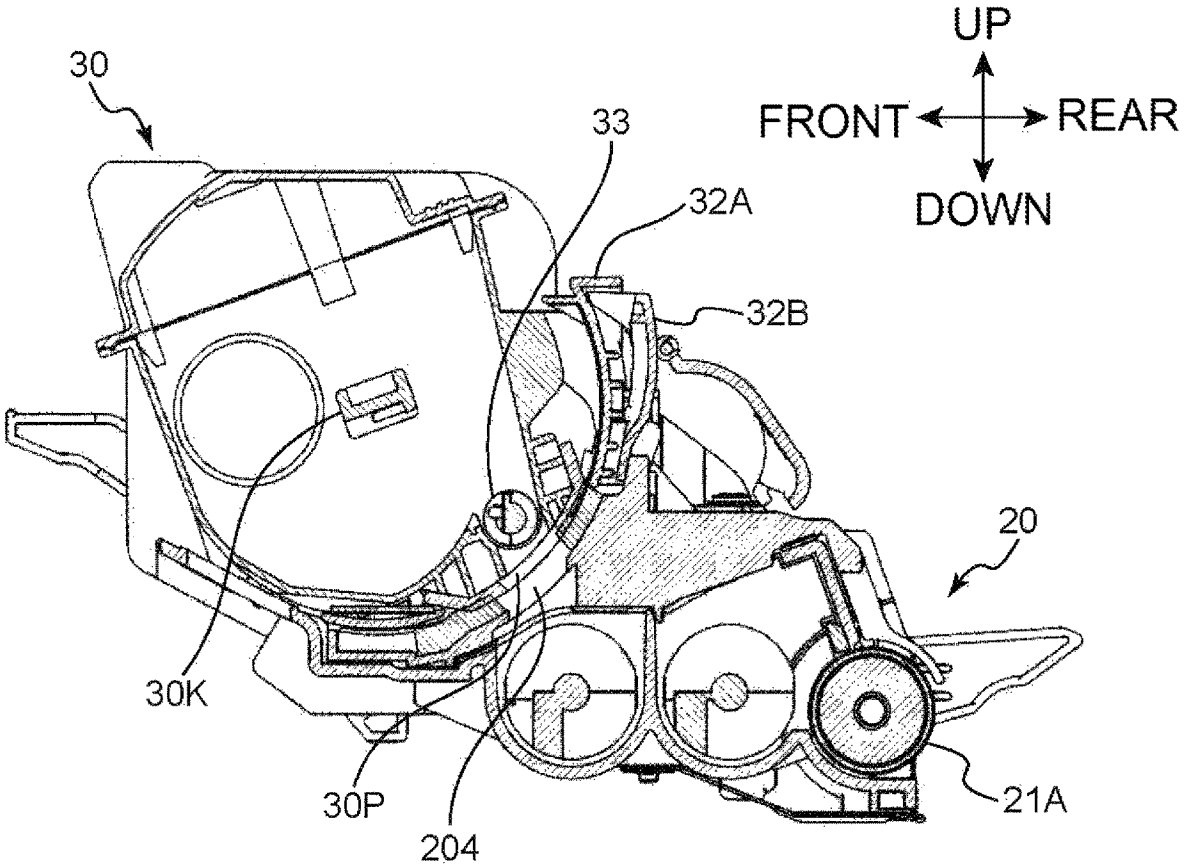
FIG. 23B illustrates a state where the developer housing container is mounted to the developing device according to the one embodiment in cross section.

FIG. 17 obliquely illustrates the disassembled developing device 20 according to the embodiment. FIG. 17 illustrates the lock button 202 and a lock urging spring 201U separated from the development housing 200. FIGS. 18A and 18B obliquely illustrate a part of the enlarged developing device 20 (a periphery of the housing-right-side wall 200R on the development housing 200). FIG. 19 obliquely illustrates a state where the toner container 30 is mounted to the developing device 20. FIGS. 20A to 20C illustrate a state where the toner container 30 is mounted to the developing device 20 in cross section. FIGS. 20A, 20B, and 20C differ in a cut surface of the developing device 20 in the longitudinal direction. Similarly, FIGS. 21A to 21C illustrate a state where the toner container 30 is mounted to the developing device 20 in cross section. Compared with FIGS. 20A to 20C, FIGS. 21A to 21C differ in a rotation position of the toner container 30. FIG. 22 obliquely illustrates a state where the toner container 30 is mounted to the developing device 20. FIGS. 23A and 23B are cross sections of the developing device 20 in a state of FIG. 22.

With reference to FIG. 17, the housing-right-side wall 200R on the development housing 200 includes a lock guide groove 201S and lock locking pieces 201T. The lock guide groove 201S is a groove formed on the front of the right-side guide groove 201R on the housing-right-side wall 200R. The lock locking pieces 201T are pair of craws formed to project to the lock guide groove 201S on the front side portion of the housing-right-side wall 200R. The developing device 20 further includes the lock urging spring 201U. The lock urging spring 201U is a coil spring located inside the lock guide groove 201S to urge the lock button 202 forward. The above-described lock button 202 includes the above-described lock abutment piece 202S. The lock abutment piece 202S is a protrusion projected from the lock button 202 toward the left side. The lock abutment piece 202S has a function to lock the toner container 30 to the respective postures. The lock button 202, which includes the lock abutment piece 202S, has a function to release the lock of this toner container 30.

Further, with reference to FIG. 18A, a guide opening 201V is open at a left side surface on the housing-right-side wall 200R. The guide opening 201V is an elongated hole formed along a direction slightly intersecting with the mounting direction (an arrow DA direction in FIG. 18A) of the toner container 30. While compressing the lock urging spring 201U, the lock button 202 is inserted into the lock guide groove 201S and the lock abutment piece 202S is fitted to the guide opening 201V. In a state where the urging force from the lock urging spring 201U slightly projects the front surface portion of the lock button 202 from a front side portion of the housing-right-side wall 200R, the lock button 202 stops. The lock locking pieces 201T (see FIG. 17) prevent a detachment of the lock button 202. When a user presses the lock button 202 against the urging force from the lock urging spring 201U, as illustrated in FIG. 18B, the lock abutment piece 202S moves from the front end portion to a rear end portion of the guide opening 201V.

As described above, in this embodiment, with the developing device 20 mounted to the housing 101 first, the toner container 30 alone is removably attachable to the developing device 20. Even if the toner container 30 becomes empty, this ensures easily exchanging the toner container 30. If the container shutter 32 is slidably moved from a position of covering the toner discharge port 30P by mistake until the toner container 30 is mounted to the developing device 20, the toner leaks from the toner discharge port 30P. This embodiment prevents the slidable movement of the container shutter 32 from the toner discharge port 30P while the toner container 30 alone is mounted.

That is, as illustrated in FIG. 13A, with the container shutter 32 covering the toner discharge port 30P, the stopper lock pieces 32B4 (see FIG. 14B) passing through the shutter holes 32A6 engage the container shutter engaging portions 309S (see FIG. 12) on the container shutter lock ribs 309 on the container main body 31 side. Distal end portions of the elastic pieces 32B5 (see FIG. 14B) exposed from the elastic piece supporting portions 32A4 to the back side of the container shutter 32 are opposed to the elastic piece pressing portions 306 (see FIG. 12). When the stopper releasing piece 32B2 (see FIG. 14A) is pressed by mistake, the elastic pieces 32B5 are slightly urged toward radially outside of the toner container 30 by the elastic piece pressing portions 306, thus being elastically deformed. By thus urging and elastically deforming the distal end portions the elastic pieces 32B5, at the shutter stopper 32B (see FIG. 14A), using a pair of the stopper fulcrums 32B3 as the fulcrums, a moment (a urging force) is given in a direction that the stopper lock pieces 32B4 side strongly engages the container shutter engaging portions 309S (see FIG. 12). Accordingly, when the toner container 30 alone is stored and transported, the elastic forces from the elastic pieces 32B5 prevents the container shutter 32 from slidably moving along the guide ribs 307. Consequently, the container shutter 32 (see FIG. 11) stably seals the toner discharge port 30P.

Referring to FIGS. 19 to 20C, with the front cover 106 open, the user of the printer 100 mounts the toner container 30 to the developing device 20 inside the housing 101. At this time, the user has his/her index finger and middle finger on a periphery of the second grip portion 31E, which is located on an upper side of the toner container 30 in FIG. 19, and has his/her thumb on the first grip portion 31D of the toner container 30 to easily grip the toner container 30. The user inserts the left-side guide 301 and the right-side guide 311 on the toner container 30 into the left-side guide groove 201L and the right-side guide groove 201R, respectively. This mounts the toner container 30 to the container mounting portion 20H while the toner container 30 is guided along the mounting direction (an arrow DA direction in FIG. 19) by the left-side guide groove 201L and the right-side guide groove 201R (see FIGS. 19A and 20A to 20C). The postures of the toner container 30 illustrated in FIGS. 19 and 20A to 20C are defined as a second posture or a third posture of the disclosure. With this posture, the toner discharge port 30P on the toner container 30 is separated above the toner replenishment port 204 of the developing device 20, and the toner discharge port 30P and the toner replenishment port 204 have not been communicated yet (see FIG. 20C).

In this respect, as illustrated in FIG. 16B, the stopper pressing portion 206 on the development housing 200 presses the stopper releasing piece 32B2 (see FIG. 14A), which is located between a pair of the releasing piece supporting portions 32A2. Consequently, the shutter stopper 32B swings using a pair of the stopper fulcrums 32B3 as the fulcrums, and a pair of the stopper lock pieces 32B4 are detached from the respective container shutter engaging portions 309S (see FIG. 12), thus releasing the engagement between both (see FIG. 20B). This releases the lock to the container shutter 32 by the shutter stopper 32B, ensuring the slidable movement of the container shutter 32 to the container main body 31.

Meanwhile, when the toner container 30 is mounted to the container mounting portion 20H with the insertion posture in FIG. 19, a pair of the shutter engaging pieces 32A8 (see FIG. 14A) of the container shutter 32 engage the wedge-shaped cutouts of the container shutter securing portions 207 (see FIG. 16B). This secures the container shutter 32 to the container shutter securing portions 207. After this, the user rotationally drives the container main body 31 of the toner container 30 from the insertion posture illustrated in FIG. 19 in the first rotation direction (an arrow DM direction in FIG. 21A) around the shaft center of the container paddle 30K (see FIG. 20B).

After the toner container 30 goes through the state illustrated in FIGS. 21A to 21C while being slidably moved to the container shutter 32 to which the toner discharge port 30P is secured, the toner container 30 reaches a replenishment position illustrated in FIGS. 22 to 23B. The postures of the toner container 30 illustrated in FIGS. 22, 23A, and 23B are defined as the first posture of the disclosure. With the first posture, the communication of the toner discharge port 30P on the toner container 30 with the toner replenishment port 204 on the developing device 20 (see FIG. 23B) ensures the toner replenishment to the developing device 20.

When the toner container 30 is rotationally driven from the insertion posture in FIG. 19 in the first rotation direction (a DM direction), the elastic piece pressing portions 306 of the container main body 31 pressing the distal end portions (see FIG. 14B) of the elastic pieces 32B5 of the shutter stopper 32B separate from the elastic pieces 32B5. With the toner discharge port 30P open, this restrains continuously giving a strong force to the elastic pieces 32B5, preventing an elastic deformation of the elastic pieces 32B5.

With the toner container 30 not mounted to the container mounting portion 20H, the main body shutter 22 seals the toner replenishment port 204. When the toner container 30 is rotationally driven in the first rotation direction as described above and the posture is changed from the insertion posture to a replenishment posture, the container shutter pressing pieces 305S (see FIG. 12) on the toner container 30 presses the main body shutter 22 in the first rotation direction against the urging force from the shutter springs 208 (see FIG. 5). This slidably moves the main body shutter 22 in the first rotation direction together with the container main body 31 of the toner container 30 and as illustrated in FIG. 23B, the toner replenishment port 204 is open. Accordingly, the toner discharge port 30P and the toner replenishment port 204 are vertically communicable.

As illustrated in FIG. 19, mounting the toner container 30 to the container mounting portion 20H with the insertion posture engages the lock abutment piece 202S to the second lock engaging portion 313 as illustrated in FIG. 20A. After this, when the user rotationally drives the toner container 30 in the first rotation direction, the lock abutment piece 202S is soon separate from the second lock engaging portion 313 while slidingly rubs against the second lock engaging portion 313. Afterwards, after the sliding motion against an inclined surface 312A on the first lock engaging portion 312, as illustrated in FIG. 23A, the lock abutment piece 202S engages the first lock engaging portion 312 at the lower side of the first lock engaging portion 312. Consequently, the lock abutment piece 202S locks the toner container 30 to the replenishment posture (see FIG. 23B). With this locked state, even if the urging force from the shutter springs 208 (see FIG. 5) reaches the container shutter pressing portion 305 of the toner container 30 via the main body shutter 22, the lock abutment piece 202S regulates the rotation of the toner container 30. This restrains the rotation of the toner container 30 in the second rotation direction, that is, this restrains changing the posture of the toner container 30 from the replenishment posture to the insertion posture.

On the other hand, when a sensor (not illustrated) detects the empty toner in the toner container 30, a display (not illustrated) on the printer 100 notifies an exchange display for the toner container 30. When the user presses the lock button 202 (see FIG. 18A), the lock abutment piece 202S moves rearward along the guide opening 201V (see FIG. 18B). As indicated by an arrow DR in FIG. 23A, this separates the lock abutment piece 202S from the first lock engaging portion 312 rearward, thus releasing the engagement between the lock abutment piece 202S and the first lock engaging portion 312. This loses the regulating force regulating the first lock engaging portion 312, thereby releasing the lock of the toner container 30. Since the urging forces from the shutter springs 208 are given to the main body shutter 22, while the main body shutter 22 presses the container shutter pressing portion 305 of the toner container 30, the toner container 30 rotates in the second rotation direction (an arrow DN in FIG. 22). Consequently, the toner container 30 automatically changes the posture from the replenishment posture to the insertion posture by the urging force from the shutter springs 208. When the toner container 30 rotates in the second rotation direction, the lock abutment pieces 202S are urged to the inclined surface 312A on the first lock engaging portion 312 by the urging force from the lock urging spring 201U. Separating the first lock engaging portion 312 from the lock abutment piece 202S recovers the lock abutment piece 202S at the position illustrated in FIG. 18A.

The posture change of the toner container 30 turns the toner discharge port 30P to the second rotation direction, and the toner discharge port 30P is re-sealed by the container shutter 32 at the insertion position. The urging force from the shutter springs 208 slidably moves the main body shutter 22, thus re-sealing the toner replenishment port 204 by the main body shutter 22.

Again, the toner container 30 with the insertion posture illustrated in FIG. 19 is detached from the container mounting portion 20H along a direction opposite from the mounting direction, thus removing the toner container 30 from the developing device 20. Thus, in this embodiment, only pressing the lock button 202 by the user releases the lock of the toner container 30 and changes the posture of the toner container 30 to the insertion posture. Then, the container shutter 32 and the main body shutter 22 seal the toner discharge port 30P and the toner replenishment port 204, respectively. When the user removes the toner container 30, this prevents the peripheral areas of the developing device 20 and the toner container 30 from being contaminated with the toner.

Packing Toner Container Together for Transportation

When the printer 100 that can mount the toner container 30 as described above manufactured in a factory or a similar facility is transported to an installation environment for the user, the toner container 30 has been often packed separately from the housing 101. In this case, the toner container 30 packed outside the housing 101 is loaded, increasing a transportation cost. There is also a problem that the user cannot quickly start using the printer 100 after installation. To solve such problem, shipping the printer 100 with the toner container 30 packed together inside the housing 101 is preferable. However, if the printer 100 is transported with the toner container 30 mounted to the developing device 20 in the replenishment posture illustrated in FIG. 22, due to vibrations during the transportation or a similar failure, a large amount of toner flows in from the toner container 30 to the developing device 20. This sometimes stains the inside of the printer 100 with toner. Meanwhile, when the printer 100 is transported with the toner container 30 mounted to the developing device 20 in the insertion posture as illustrated in FIG. 19, the problem as described above is less likely to occur. This is because that, at the insertion position of the toner container 30, the toner discharge port 30P on the toner container 30 does not communicate with the toner replenishment port 204 on the developing device 20 but the container shutter 32 seals the toner discharge port 30P. However, thus, if the front cover 106 (see FIG. 1) is configured to be closeable with respect to the housing 101 while the toner discharge port 30P does not communicate with the toner replenishment port 204, after a completion of the installation of the printer 100, the printer 100 is sometimes used with the toner container 30 remaining in the insertion posture illustrated in FIG. 19. Consequently, despite that the photoreceptor drum 121 consumes the toner from the developing device 20, the toner container 30 does not replenish the toner to the developing device 20, causing a problem of reduction in print density for images.

Regulating Member

Figure 24A:
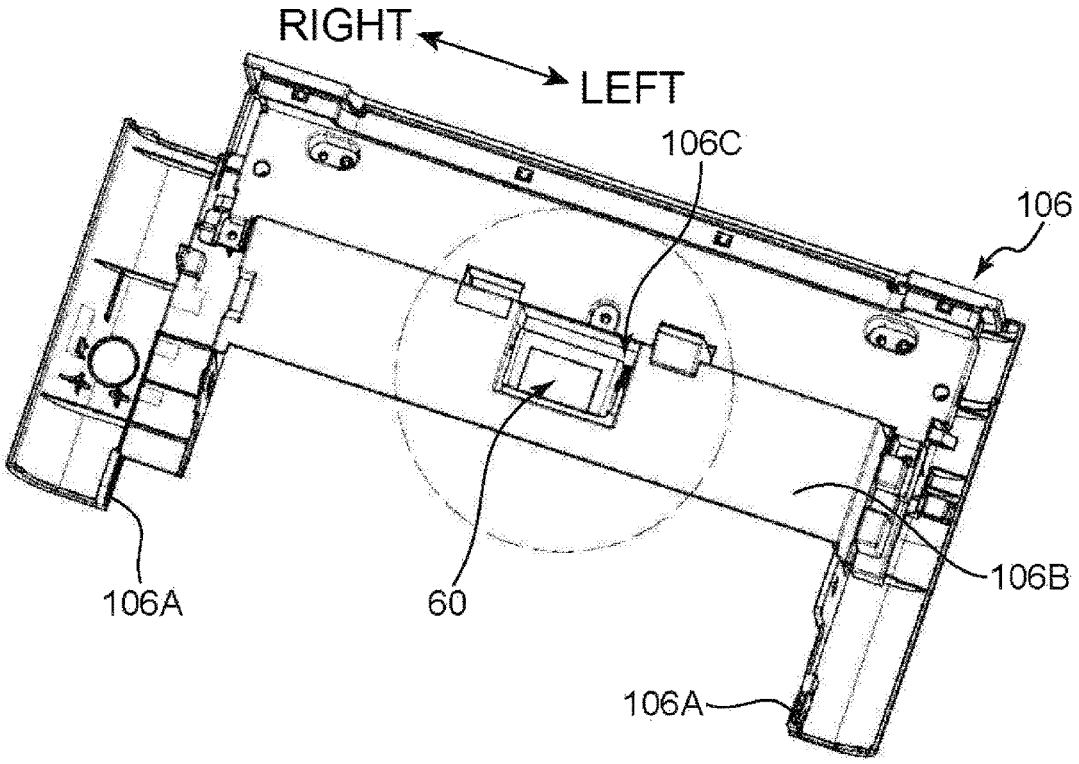
FIG. 24A obliquely illustrates a cover member of the apparatus main body according to the one embodiment.
Figure 24B:
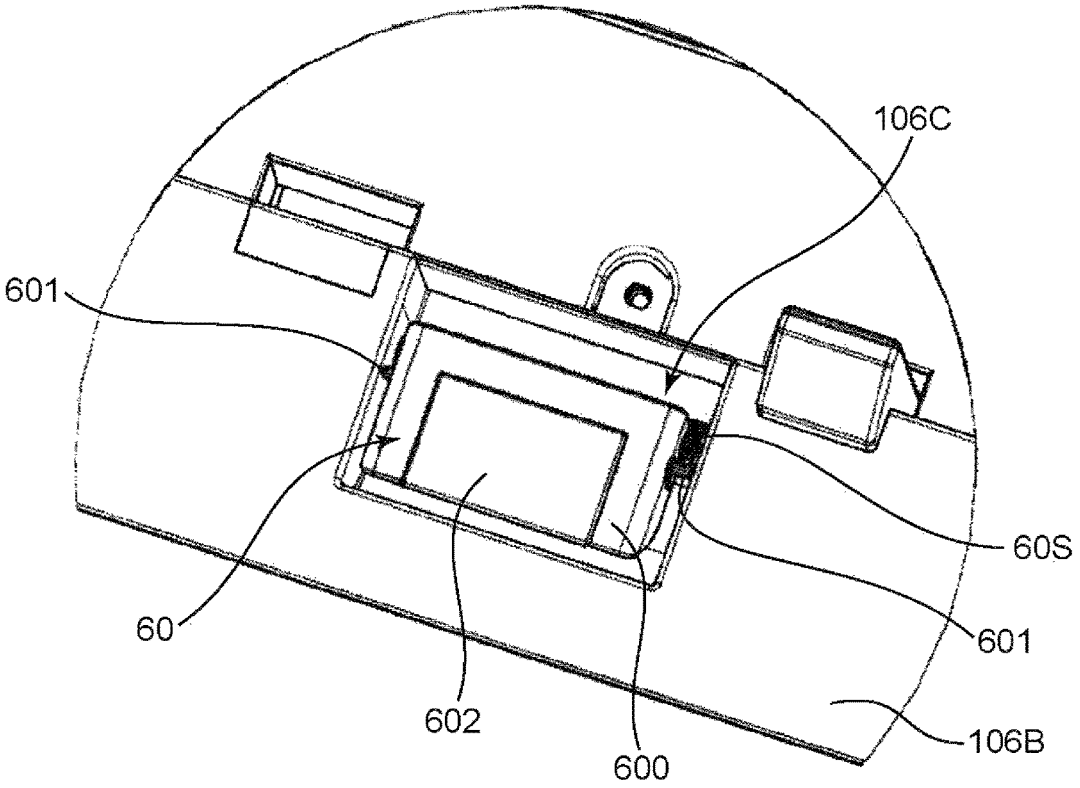
FIG. 24B obliquely illustrates the enlarged cover member of the apparatus main body according to the one embodiment.
Figure 25A:
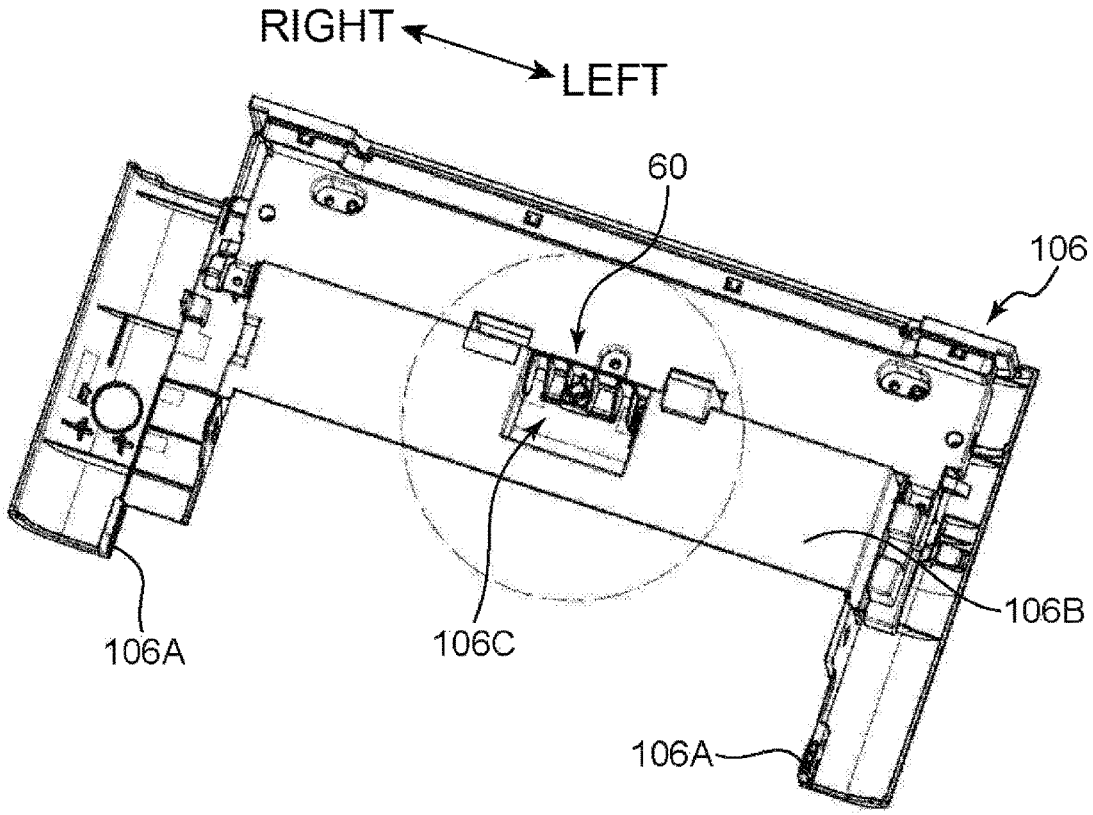
FIG. 25A obliquely illustrates the cover member of the apparatus main body according to the one embodiment.
Figure 25B:
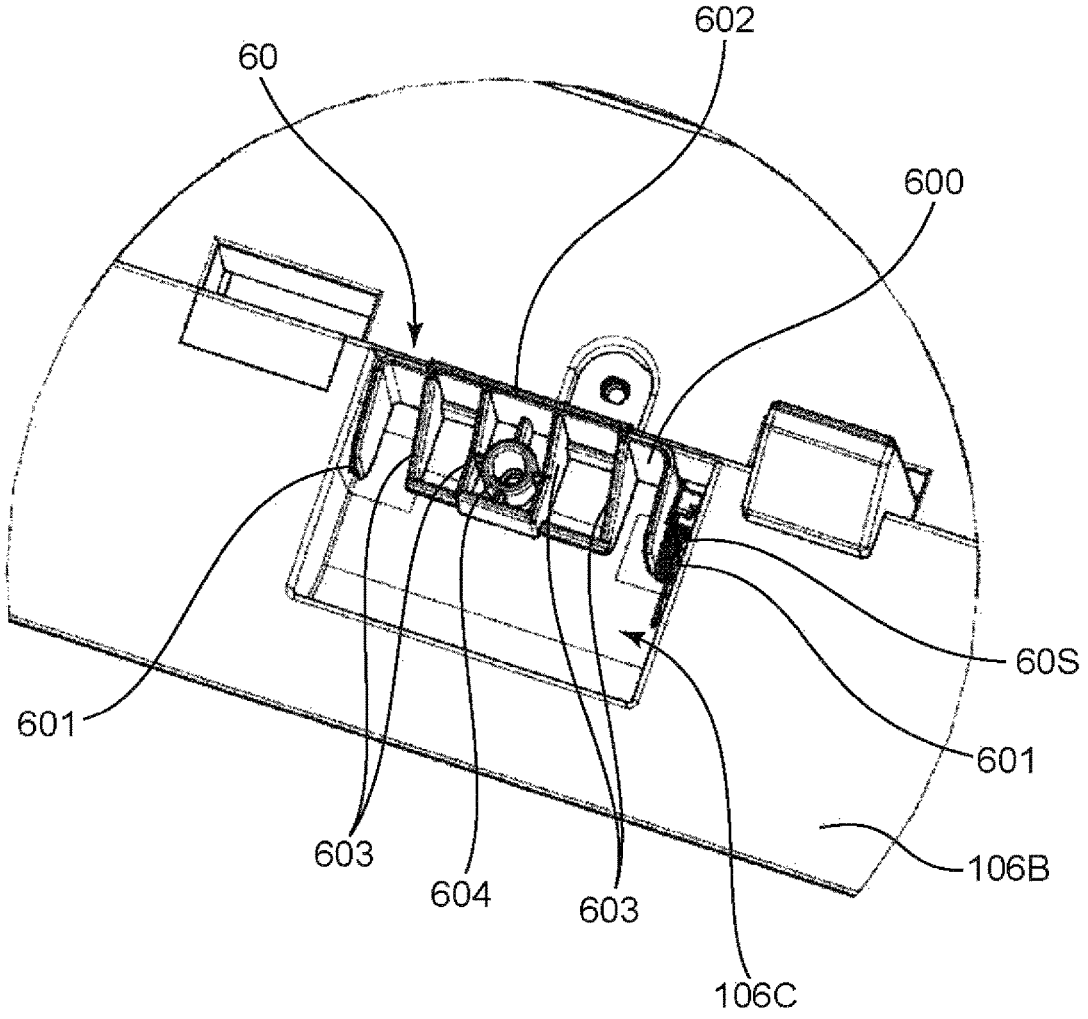
FIG. 25B obliquely illustrates the enlarged cover member of the apparatus main body according to the one embodiment.
Figure 26:
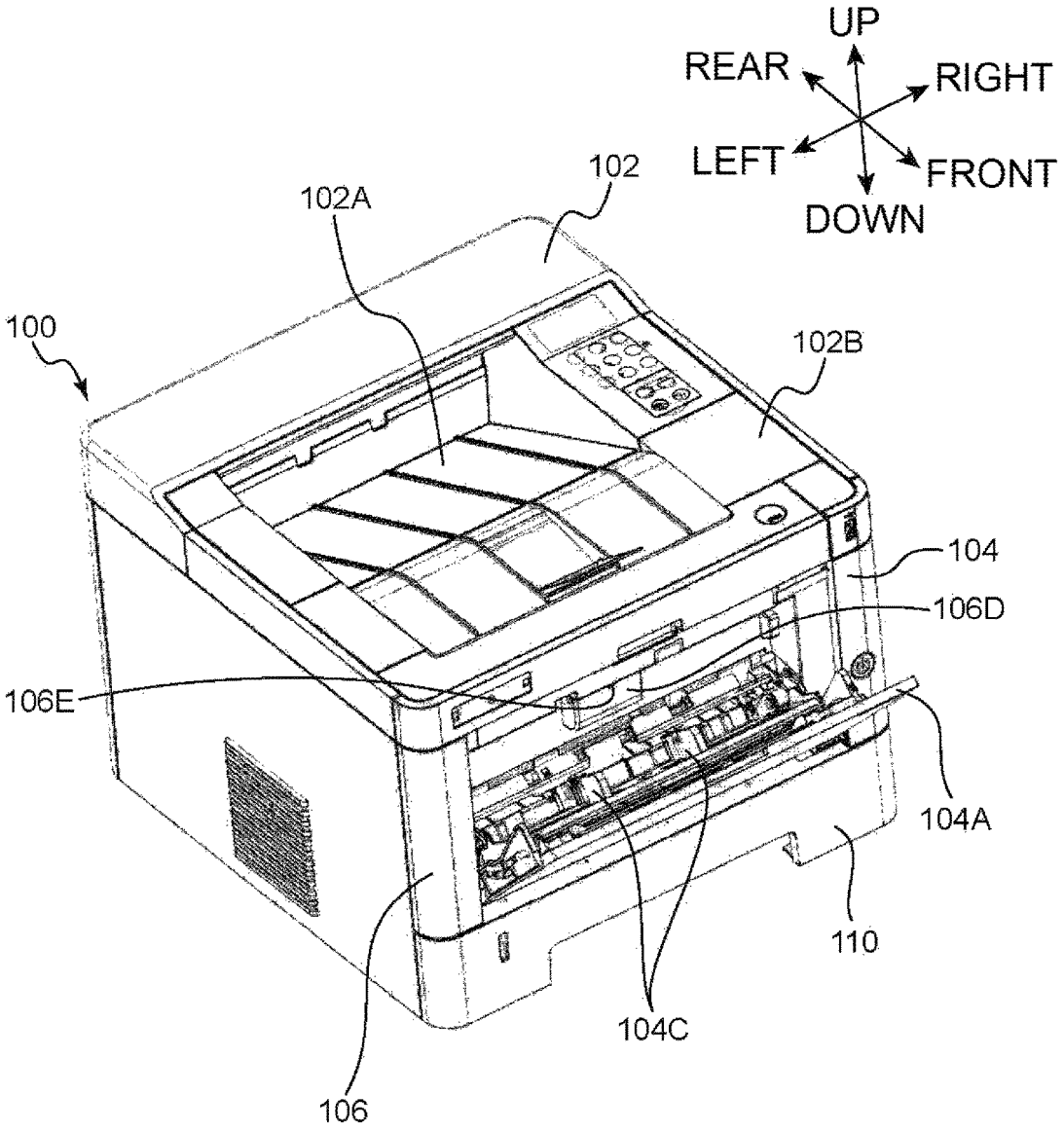
FIG. 26 obliquely illustrates an image forming apparatus according to the one embodiment.
Figure 27:
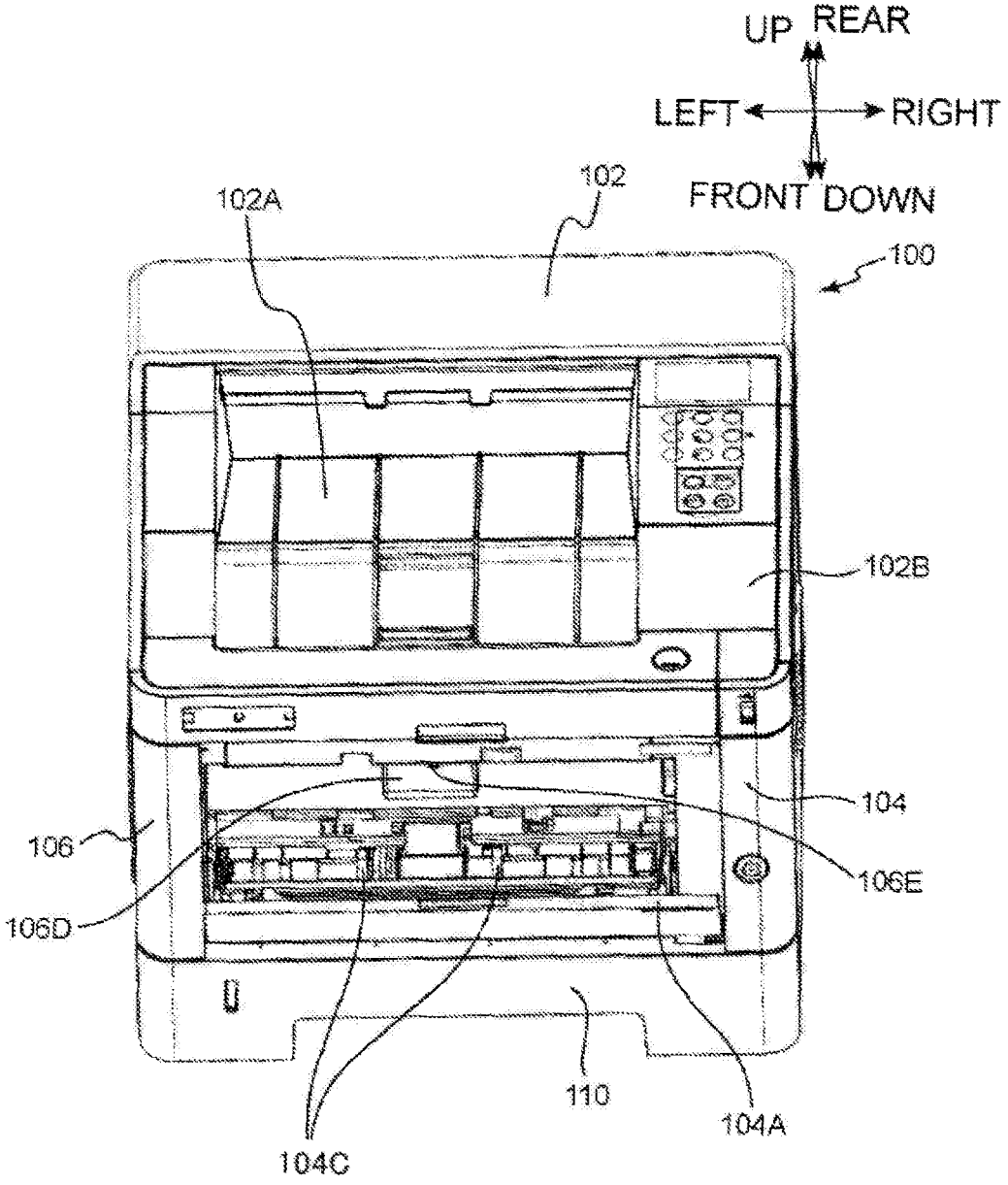
FIG. 27 obliquely illustrates the image forming apparatus according to the one embodiment.
Figure 28A:
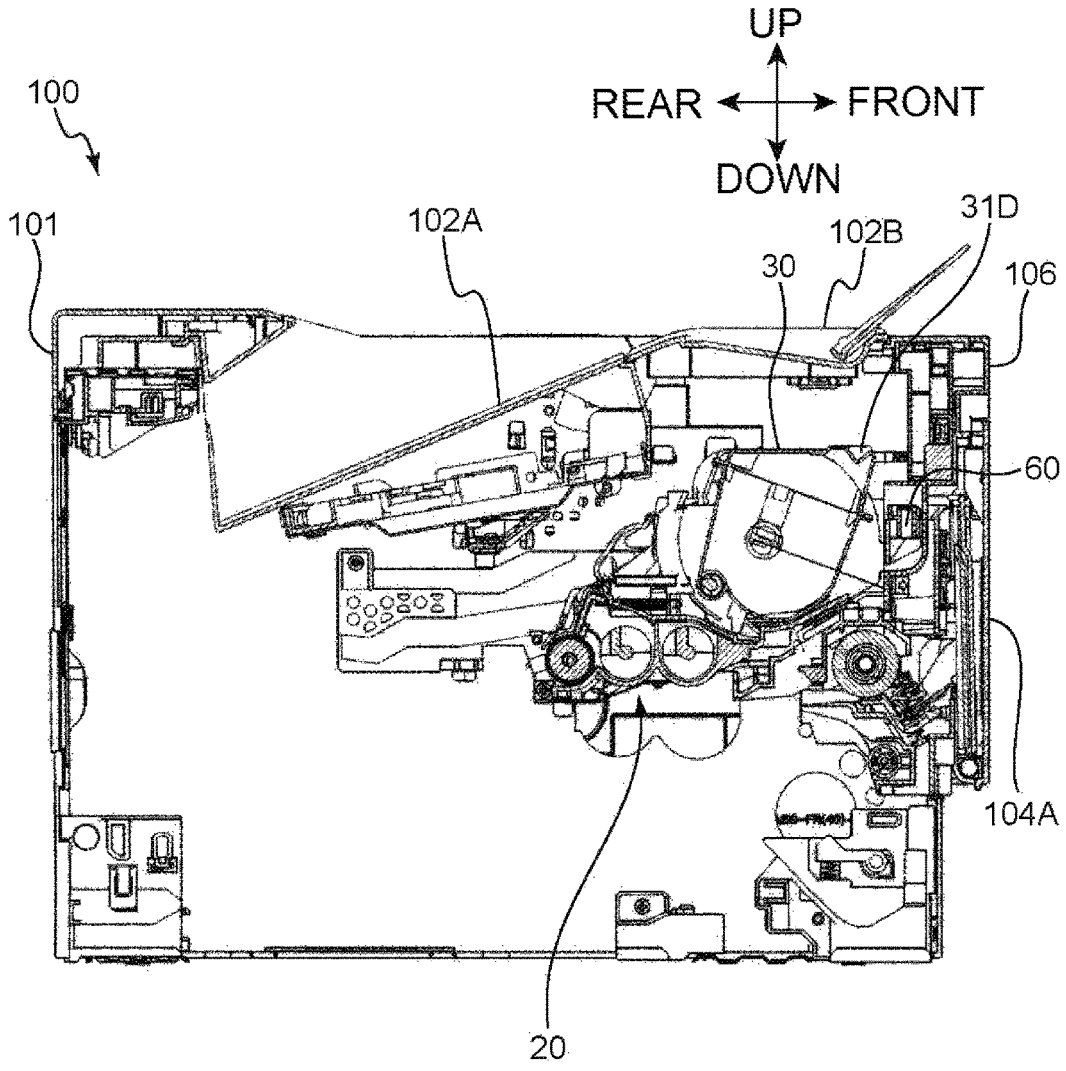
FIG. 28A illustrates a cross section of the image forming apparatus according to the one embodiment.
Figure 28B:
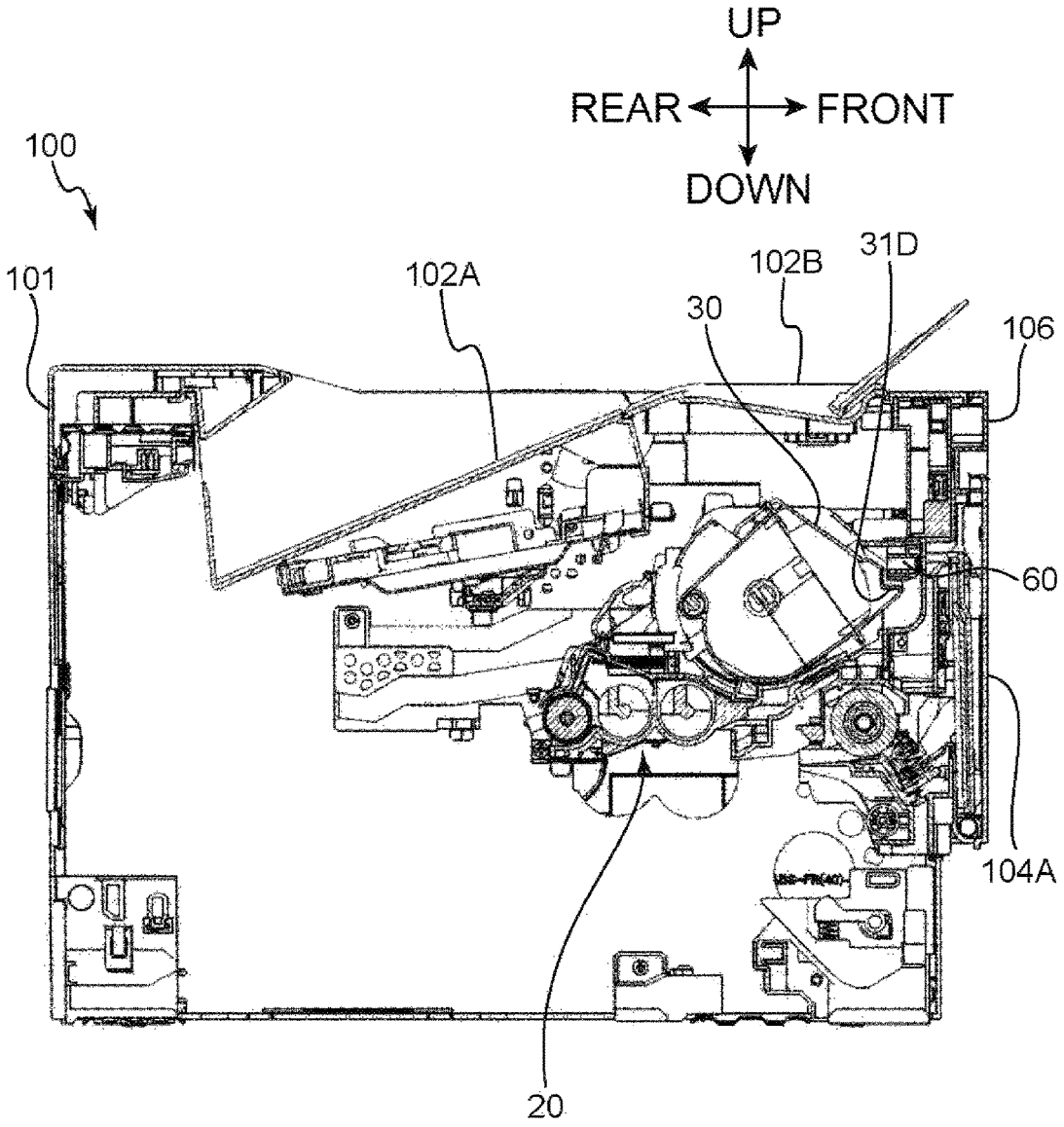
FIG. 28B illustrates a cross section of the image forming apparatus according to the one embodiment.
Figure 29A:
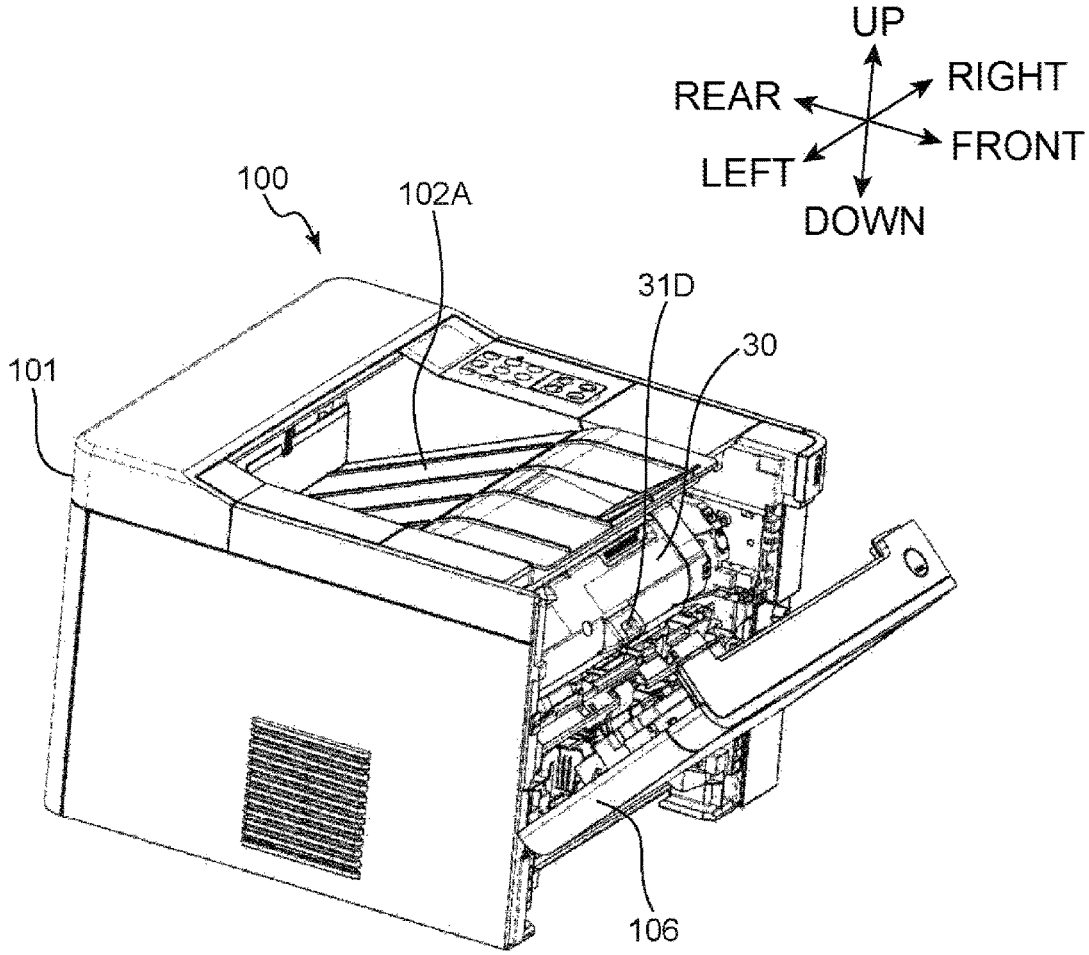
FIG. 29A obliquely illustrates the image forming apparatus according to the one embodiment.
Figure 29B:
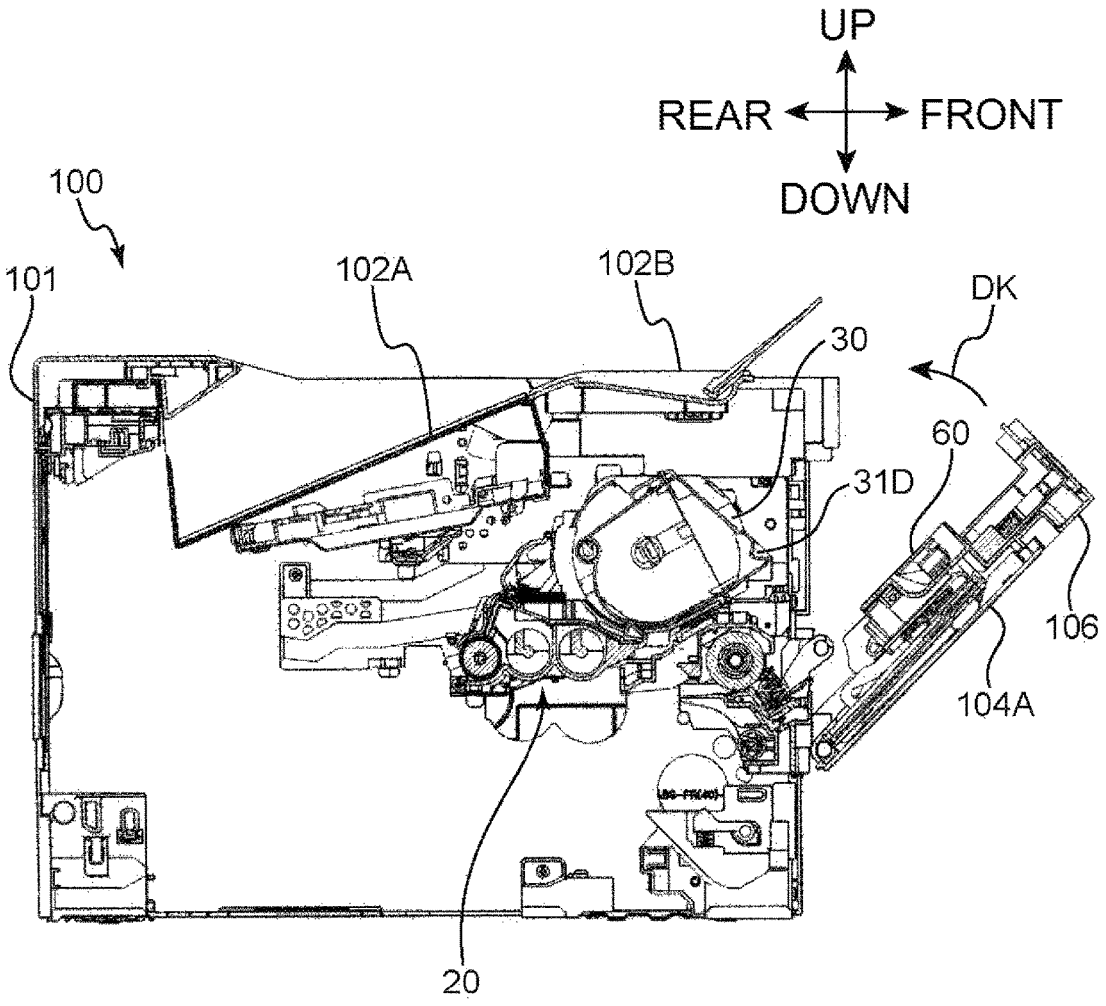
FIG. 29B illustrates a cross section of the image forming apparatus according to the one embodiment.
Figure 30:
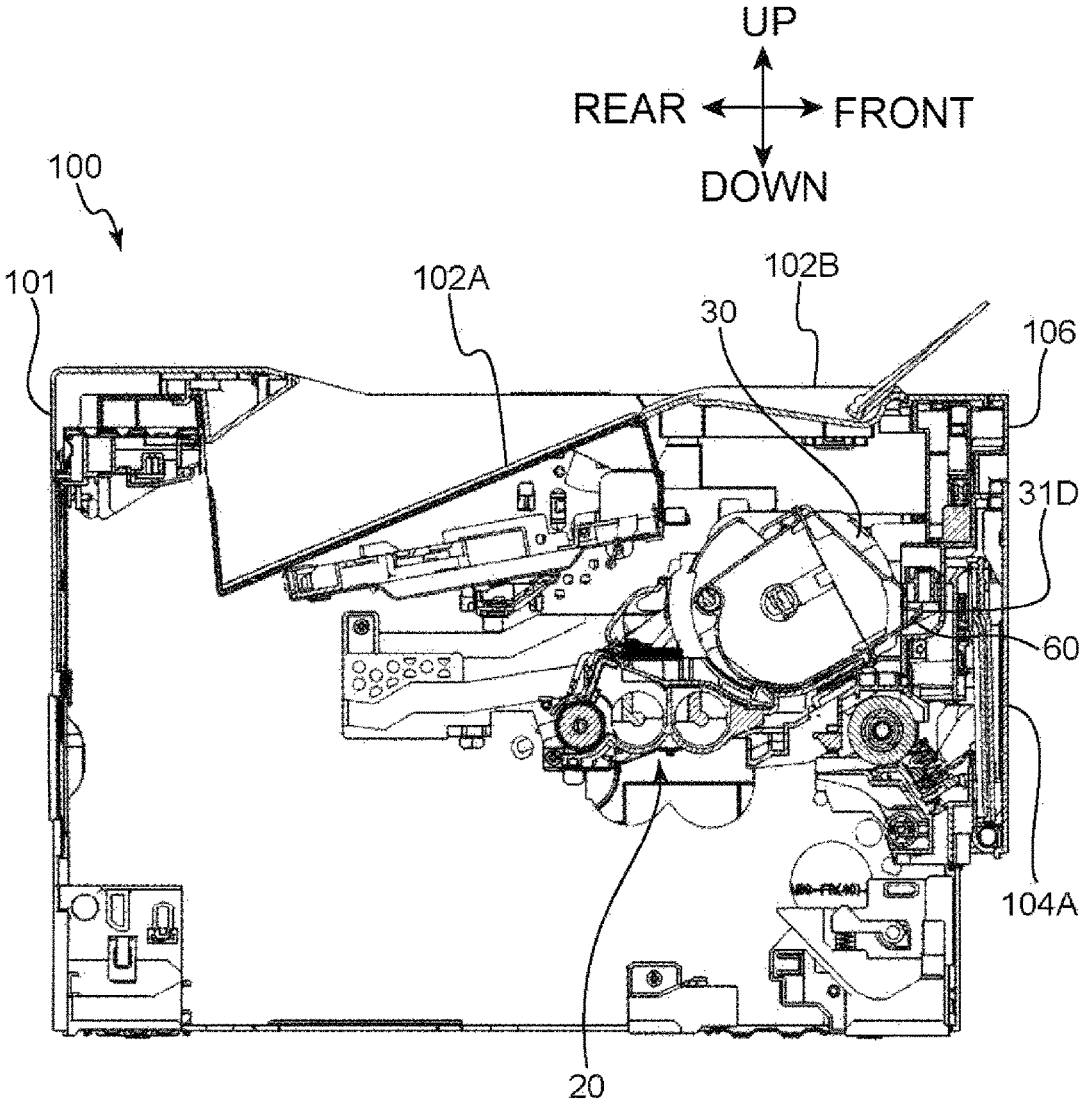
FIG. 30 illustrates a cross section of the image forming apparatus according to the one embodiment.

To solve such problem, in this embodiment, the printer 100 includes a regulating member 60. FIG. 24A obliquely illustrates the front cover 106 (the cover member) of the housing 101 according to the embodiment. FIG. 24B obliquely illustrates the enlarged front cover 106 in FIG. 24A. Similarly, FIG. 25A obliquely illustrates the front cover 106. FIG. 25B obliquely illustrates the enlarged front cover 106 in FIG. 25A. FIGS. 24A and 24B illustrate the regulating member 60 located at a first position, which will be described later. FIGS. 25A and 25B illustrate the regulating member 60 located at a second position, which will be described later. FIGS. 26 and 27 obliquely illustrate the printer 100 according to the embodiment. FIGS. 28A and 28B illustrate a cross section of the printer 100. Similarly, FIG. 29A obliquely illustrates the printer 100. FIG. 29B illustrates a cross section of the printer 100 in FIG. 29A. FIG. 30 illustrates a cross section of the printer 100 to describe an interference state of the regulating member 60 with the toner container 30.

By referring to FIGS. 24A to 27, the regulating member 60 is included in the front cover 106. The front cover 106 has an approximately U shape open downward. The front cover 106 includes cover fulcrums 106A, a center plate 106B, a plate concave portion 106C, a plate protrusion 106D (see FIG. 26), and a hole 106E (see FIG. 26).

The cover fulcrums 106A are open/close fulcrums of the front cover 106 with respect to the housing 101. A pair of the cover fulcrums 106A are located on lower end portions of the front cover 106. The center plate 106B, which is located at an approximately center of the front cover 106 in the vertical direction, is a planar portion extending in the lateral direction. The plate concave portion 106C is a concave portion formed at the center of the center plate 106B in the lateral direction. The plate concave portion 106C illustrated in FIGS. 24A and 24B appears when the front cover 106 is viewed from the main-body internal space 107 (see FIG. 1) side of the housing 101. As illustrated in FIG. 26, when the front cover 106 is viewed from outside the housing 101 with the manual bypass tray 104A opened, the plate protrusion 106D, which corresponds to the back side of the plate concave portion 106C, appears. The plate concave portion 106C is a concave portion formed by depressing a part of the center plate 106B into an approximately rectangular parallelepiped shape. As illustrated in FIG. 24B, the regulating member 60 can be housed inside the plate concave portion 106C. The hole 106E (see FIGS. 26 and 27) is a hole open at an approximately center of the plate protrusion 106D. In FIG. 26, from outside the housing 101 to the main-body internal space 107 of the housing 101, the hole 106E is formed passing through the plate protrusion 106D.

The regulating member 60 is a flat-shaped member made of resin material. When the toner container 30 takes the replenishment posture (see FIG. 22) in the housing 101, the regulating member 60 allows closing the housing 101 by the front cover 106. When the toner container 30 takes the insertion posture (see FIG. 19), the regulating member 60 interferes with the first grip portion 31D on the toner container 30 to regulate closing the housing 101 by the front cover 106. By referring to FIGS. 24A to 25B, the regulating member 60 includes a flat plate 600, shafts 601, an elastic plate 602, ribs 603, a communication hole 604, and a coil spring 60S (a urging spring).

The flat plate 600 is a plate-shaped portion with rectangular shape, which constitutes a main part of the regulating member 60. The shaft 601 projects from right and left side edges of the flat plate 600. The shaft 601 is inserted through a hole (not illustrated) open at the center plate 106B. The elastic plate 602 is an elastic member pasted to the flat plate 600. The elastic plate 602 reduces an impact when the regulating member 60 collides with the toner container 30. A plurality of the ribs 603 are located spaced on the back side of the flat plate 600. The ribs 603 improve rigidity of the regulating member 60. The communication hole 604 is a hole formed inside a cylindrical portion, which is located between the ribs 603. With the state illustrated in FIG. 25B, the communication hole 604 communicates with the hole 106E (see FIG. 26). The coil spring 60S is included around the shaft 601.

As illustrated in FIG. 24B, the plate protrusion 106D projects on the front surface portion of the front cover 106 to house the regulating member 60. The manual bypass tray 104A can be housed inside the front cover 106. The manual bypass tray 104A includes a pair of cursors 104C (see FIGS. 26 and 27) to regulate end edges of sheets to be placed. A pair of the cursors 104C are slidably movable toward sides opposite from one another in the lateral direction. In this respect, this embodiment regulates the entrance of the cursors 104C inside with respect to positions illustrated in FIG. 27. The positions of the cursors 104C illustrated in FIG. 27 correspond to a minimum size of a sheet placed on the manual bypass tray 104A. The plate protrusion 106D is configured so as to be located between a pair of the cursors 104C illustrated in FIG. 27. Therefore, the cursors 104C do not interference with the plate protrusion 106D.

As described above, FIGS. 24A and 24B illustrate the regulating member 60 located in the first position. FIGS. 25A and 25B illustrate the regulating member 60 located in the second position. Turning the regulating member 60 around the shafts 601 ensures changing the position between the first position and the second position. In the first position, the regulating member 60 is located along an inner wall surface of the front cover 106. Meanwhile, in the second position, the regulating member 60 projects from the inner wall surface of the front cover 106 toward the main-body internal space 107 (see FIG. 1). The coil spring 60S urges the regulating member 60 toward the first position. When the user uses the printer 100, the regulating member 60 is located in the first position by the urging force from the coil spring 60S.

As illustrated in FIGS. 22 and 28A, with the toner container 30 in the replenishment posture, the regulating member 60 located in the first position allows closing the front cover 106 with respect to the housing 101. Meanwhile, as illustrated in FIGS. 19, 29A, and 29B, with the toner container 30 in the insertion posture, if the front cover 106 is attempted to be closed, the regulating member 60 located in the first position interferes with the first grip portion 31D on the toner container 30. Thus, if the user attempts to close the front cover 106 with the toner container 30 remaining in the insertion posture (an arrow DK in FIG. 29B), since the regulating member 60 interferes with the toner container 30, the front cover 106 cannot be closed. This prevents the use of the printer 100 with the toner container 30 in the insertion posture, in other words, in a state where the toner discharge port 30P on the toner container 30 does not communicate with the toner replenishment port 204 on the developing device 20. FIG. 30 illustrate that the first grip portion 31D and the regulating member 60, which interfere with one another, overlap with the front cover 106 closed to show the interference state of the regulating member 60 with the first grip portion 31D on the toner container 30.

Meanwhile, when the printer 100 manufactured at a predetermined factory or a similar facility is shipped, the toner container 30 is initially configured to take the insertion posture, and the position of the regulating member 60 is initially configured to take the second position. In this respect, the position of the regulating member 60 is initially configured to the second position against the urging force from the coil spring 60S. In this embodiment, the hole 106E is open at the plate protrusion 106D, and the hole 106E communicates with the communication hole 604 on the regulating member 60. Accordingly, the operator inserts a thin bar-shaped member into the hole 106E to ensure configuring the regulating member 60 in the second position against the urging force from the coil spring 60S.

With the configuration, as illustrated in FIG. 28B, even if the toner container 30 takes the insertion posture, a part of the regulating member 60 is housed in the concave portion of the first grip portion 31D on the toner container 30, allowing closing the front cover 106 with respect to the housing 101. This ensures that the printer 100 is shipped, transported, and installed while the toner container 30 is packed together with the housing 101 where the toner discharge port 30P on the toner container 30 located at the insertion position is separate from the toner replenishment port 204 on the developing device 20.

As illustrated in FIG. 28B, the regulating member 60 initially located in the second position is located immediately above the first grip portion 31D on the toner container 30. Accordingly, the regulating member 60 regulates a rotation of the toner container 30 in the insertion posture in the first rotation direction. Consequently, this prevents the toner container 30 from taking the replenishment posture by mistake due to vibrations during transportation or a similar failure from the shipment until the installation of the printer 100.

The printer 100 that includes the toner container 30 according to the embodiment of the disclosure is described above. This configuration restrains the use of the printer 100 in the state where the toner container 30 cannot replenish the toner to the developing device 20. The disclosure is not limited to the embodiment and can employ, for example, the following modified embodiments.

(1) The above-described embodiment describes an aspect that the urging force from the coil spring 60S locates the regulating member 60 in the first position during usual usage of the printer 100; however the disclosure is not limited to this. An aspect where the regulating member 60 does not include the coil spring 60S and a rotation moment around the shafts 601 generated by its own weight of the regulating member 60 configures the regulating member 60 in the first position may be employed. In this case, at the shipment of the printer 100, the position of the regulating member 60 is initially configured in the second position against the above-described rotation moment. In this respect as well, the operator inserts a thin bar-shaped member to the hole 106E to ensure configuring the regulating member 60 in the second position. When the use of the printer 100 is started, once opening the front cover 106 locates the regulating member 60 in the first position by its own weight of the regulating member 60.

(2) The above-described embodiment describes an aspect where the regulating member 60 is located in the second position (see FIGS. 25A and 25B) at the shipment of the printer 100 and the toner container 30 is located at the insertion position (see FIGS. 19 to 20C). However, the disclosure is not limited to this. In the case of the above-described aspect, with the toner container 30 packed together with the housing 101, the printer 100 can be shipped. However, in this case, the elastic pieces 32B5 on the toner container 30 abut the elastic piece pressing portions 306 and are elastically deformed continuously during transportation of the printer 100. This possibly degrades the function of the elastic pieces 32B5.

Therefore, this modified embodiment employs the insertion posture illustrated in FIGS. 19 to 20C as a third posture of the disclosure. A posture by which the toner container 30 is rotationally driven from the above-described insertion posture in the first rotation direction (the arrow DM in FIG. 21A) by a predetermined angle is defined as a shipment posture (a second posture). FIGS. 21A to 21C are cross sections illustrating the shipment posture of the toner container 30. In other words, in the modified embodiment, the insertion posture of the toner container 30 (the third posture) is a posture that the toner container 30 is rotationally driven in the second rotation direction with respect to the shipment posture (the second posture) by a predetermined angle.

With the shipment posture illustrated in FIGS. 21A to 21C, since a pair of the elastic pieces 32B5 detach from a pair of the elastic piece pressing portions 306, the elastic force from the elastic pieces 32B5 is released. This configuration prevents the elastic pieces 32B5 from being elastically deformed continuously from the shipment until the installation of the printer 100. This restrains the elastic deformation of the elastic pieces 32B5. When the printer 100 is installed, with the elastic force from a pair of the elastic pieces 32B5 released, the container main body 31 of the toner container 30 is rotationally driven from the shipment posture in the first rotation direction and is configured to take the replenishment posture (see FIG. 22). The toner discharge port 30P communicates with the toner replenishment port 204 (see FIG. 23B). This configuration prevents the elastic pieces 32B5 from being elastically deformed continuously also at the use of the printer 100. This stably restrains the elastic deformation of the elastic pieces 32B5.

With the toner container 30 provided with the second lock engaging portion 313, as illustrated in FIG. 21A, the lock abutment piece 202S of the lock button 202 is engageable with the second lock engaging portion 313. This ensures shipping the printer 100 with the toner container 30 maintained in the shipment posture. The toner container 30 not packed together with the printer 100, in other words, the toner container 30 for replacement after the start of use of the printer 100 needs not to be held by the shipment posture as described above. Therefore, this toner container 30 may be an aspect that does not include the second lock engaging portion 313. In this case, since the second lock engaging portion 313 is located at the container cover 31C of the toner container 30, preliminary preparing the container cover 31C that includes the second lock engaging portion 313 and the container cover 31C that does not include the second lock engaging portion 313 reduces an entire cost of the toner container 30.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. An image forming apparatus comprising:

an apparatus main body that includes an openable/closable cover member and an internal space;

an image carrier located in the apparatus main body, the image carrier having a circumference surface on which an electrostatic latent image is formed by rotationally driving the image carrier;

a developing device that includes a developer replenishment port to which a developer is replenished, the developing device supplying the image carrier with the developer;

a developer housing container that includes a developer discharge port from which the developer is discharged, the developer housing container taking a posture changeable between a first posture and a second posture in which the developer housing container is mountable to the internal space with the cover member open and internally houses the developer, the developer discharge port communicating with the developer replenishment port such that the developer is replenishable to the developing device in the first posture, the second posture locating the developer discharge port separate from the developer replenishment port and sealing the developer discharge port; and a regulating member located in the cover member, the regulating member allowing the cover member to be closed with respect to the apparatus main body while the developer housing container takes the first posture in the apparatus main body, the regulating member regulating the cover member to be closed with respect to the apparatus main body by an interference with the developer housing container while the developer housing container takes the second posture; wherein the developer housing container changes the posture to the first posture when the developer housing container in the second posture is rotationally driven in a first rotation direction around a predetermined axis in the internal space, the developer housing container changing the posture to the second posture when the developer housing container in the first posture is rotationally driven in a second rotation direction around the axis, the second rotation direction being a direction opposite from the first rotation direction;

the regulating member takes a position changeable between a first position and a second position, the first position allowing the cover member to be closed with respect to the apparatus main body while the developer housing container takes the first posture in the apparatus main body, the regulating member in the first position interfering with the developer housing container while the developer housing container takes the second posture, the second position allowing the cover member to be closed with respect to the apparatus main body while the developer housing container takes the second posture; and the developer housing container is initially configured to take the second posture, the position of the regulating member being initially configured in the second position.

2. The image forming apparatus according to claim 1, wherein the regulating member includes a shaft rotatably journaled to the cover member, the position of the regulating member being changeable between the first position and the second position through turning around the shaft, the regulating member in the first position being located along an inner wall surface of the cover member, the regulating member in the second position projecting from the inner wall surface toward the internal space.

3. The image forming apparatus according to claim 2, further comprising:

an urging spring located around the shaft, the urging spring urging the regulating member toward the first position; wherein the position of the regulating member is initially configured in the second position against an urging force from the urging spring.

4. The image forming apparatus according to claim 2, wherein:

when the cover member is closed with respect to the apparatus main body, a rotation moment around the shaft generated by the regulating member under its own weight configures the position of the regulating member to the first position; and the position of the regulating member is initially configured to be the second position against the rotation moment.

5. The image forming apparatus according to claim 1, wherein the regulating member initially located in the second position regulates the rotation of the developer housing container in the second posture in the first rotation direction.

6. The image forming apparatus according to claim 1, wherein:

the developer housing container includes a container main body that includes an engaged portion, the container main body internally housing the developer, and a shutter slidably movable with respect to the container main body in the first rotation direction and the second rotation direction, the shutter sealing or opening the developer discharge port;

the shutter includes a shutter main body that seals the developer discharge port, and a stopper member mounted to the shutter main body, the stopper member regulating or allowing the slide movement of the shutter with respect to the container main body;

the stopper member includes a fulcrum swingably journaled to the shutter main body, a lock piece engageable with the engaged portion on the container main body, and a pressed portion located on a side opposite from the lock piece with respect to the fulcrum; and when the pressed portion is pressed to swing the stopper member around the fulcrum, the engagement between the lock piece and the engaged portion is released to cause the shutter to be slidably movable with respect to the container main body.

7. The image forming apparatus according to claim 6, wherein:

the stopper member includes a pair of elastic pieces;

the container main body of the developer housing container includes a pair of protrusions, the pair of protrusions being opposed to the pair of elastic pieces at a position where the shutter seals the developer discharge port; and when the pressed portion is pressed to swing the stopper member around the fulcrum with the developer discharge port sealed by the shutter, the engagement between the lock piece and the engaged portion is released, and an elastic force from the elastic pieces giving a urging force around the fulcrum to the stopper member in a direction that the lock piece engages the engaged portion, the elastic force being generated by abutting the pair of elastic pieces with the pair of protrusions.

8. The image forming apparatus according to claim 7, wherein:

the developing device includes a pressing portion configured to press the pressed portion on the shutter of the developer housing container;

mounting the developer housing container to the developing device in the apparatus main body in a third posture presses the pressed portion by the pressing portion, the developer housing container in the third posture being rotationally driven by a predetermined angle in the second rotation direction from the second posture; and when the container main body in the third posture is rotationally driven in the first rotation direction to take the second posture with the shutter on the developer housing container secured, the pair of elastic pieces are detached from the pair of protrusions to release the elastic force from the elastic pieces.

9. The image forming apparatus according to claim 8, wherein when the container main body in the second posture is rotationally driven in the first rotation direction to take the first posture with the elastic force from the pair of elastic pieces released, the developer discharge port communicates with the developer replenishment port.

* * * * *